US011701573B2

(12) United States Patent
Anderson et al.

(10) Patent No.: US 11,701,573 B2
(45) Date of Patent: Jul. 18, 2023

(54) ROTATION POWERED VEHICLE

(71) Applicants: Steven Craig Anderson, Lompoc, CA (US); Phillip R. Dinter, Lompoc, CA (US)

(72) Inventors: Steven Craig Anderson, Lompoc, CA (US); Phillip R. Dinter, Lompoc, CA (US)

( * ) Notice: Subject to any disclaimer, the term of this patent is extended or adjusted under 35 U.S.C. 154(b) by 0 days.

(21) Appl. No.: 17/537,025

(22) Filed: Nov. 29, 2021

(65) Prior Publication Data

US 2022/0080292 A1 Mar. 17, 2022

Related U.S. Application Data

(63) Continuation of application No. 16/646,422, filed as application No. PCT/US2018/050276 on Sep. 10, 2018, now Pat. No. 11,213,739.

(Continued)

(51) Int. Cl.

| | |
|---|---|
| ***A63C 17/12*** | (2006.01) |
| ***A63C 17/01*** | (2006.01) |
| ***A63C 17/02*** | (2006.01) |

(52) U.S. Cl.

CPC ..... *A63C 17/12* (2013.01); *A63C 17/015* (2013.01); *A63C 17/02* (2013.01)

(58) Field of Classification Search

CPC ..... A63C 17/12

See application file for complete search history.

(56) References Cited

U.S. PATENT DOCUMENTS 4,411,442 A * 10/1983 Rills ..... B62M 1/32 74/577 M
4,504,041 A * 3/1985 Raz ..... B66F 7/0625 254/9 R (Continued)

FOREIGN PATENT DOCUMENTS

GB 2528678 * 2/2016 ..... A63C 17/12

*Primary Examiner* — Brian L Swenson
(74) *Attorney, Agent, or Firm* — Felix L. Fischer

(57) ABSTRACT

A rotation powered vehicle drive mechanism includes an elongated chassis slot disposed within a respective lateral exterior portion of a chassis assembly. An elongated platform slot is disposed within a respective lateral portion of a platform assembly, and is configured such that it is substantially opposed to the chassis slot. The platform assembly is pivotally secured to the chassis assembly thereby allowing for rotation through a platform rotation angle of the platform assembly with respect to the chassis assembly about a rotation axis. The rotation of the platform assembly results in an increase or decrease of a variable slot height which is measured between the chassis slot and the platform slot. A cart assembly is disposed between the chassis assembly and the platform assembly, and is operatively coupled to the chassis slot and to the platform slot. The cart assembly has a cart height and is constrained by the chassis slot and the platform slot to a position on the chassis assembly wherein the cart height is substantially equivalent to the variable slot height. In this manner the cart assembly is configured to translate along the chassis assembly upon rotation of the platform assembly with respect to the chassis assembly. A helical drive shaft is rotationally secured within the chassis assembly and operatively coupled to the cart assembly such that translation of the cart assembly results in rotational motion of the helical drive shaft. A truck assembly is pivotally secured to the chassis assembly. The truck assembly includes an axle rotationally secured to the truck assem- (Continued)

bly and operatively coupled to a plurality of wheels. The axle is operatively coupled to the helical drive shaft such that rotation of the platform assembly with respect to the chassis assembly in a first angular direction results in rotation of the axle and respective wheels in the first angular direction.

19 Claims, 30 Drawing Sheets

Related U.S. Application Data

(60) Provisional application No. 62/557,663, filed on Sep. 12, 2017.

(56) References Cited

U.S. PATENT DOCUMENTS

| | | | | |
|---|---|---|---|---|
| 5,310,202 | A * | 5/1994 | Goodspeed | A63C 17/12 280/11.115 |
| 7,040,638 | B2 * | 5/2006 | Cole | A63C 17/12 180/181 |
| 7,073,805 | B2 * | 7/2006 | Yan | A63C 5/04 280/221 |
| 2007/0262546 | A1 * | 11/2007 | Bertiller | B60L 50/52 74/502.2 |
| 2016/0001167 | A1 * | 1/2016 | Anderson | A63C 17/12 180/181 |
| 2016/0045814 | A1 * | 2/2016 | Zhou | A63C 17/12 280/221 |
| 2019/0329122 | A1 * | 10/2019 | Lee | B62M 1/30 |

* cited by examiner

ROTATION POWERED VEHICLE

REFERENCE TO RELATED APPLICATIONS

This application is a continuation of U.S. Ser. No. 16/646,422 filed on Mar. 11, 2020 which relies of the priority of U.S. provisional application Ser. No. 62/557,663 filed on Sep. 12, 2017 entitled Rotation Powered Vehicle, the disclosures of which are incorporated herein by reference.

BACKGROUND

Device and methods for a rotation powered vehicle are described, the rotation powered vehicle may have a platform which is pivotally attached to a chasses. Performing a rotational motion of the platform with respect to the chassis in either of two angular directions will result in the propulsion of the rotation powered vehicle in a single linear direction. The conversion of a rotational motion of the platform in either of two directions into a linear motion of the rotation powered vehicle in a single direction may be accomplished using multiple drive mechanisms, which may utilize hydraulic or mechanical methods and devices to accomplish the conversion.

There are a variety of power methods and devices for the purposes of providing a motive force to skateboards. These methods may include but are not limited to gas power via a gasoline engine attached to the skateboard and electric motors attached to the skateboard. These methods are convenient for a rider of the board but are damaging to the environment. Other "human" power methods may include skateboards that use a "serpentine" motion of the board in order to provide a motive force, or a rider of the skateboard may simply "kick" themselves along by dropping one foot to the ground while riding the board. These human powered methods are less convenient for a rider of the skateboard.

What have been needed are devices and methods for a rotation powered vehicle which is capable of a power cycle consisting of a first half power cycle where the platform is rotated in a first angular direction thereby providing the rotation powered vehicle a motive force such that it moves in a first linear direction, and a second half power cycle where the platform is rotated in a second angular direction thereby providing the rotation powered vehicle a motive force such that it also moves in a first linear direction. What are also needed are devices and methods which provide environmentally sound strategies such as mechanical or hydraulic drive mechanisms for converting the rotational motion of the platform into translational motion of the rotation powered vehicle. Finally, the devices and methods for converting the rotational motion of the platform into a translational motion of the rotation powered vehicle must be configured such that a small rotational motion of the platform will provide a large translational motion of the rotation powered vehicle such that a rider of the rotation powered vehicle does not require a handle to hold onto.

SUMMARY

Some embodiments of a rotation powered vehicle may include a chassis assembly and a platform assembly which may be pivotally secured to the chassis assembly such that the platform assembly may rotate with respect to the chassis assembly about a platform rotation axis. The rotation powered vehicle may also include a drive mechanism, the drive mechanism having a cart assembly which may be operatively coupled between the chassis assembly and the platform assembly such that rotation of the platform assembly with respect to the chassis assembly results in translation of the cart assembly along the chassis assembly. The drive mechanism may also include a helical drive shaft which may be rotationally secured within the chassis assembly. The helical drive shaft may be operatively coupled to the cart assembly such that translation of the cart assembly along the chassis assembly results in rotational motion of the helical drive shaft.

The rotation powered vehicle may also include a truck assembly which is pivotally secured to the chassis assembly. The truck assembly may include an axle which may be rotationally secured to the truck assembly, with the axle being operatively coupled to a plurality of wheels. In some cases, the axle may be operatively coupled to the helical drive shaft such that rotation of the platform assembly with respect to the chassis assembly in a first angular direction results in translation of the cart assembly along the chassis assembly and rotation of the axle and wheels in the first angular direction.

Some embodiments of a rotation powered vehicle may include a chassis assembly and a platform assembly which may be pivotally secured to the chassis assembly such that the platform assembly may rotate with respect to the chassis assembly about a platform rotation axis. The rotation powered vehicle may also include a drive mechanism which may have a plurality of linkages which may be operatively coupled to the chassis assembly, the platform assembly, and/or to adjacent linkages such that rotation of the platform assembly with respect to the chassis assembly results in rotation and/or translation of the linkages. The drive mechanism may also include a helical drive shaft which may be rotationally secured within the chassis assembly. The helical drive shaft may be operatively coupled to a drive linkage such that translation of a drive chassis section of the drive linkage along the chassis assembly results in rotational motion of the helical drive shaft.

The rotation powered vehicle may also include a truck assembly which may be pivotally secured to the chassis assembly. The Truck assembly may include an axle which may be rotationally secured to the truck assembly and operatively coupled to a plurality of wheels. The axle may be operatively coupled to the helical drive shaft such that rotation of the platform assembly with respect to the chassis assembly in a first angular direction results in translation of the drive chassis section along the chassis assembly and rotation of the axle and wheels in the first angular direction.

Some embodiments of a rotation powered vehicle may include a chassis assembly and a platform assembly which may be pivotally secured to the chassis assembly 368 such that the platform assembly may rotate with respect to the chassis assembly about a platform rotation axis. The rotation powered vehicle may also include a drive mechanism which may have a chassis platform belt which may be operatively coupled between the platform assembly and the chassis assembly. The drive mechanism may also include a sprocket assembly which may be disposed within the chassis assembly and which may be operatively coupled to the chassis platform belt.

The rotation powered vehicle may also include a truck assembly which may be pivotally secured to the chassis assembly. The truck assembly may include an axle which may be rotationally secured to the truck assembly and operatively coupled to a plurality of wheels. The axle may be operatively coupled to the sprocket assembly by a sprocket axle belt, with the sprocket assembly being configured to rotate via the sprocket axle belt the axle and respective wheels in a first angular direction when rotation of the platform assembly with respect to the chassis assembly in the first angular direction translates the chassis platform belt about the sprocket assembly.

Some embodiments of a rotation powered vehicle may include a chassis assembly and a platform assembly which is pivotally secured to the chassis assembly. The rotation powered vehicle may also include a power cycle dampener which is operatively coupled between the chassis assembly and the platform assembly. The rotation powered vehicle may also include at least one drive mechanism which is operatively coupled between the chassis assembly and the platform assembly; and at least one truck assembly which is pivotally secured to the chassis assembly. The rotation powered vehicle may also include at least one steering dampener mechanism which is operatively coupled between the at least one truck assembly and the chassis assembly.

DETAILED DESCRIPTION

Figure 1:
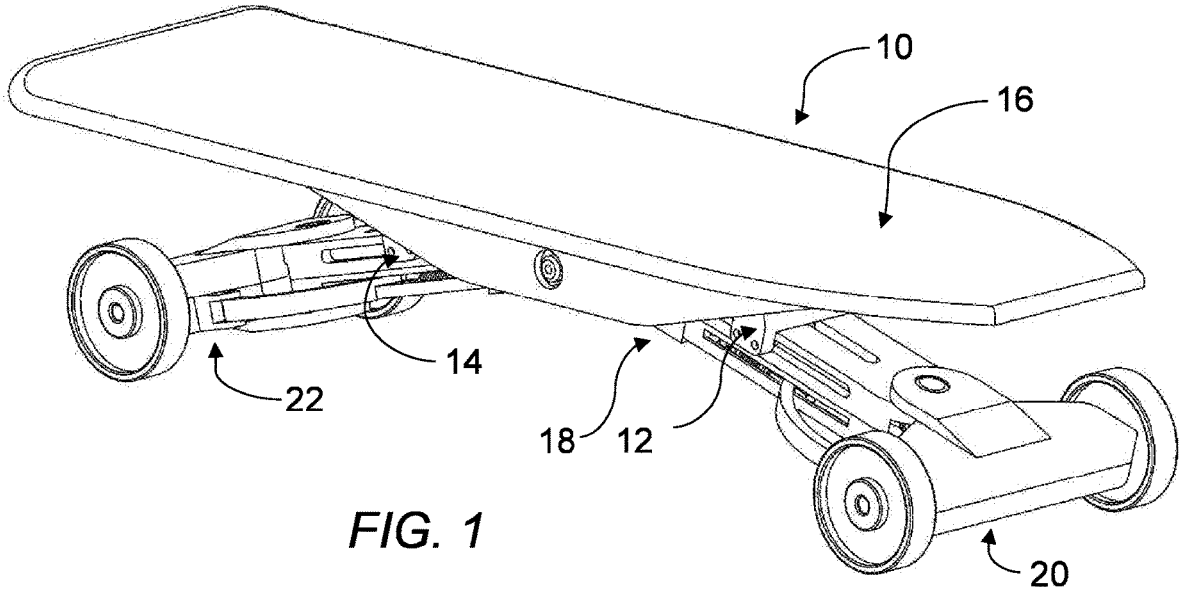
FIG. 1 is a perspective view of a rotation powered vehicle embodiment having a platform assembly which is rotationally secured to a chassis assembly and multiple drive mechanisms, each drive mechanism utilizing a cart assembly and respective helical drive shaft to power the vehicle.

Some embodiments are directed at a rotation powered vehicle on which a rider can propel themselves by rotating a platform on which they stand in either of two angular directions. The platform may be pivotally secured to chasses which may have a plurality of axles and a plurality of wheels which are secured to the axles. It is important that the rotational motion of the platform be small such that a rider of the rotation powered vehicle may comfortably stand on the platform and maintain their balance as they rotate the platform with their feet.

It is also important that the small rotational motion of the platform be translated into a large linear motion of the rotation powered vehicle. Multiple drive mechanisms are required to convert the rotational motion of the platform into a linear motion of the vehicle. Each drive mechanism converts a small rotational motion of the platform into a larger linear motion of the vehicle. A drive mechanism can convert a rotational motion of the platform in a first angular direction into a translational motion of the vehicle in a first linear direction, and a second drive mechanism can convert a rotational motion of the platform in a second angular direction into a translational motion of the vehicle in the first linear direction.

Some embodiments of the rotation powered vehicle may be powered by a series of power cycles. Each power cycle may consist of a first half power cycle wherein the platform is rotated in the first angular direction which activates the first drive mechanism and which moves the rotation powered board in the first linear direction. The first half power cycle may be followed by a second half power cycle wherein the platform is rotated in the second angular direction which activates the second drive mechanism and which moves the rotation powered board in the first linear direction.

Some embodiments of the rotation powered vehicle may also allow for the steering of the vehicle through the rotation of the platform in third and fourth angular directions. Thus a rider of the rotation powered vehicle can propel the vehicle by rotating the platform in either of two angular directions both of which are in a plane which is perpendicular to the surface of the platform and which is parallel to the direction of travel. A rider of the rotation powered vehicle may then steer the board in either of two additional angular directions both of which are in a plane which is perpendicular to the surface of the platform and which is perpendicular to the direction of travel.

Such embodiments of the rotation powered vehicle provide a rider of the vehicle with a more "natural" riding experience. That is to say riding the rotation powered vehicle will be very similar to surfing wherein a rider of a surfboard leans the board in either of two angular directions both of which are in a plane which is perpendicular to the surface of the board and which is perpendicular to the direction of travel in order to steer the board. Additionally, a rider of a surfboard may bounce up and down on the surfboard in order to propel the board forward. This is a technique which surfers refer to as "pumping" the surfboard. This "pumping" motion is similar to the rotational motions of the rotation powered vehicle which propel it forward.

For some embodiments of the rotation powered vehicle, the midpoint of the platform with respect to the direction of travel may be secured in proximity to the midpoint of the chasses. This allows for a rider of the rotation powered vehicle to alter the power of a power cycle by altering where their feet are on the platform in relation to the midpoint of the platform. A rider standing on with their feet spread apart along the axis of motion will have their feet positioned at points far from the midpoint of the platform and will thus generate a larger rotational moment (resulting in more power transferred to the drive mechanisms) about the midpoint of the platform. A rider standing on with their feet close together along the axis of motion will have their feet positioned at points close to the midpoint of the platform and will thus generate a small rotational moment (resulting in less power transferred to the drive mechanisms) about the midpoint of the platform.

As discussed above, each drive mechanism should ideally convert small rotational energy of the platform into large translational motion of the rotation powered vehicle. Some embodiments of rotation powered vehicle drive mechanism may include a helical drive shaft which is suitably coupled to the wheels of the rotation powered vehicle. Rotational motion of the platform with respect to the chassis may be suitably converted into rotational motion of the helical drive shaft, and for some rotation powered vehicle embodiments each helical drive shaft may be rotationally disposed within the chassis assembly.

Some embodiments of rotation powered vehicles may be configured with a chassis assembly which is elongated in the direction of translational motion, which is a chassis body may be designed such that its length (along the direction of translational powered motion) is greater than its width. It is advantageous to use as much of the chassis body as possible in order to maximize the number of turns of the wheel per revolution of the platform assembly. Putting the helical drive shaft in the body lengthwise allows for a long helical drive shaft; a long helical drive shaft means more turns of the wheel per full revolution of the platform (during a power cycle). The chassis may thus in general be configured to be longer in the direction of motion and less wide in a direction perpendicular to the motion. Additionally, steering of the rotation powered vehicle may require the platform and chassis to be thinner in directions perpendicular to the direction of motion in order to avoid the platform or chassis hitting the ground while steering.

Figure 2:
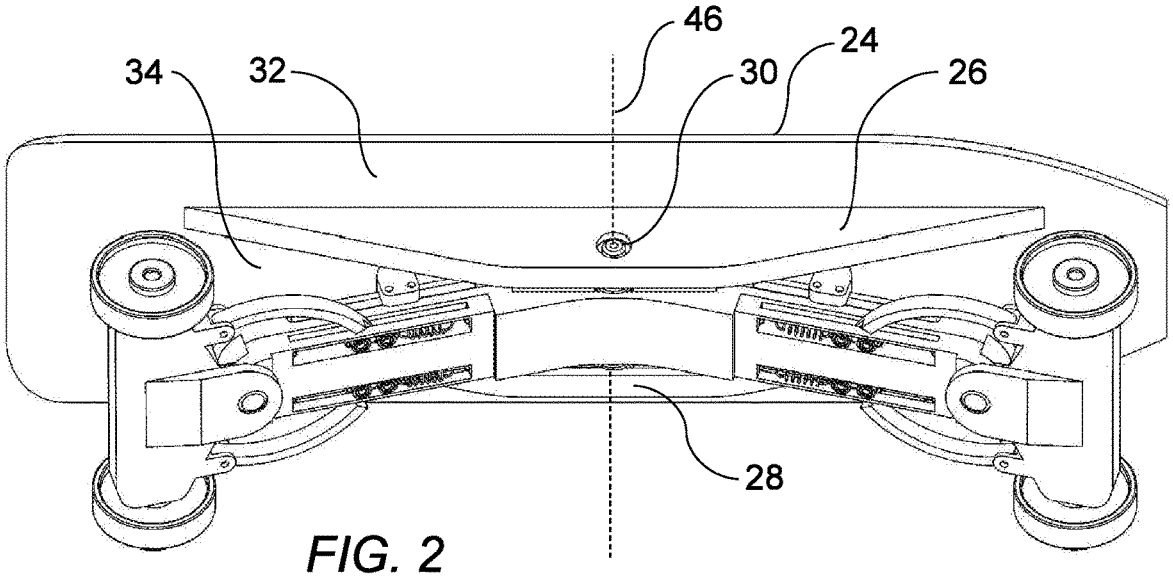
FIG. 2 is a perspective view of the rotation powered vehicle of claim 1.
Figure 3:
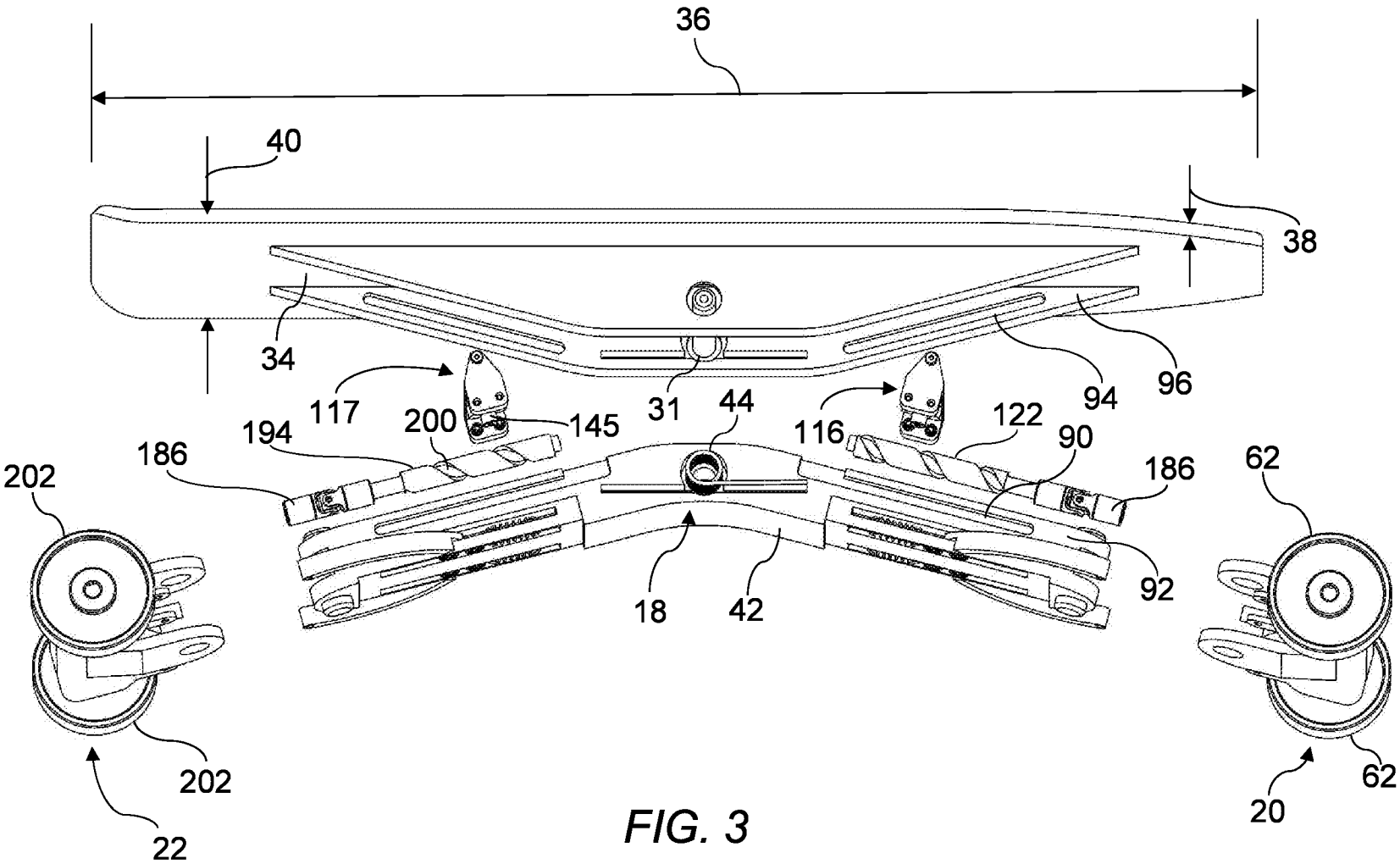
FIG. 3 is an exploded view of the rotation powered vehicle embodiment of FIG. 1.

An embodiment of a rotation powered vehicle 10 having a drive mechanism 12 and a second drive mechanism 14 each of which utilize a helical drive shaft is shown in FIGS. 1-3. The rotation powered vehicle may include a platform assembly 16, a chassis assembly 18, and a truck assembly 20 and a second truck assembly 22. The platform assembly 16 may be configured to support a rider, to pivotally secure to the chassis assembly 18, and to operatively couple the platform assembly 16 to the chassis assembly 18 via the drive mechanisms 12 and 14.

The platform assembly may include a board 24, a first side panel 26, a second side panel 28, and a pivot rod 30. For some embodiments of the platform assembly 16 the first and second side panels 26 and 28 may be secured to a lower board surface 32, and the first and second side panels may be separated by a chassis gap 34. The pivot rod 30 may be rotationally secured to the first side panel 26 and the second side panel 28 by pivot channels 31 which may disposed within the first side panel 26 and the second side panel 28. In some cases, the pivot rod 30 and respective pivot channel 31 may each have a substantially cylindrical shape. For some embodiments, the pivot rod 30 may be rigidly secured to the chassis assembly 18 by any suitable means such as an adhesive or pins. The pivot rod 30 may span the chassis gap 34 disposed between the first side panel 26 and the second side panel 28. The pivot rod 30 may thus rotationally secure the platform assembly 16 to the chassis assembly 18 such that the platform assembly 16 may rotate with respect to the chassis assembly 18 about a platform rotation axis 46. For some embodiments the board 24 (and some other board embodiments discussed herein) may have a length 36 from about 18 inches to about 40 inches, a width 40 from about 4 inches to about 12 inches, and a thickness 38 from about 0.25 inches to about 2 inches. The board 24 and side panels 26 and 28 may be fabricated from any suitable material such as wood, plastic, metal, or composite materials.

The chassis assembly 18 may be configured to pivotally secure to the platform assembly 16 and to operatively couple to the platform assembly 16 via the drive mechanisms 12 and 14. The chassis assembly 18 may include a chassis body 42, and at least one power cycle dampener 44 which may be disposed between the chassis body 42 and the platform assembly 16. The at least one power cycle dampener 44 may be configured to provide a restorative force to the platform assembly 16 when the platform assembly 16 is rotated about the platform rotation axis 46 and through a platform rotation angle 48 from a neutral platform position (in FIG. 4 the platform assembly is disposed in the neutral platform position). In this manner the at least one power cycle dampener 44 acts (via the restorative forces) to maintain the platform assembly 16 in the neutral position. For rotation powered vehicle embodiments discussed herein, any suitable configuration of power cycle dampener may be operatively coupled between the respective platform and chassis assemblies. The power cycle dampeners may be configured as leaf springs, compression springs, tension springs, or the like.

For some embodiments the platform rotation axis 46 may be substantially perpendicular to a first linear direction 50 of travel of the rotation powered vehicle 10, and substantially parallel to a drive surface 52 which the rotation powered vehicle 10 travels on. For some embodiments the chassis assembly 18 (and some other chassis embodiments discussed herein) may have a length 54 of about 12 inches to about 36, a width 56 of about 3 inches to about 6 inches, and a thickness 58 of about 1 inches to about 4 inches. The chassis body 42 may be fabricated from any suitable material such as wood, plastic, metal, or composite materials.

The truck assembly 20 may include an axle 60 which is rotationally secured to the truck assembly 20, with the axle 60 additionally being operatively coupled to a plurality of wheels 62. The truck assembly 20 may be pivotally coupled to the chassis assembly 18 and operatively coupled to the chassis assembly 18 by the drive mechanism 12. The truck assembly 20 may be pivotally coupled to the chassis assembly 18 such that rotation of the platform assembly 16 and the chassis assembly 18 in a third angular direction 64 or a fourth angular direction 66 results in rotational motion of the truck assembly 20 with respect to the chassis assembly 18 about a truck pivot axis 68 and through a truck pivot angle 70. The truck assembly 20 may be pivotally secured to the chassis assembly 18 by at least one chassis steering boss 89, which may be coupled to a respective truck steering channel 91 (see FIGS. 20A and 20B). In some cases the chassis steering boss 89 may be configured as a cylindrical protrusion which extends from the chassis body 42, and the truck steering channel 91 may be configured as a mating cylindrical channel formed into a truck body 43. The chassis steering boss 89 may thus act to constrain via the truck steering channel 91 the motion of truck assembly 20 to rotational motion about the truck pivot axis 68. For some embodiments the truck assembly 20 (and some other truck assembly embodiments discussed herein) may have a width 72 from about 3 inches to about 8 inches, and a thickness 74 from about 0.75 inches to about 2 inches. The truck assembly 20 may be fabricated from any suitable material such as wood, plastic, metal, or composite materials.

The wheels 62 of the truck assembly 20 may be constrained to lie on the drive surface 52 such that a wheel axis 76 of each wheel is substantially parallel to the drive surface 52. Rotation of the platform assembly 16 and the chassis assembly 18 in the third angular direction 64 or the fourth angular direction 66 results in the application of a plurality of eccentric steering forces 78 to the truck assembly 20 by the chassis assembly 18 (the steering forces 78 being configured as a distributed force over the respective contact surfaces). The constraint of the wheels 62 by the drive surface 52 and the plurality of eccentric steering forces 78 applied to the truck assembly 20 by the chassis assembly 18 leads to the rotation of the truck assembly 20 with respect to the chassis assembly 18 about the truck pivot axis 68.

Figure 20:
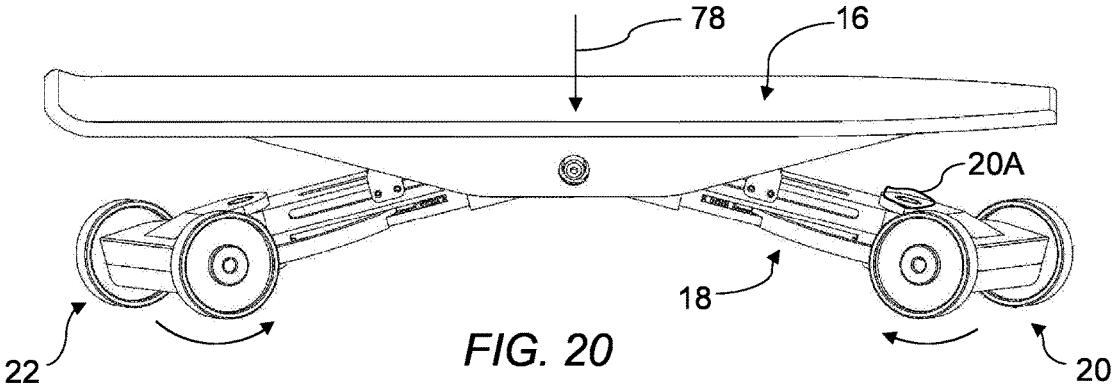
FIG. 20 is a perspective view of the rotation powered vehicle of FIG. 1 depicting an eccentric steering force applied to the platform assembly, with resulting rotation of the truck assembly and the second truck assembly with respect to the chassis.
Figure 20A:
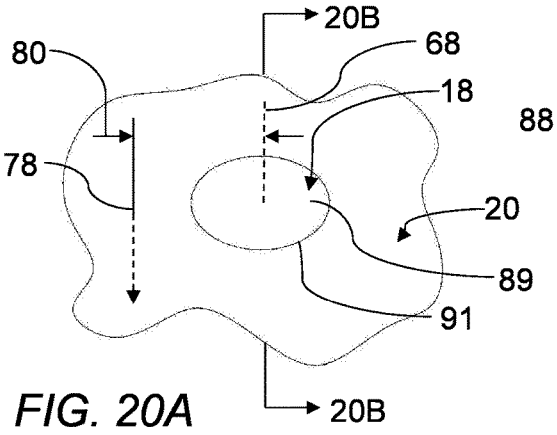
FIG. 20A is an enlarged detail view of FIG. 20 depicting a chassis steering boss, a truck steering channel, and a steering force.
Figure 20B:
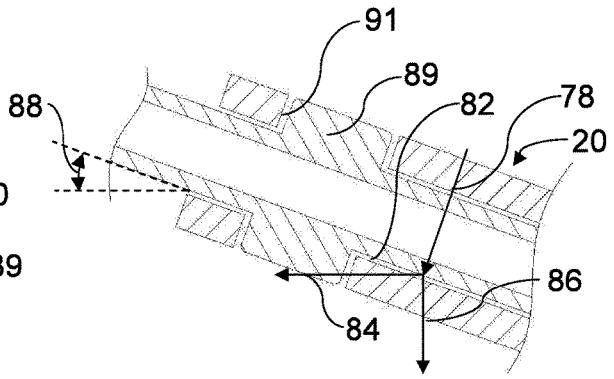
FIG. 20B is a sectional view of FIG. 20A depicting a chassis steering boss, a truck steering channel, a steering force, and steering force components with components of the chassis assembly and truck assembly hidden for purposes of illustration.

An example of an eccentric steering force 78 is shown in FIGS. 20A and 20B. The purpose of showing a single eccentric steering force 78 (as opposed to a distributed force) is to illustrate the components of the eccentric steering force 78, one of which leads to rotation of the truck assembly 20 with respect to the chassis assembly 18. Rotation of the platform assembly 16 and chassis assembly 18 in the third angular direction 64 or in the fourth angular direction 66 results in the application of a plurality of eccentric steering forces 78 to the truck assembly 20 by the chassis assembly 18, a single eccentric steering force 78 is shown in FIG. 20A, along with a truck pivot axis 68.

In this case the eccentric steering force 78 is offset from the truck pivot axis 68 by a steering force offset 80. Each eccentric steering force 78 (of the distributed force between the chassis assembly 18 and the truck assembly 20) would have a respective steering force offset 80. Additionally, the eccentric steering force 78 is applied such that it is normal to an inner surface 82 of the truck assembly 20. The components of the eccentric steering force 78 are shown in FIG. 20B, and include a first steering force component 84 and a second steering force component 86. The first steering force component 84 is the component of the eccentric steering force 78 that leads to rotation of the truck assembly 20 with respect to the chassis assembly 18 with rotation of the platform assembly 16 and the chassis assembly 18 in the third angular direction 64 or the fourth angular direction 66. A steering angle 88 between the chassis assembly/18 truck assembly 20 connection and the drive surface 52 determines the magnitude of the first steering force component 84 and the second steering force component 86. Increasing the steering angle 88 increases the magnitude of the first steering force component 84 with respect to the second steering force component 86 and vice versa.

As discussed above the rotation powered vehicle 10 may include multiple drive mechanisms, specifically the drive mechanism 12 and the second drive mechanism 14 which may be configured similarly to the drive mechanism 12. The drive mechanism 12 may include an elongated chassis slot 90 which is disposed within a respective lateral exterior portion 92 of the chassis assembly 18. The drive mechanism 12 may also include an elongated platform slot 94 which is disposed within a respective lateral interior portion 96 of the platform assembly 16 and which is configured such that it is substantially opposed to the chassis slot 90. As discussed above the platform assembly 16 may be pivotally secured to the chassis assembly 18 thereby allowing for rotation through the platform rotation angle 46 of the platform assembly 16 with respect to the chassis assembly 18 about the platform rotation axis 46. The rotation of the platform assembly 16 about the platform rotation axis 46 resulting in an increase or decrease of a variable slot height 98 which is measured between the chassis slot 90 and the platform slot 94.

Figure 4:
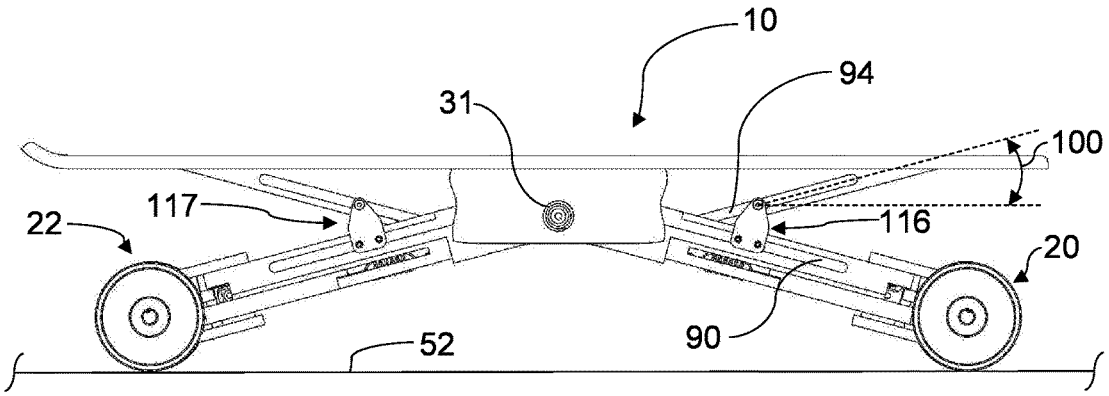
FIG. 4 is an elevation view in partial section of the rotation powered vehicle of FIG. 1.

For some embodiments, the platform slot 94 may be disposed within the platform assembly 16 at a platform slot angle 100 of about zero degrees to about 25 degrees (see FIG. 4). Additionally, the chassis slot 90 may be disposed within the chassis assembly 18 at a chassis slot angle 102 of about zero degrees to about 25 degrees. In some cases the platform slot 94 may incorporate a platform slot plane 104 and the chassis slot 90 may incorporate a chassis slot plane 106. For some embodiments the platform slot plane 104 may be disposed such that it is substantially equidistant from a lower platform slot surface 108 and an upper platform slot surface 110, and may be substantially parallel to the upper and lower platform slot surfaces 108 and 110.

In some cases, the platform slot 94 may be disposed on the platform assembly 16 such that it is offset from the platform rotation axis 46. The platform slot 94 may be disposed such that the platform slot plane 104 is either above or below the platform rotation axis 46. For some embodiments, the platform slot plane 104 may be disposed from about 0.25 inches to about 2 inches above or below the platform rotation axis 46.

The chassis slot plane 106 may be disposed such that it is substantially equidistant from a lower chassis slot surface 112 and an upper chassis slot surface 114, and may be substantially parallel to the lower chassis slot surface 112 and the upper chassis slot surface 114. In some cases, the chassis slot 90 may be disposed on the chassis assembly 18 such that it is offset from the chassis rotation axis 46. The chassis slot 90 may be disposed such that the chassis slot plane 106 is either above or below the platform rotation axis 46. For some embodiments, the chassis slot plane 106 may be disposed from about 0.25 inches to about 2 inches above or below the platform rotation axis 46.

The rotation powered vehicle may also include a cart assembly 116 which may be disposed between the chassis assembly 18 and the platform assembly 16 and which may be operatively coupled to the chassis slot 90 and to the platform slot 94. In some cases the cart assembly 116 may be operatively coupled to the chassis slot 90 by a chassis cart roller 118, and may be operatively coupled to the platform slot 94 by a platform cart roller 120. In some cases the chassis cart roller 118 and platform cart roller 120 may be configured as bearings, wheels, or the like. For the rotation powered vehicle 10 of FIG. 1, the cart assembly 116 may be operatively coupled a helical drive shaft 122 through a top surface 124 of the chassis assembly 18. For some embodiments (not shown), the cart assembly 116 may operatively coupled to the helical drive shaft 122 through a lateral surface 126 of the chassis assembly 18. For helical drive shaft embodiments and chassis body embodiments discussed herein, the helical drive shaft may be disposed within any suitable region of the chassis body. For example the helical drive shaft 122 may be disposed such that it is offset from a central portion of the chassis body 42. The helical drive shaft 122 may be offset towards the top surface 124 of the chassis body 42, or towards the lateral surface 126 of the chassis body 42.

Figure 28:
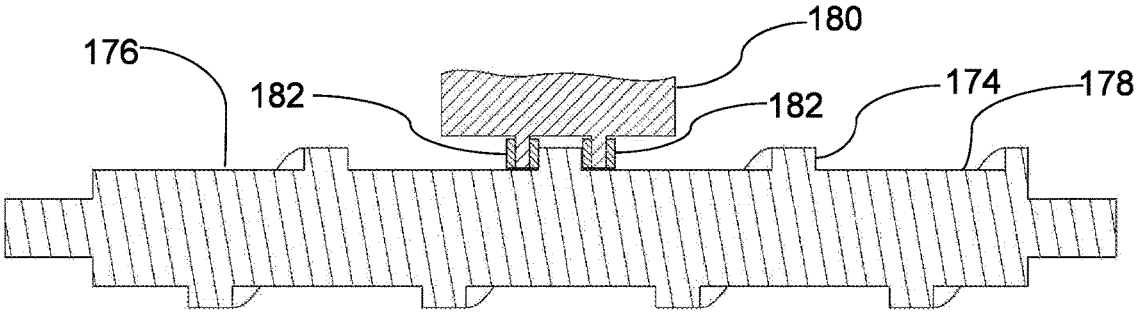
FIG. 28. is a sectional view of the rail drive shaft of FIG. 27, also depicting a cart assembly which is operatively coupled to the rail drive shaft.

For some rotation powered drive mechanism embodiments (not shown), the chassis slot 90 may be configured as a chassis rail and the platform slot 94 may be configured as a platform rail. Instead of slots, the chassis and platform rails would be bosses which extend from the surfaces of the chassis and platform assemblies 18 and 16 respectively. The cart assembly 116 could couple to the respective rails in a manner similar to that which is depicted in FIG. 28. The position and dimensions of the chassis rail and platform rail could be configured to similar to the position and dimensions of the chassis slot 90 and platform slot 94 respectively which have been discussed previously herein.

For the rotation powered vehicle embodiment 10 depicted in FIG. 1, the cart assembly 116 may be slidably and pivotally coupled to the platform slot 94 by a platform cart roller 120, and may be slidably coupled to the chassis slot 90 by a plurality of chassis cart rollers 118. That is to say that the cart assembly 116 is operatively coupled to the platform slot 94 (by platform cart roller 120) such that the cart assembly 116 can slide along the platform slot 94 and pivot with respect to the platform slot 94. Similarly, the cart assembly 116 is slidably coupled to the chassis slot 90 (by the plurality of chassis cart rollers 118) such that the cart assembly 116 can slide along the chassis slot 90, but the cart assembly 116 cannot pivot with respect to the chassis slot 90.

With regard to the rotation powered vehicle 10 which is depicted in FIG. 1, for a fixed platform rotation angle 48 the variable slot height 98 may be measured as the length of a line 128 which originates from a point 130 which is disposed within the chassis slot 90 and disposed on the chassis slot plane 106. The line 128 may be configured such that it is substantially perpendicular to the chassis slot plane 106 and the line may terminate at a point 132 which is disposed on the platform slot plane 104. Thus for any given platform rotation angle 48, the variable slot height 98 can be measured between the platform slot 94 and the chassis slot 90.

Figure 8:
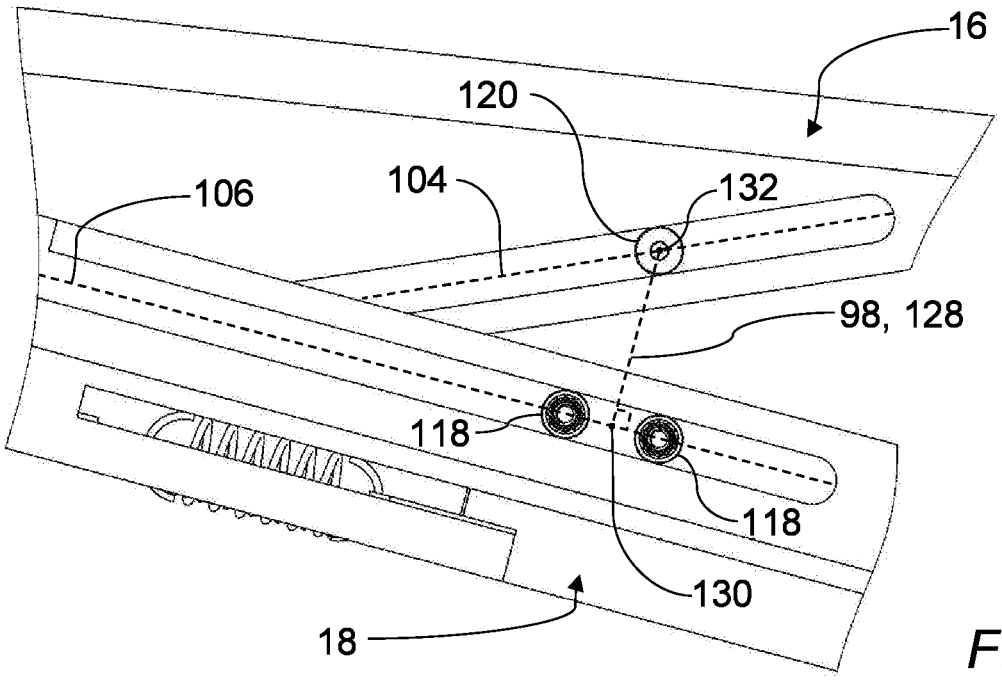
FIG. 8 is the enlarged detail view of FIG. 7 with the cart assembly hidden.
Figure 9:
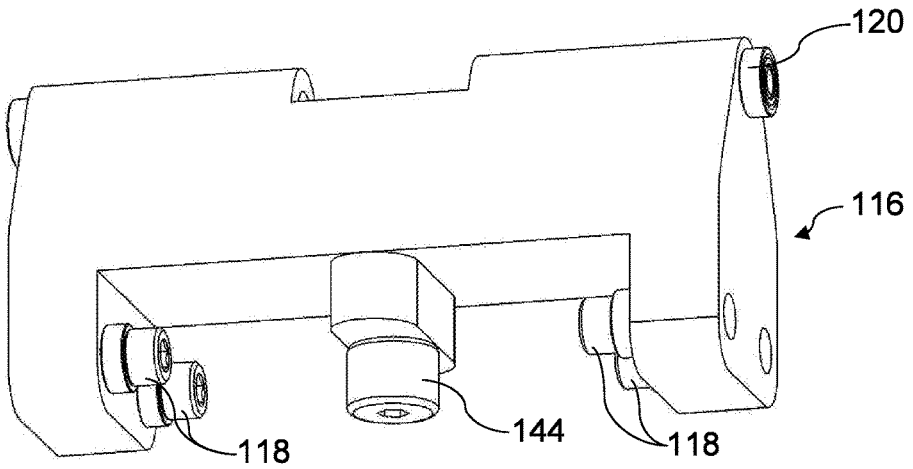
FIG. 9 is a perspective view of the cart assembly.
Figure 10:
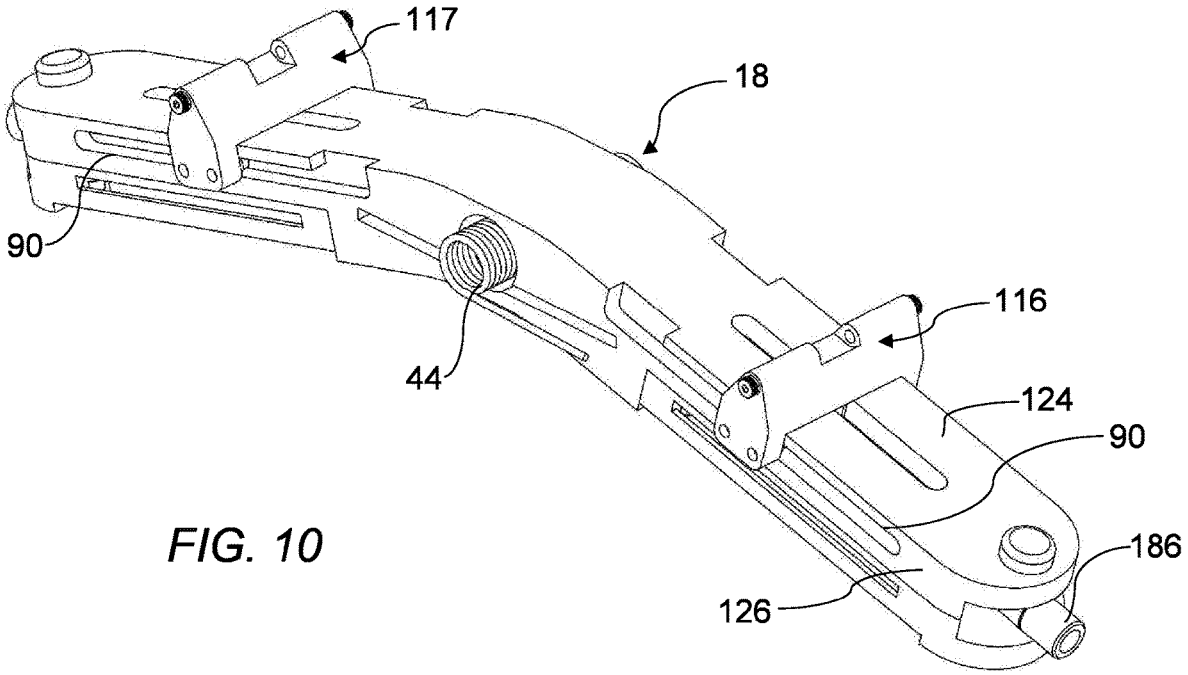
FIG. 10 is a perspective view of the chassis assembly, the cart assembly, a second cart assembly, a helical drive shaft, a second helical drive shaft, multiple universal joints, and a power cycle dampener.
Figure 11:
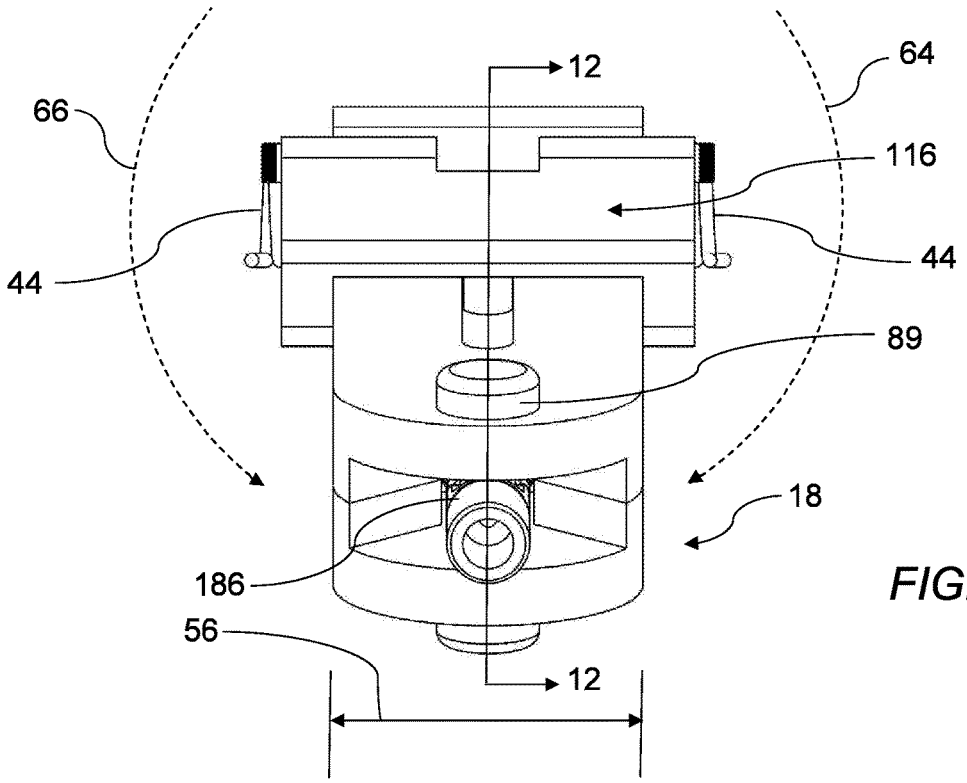
FIG. 11 is an elevation view of the components of FIG. 10.
Figure 12:
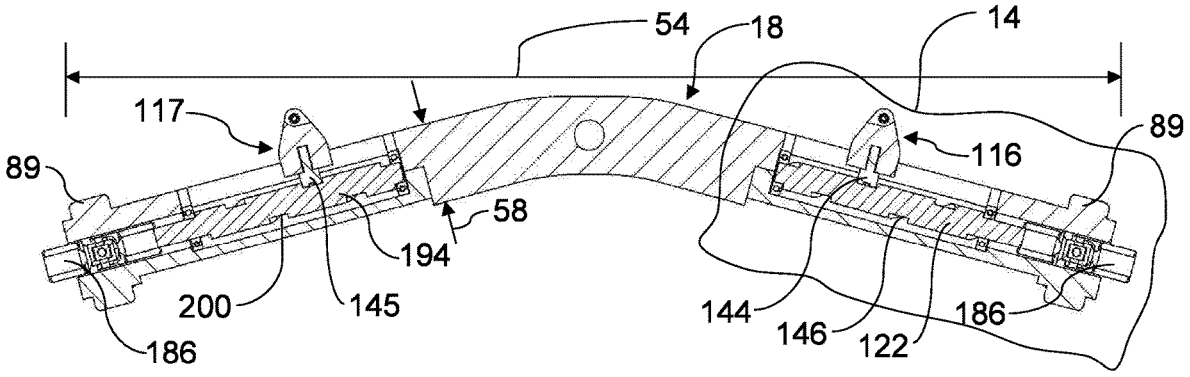
FIG. 12 is a sectional view of the components of FIG. 11.

With regard to the cart assembly 116, the cart height 134 may be defined as the height of a cart triangle 136 having a centroid 138 of the platform cart roller 120 as one vertex (first vertex), and the centroids 140 of two of the plurality of chassis cart rollers 118 as the other two vertices (second and third vertices). In this case, the cart triangle 136 is configured as an isosceles triangle with a single platform cart roller 120 at one vertex and two chassis cart rollers 118 at the other two vertices (see FIG. 8). However, the cart triangle 136 can be configured as any suitable triangle such as a right triangle, a scalene triangle, or the like. Thus for the rotation powered vehicle 10 the cart assembly 116 may be constrained by the chassis slot 90 and the platform slot 94 to a position on the chassis assembly 18 wherein the cart height 134 is substantially equivalent to the variable slot height 98. In this manner, the cart assembly 116 may be configured to translate along the chassis assembly 18 upon rotation of the platform assembly 16 with respect to the chassis assembly 18.

For some other drive mechanism embodiments (not pictured), the cart assembly 116 may be slidably and pivotally coupled to the chassis slot 90 by a chassis cart roller 118, and the cart assembly 116 may be slidably coupled to the platform slot 94 by a plurality of platform cart rollers 120. In this case for a fixed platform rotation angle 48, the variable slot height 98 may be measured as the length of a line which originates from a point which is disposed within the platform slot 94 and disposed on the platform slot plane 104. The line may be configured such that it is substantially perpendicular to the platform slot plane 104, and the line may terminate at a point which is disposed on the chassis slot plane 106. Also in this case the cart height 134 may be defined as the height of a cart triangle having a centroid of the chassis cart roller 118 as one vertex, and the centroids of two of the plurality of platform cart rollers 120 as the other two vertices. Again the cart triangle may be configured as any suitable triangle, isosceles, right, scalene, etc.

Figure 13:
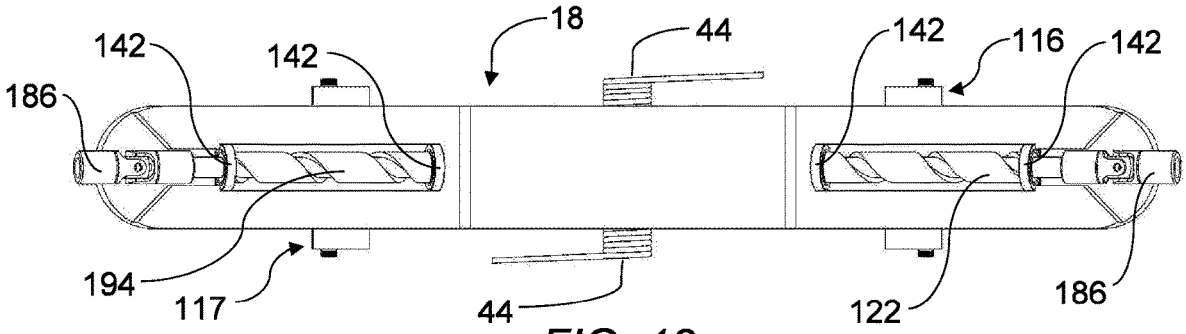
FIG. 13 is an elevation view of the components of FIG. 10.

For some rotation powered vehicle 10 drive mechanism embodiments, the helical drive shaft 122 may be rotationally secured within the chassis assembly 18. For embodiments discussed herein, the helical drive shaft may be rotationally secured within the chassis assembly by shaft bearings 142 (see FIG. 13). The helical drive shaft 122 may be operatively coupled to the cart assembly 116 such that translation of the cart assembly 116 results in rotational motion of the helical drive shaft 122. In some cases the helical drive shaft 122 may be operatively coupled to the cart assembly 116 by a drive pin 144 which is coupled to the cart assembly 116. For some embodiments the drive pin 144 may be rotationally secured to the cart assembly 116, in this case the drive pin 144 may be configured as a roller pin, bearing, or the like.

Figure 24:
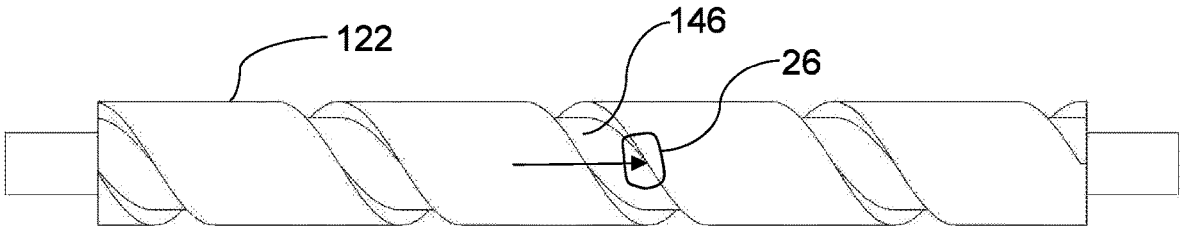
FIG. 24 is an elevation view of a helical drive shaft embodiment having a helical slot with a constant pitch.

For helical drive shaft embodiments 122 discussed herein, the helical drive shaft 122 may have a length from about 4 inches to about 14 inches. The diameter of the helical drive shaft may be from about 0.5 inches to about 2 inches. The helical drive shaft 122 may include a helical slot 146, which may have a depth from about 0.125 inches to about 0.75 inches. In some cases, the width of the helical slot 146 may be from about 0.125 inches to about 0.75 inches. For some embodiments, the helical slot 146 may be disposed within the helical drive shaft 122 at a constant pitch (see FIG. 24). For some embodiments the constant thread pitch be from about 0.5 inches to about 2 inches. For some other embodiments, the helical slot 146 may be disposed within the helical drive shaft 122 at a variable pitch (see FIG. 25). For all of the rotation powered vehicle embodiments discussed herein, the helical slots 146 may be configured with right hand orientation (FIGS. 24 and 25) or with left hand orientation (not shown). Right or left hand orientation being analogous to right and left hand screw thread pitch orientation.

Figure 14:
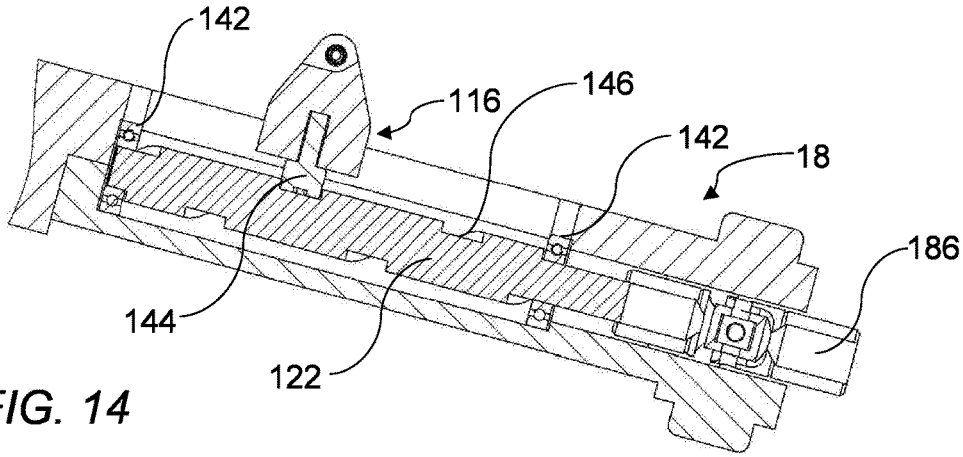
FIG. 14 is an enlarged detail view of FIG. 12.
Figure 15:
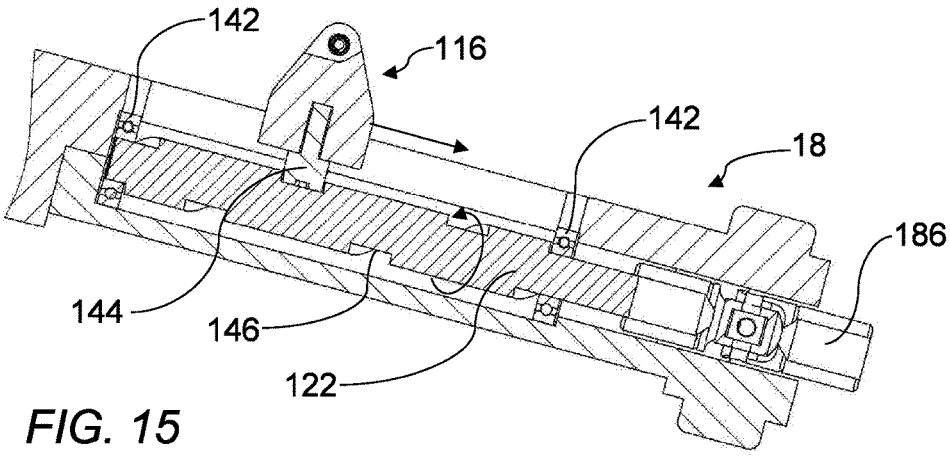
FIG. 15 is an enlarged detail view of FIG. 12 depicting motion of the cart assembly along the chassis assembly and rotation of the helical drive shaft.
Figure 16:
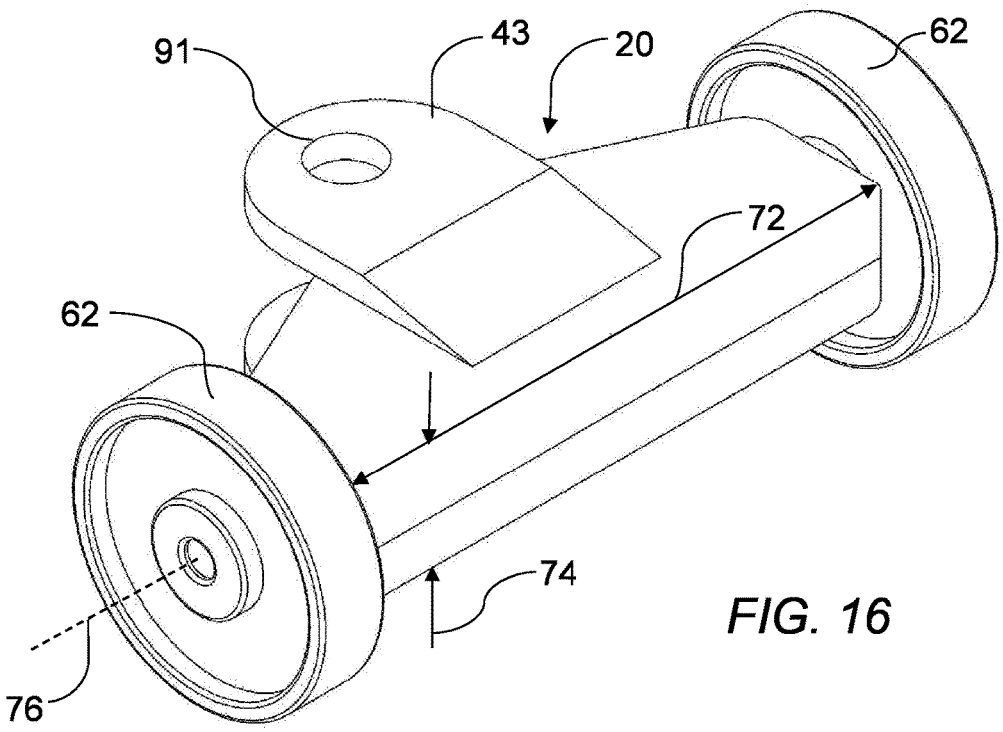
FIG. 16 is a perspective view of a truck assembly embodiment.
Figure 26:
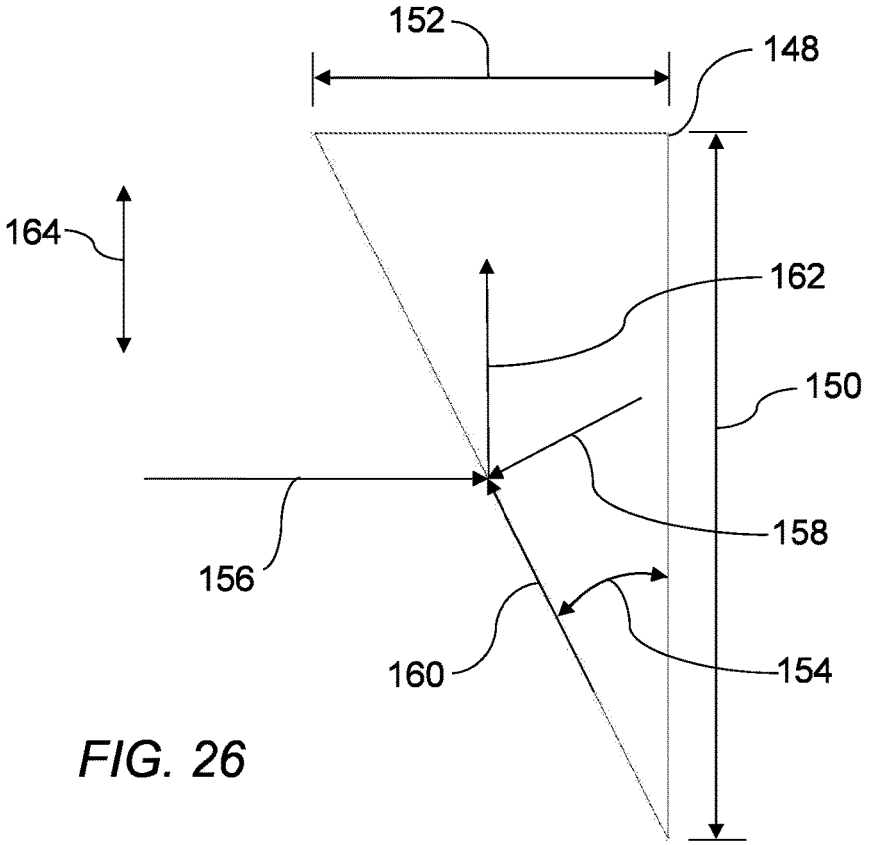
FIG. 26 is an enlarged detail view of the helical drive shaft of FIG. 24 depicting various forces applied to and originating from the helical drive shaft as the result of interaction with the cart assembly during a first half power cycle.

In some cases the drive pin 144 may be operatively coupled to the helical slot 146 (see FIGS. 14 and 15). For some embodiments the drive pin 144 may have a diameter which is from about 75 percent to about 98 percent of the width of the helical slot 146. Motion of the cart assembly 116 (and drive pin 144) with respect to the chassis assembly 18 results in rotation of the helical drive shaft 122 within the chassis assembly 18. The rotation of the helical drive shaft 122 is the result of the interaction between the drive pin 144 and the helical slot 146. FIG. 26 depicts a diagram of the forces between the helical slot 146 and the drive pin 144; for the example given the helical drive shaft 122 having the constant pitch is used however the derived formula would apply to any given helical drive shaft 122 pitch configuration.

The force diagram depicts a triangle 148 which represents an "unrolled" single thread of the helical slot 146. The base 150 of the triangle 148 is the circumference (π*dm) of the mean-thread-diameter (dm) of the helical drive shaft 122 and the height 152 is the pitch of the helical slot 146 disposed within the helical drive shaft 122. Thus if the drive pin 144 is moved a distance which is equivalent to the pitch 152, the helical drive shaft 122 will rotate through a single complete revolution. In the force diagram p 152 is the pitch of the helical shaft and θ 154 is the lead angle. The drive pin 144 applies a drive pin force F 156 to the helical slot 146, a normal force N 158 is applied to the drive pin 144 by the helical slot 146. A friction force 160 which is equivalent to f*N wherein f is the coefficient of friction of the helical slot 146 is applied to the drive pin 144 by the helical slot 146. A resultant force P 162 is directed along an axis 164 which represents the allowable motion of the helical drive shaft 122. Performing a force balance and solving gives:

$$P = \frac{F * \left[\frac{p}{\pi * dm} f\right]}{\left[1 + \frac{f * p}{\pi * dm}\right]} \tag{1}$$

Thus the efficiency of the drive system (P/F), that is the ratio of the force F 156 applied to the helical drive shaft 122 by the drive pin 144 to the resultant force P 162 (which rotates the helical drive shaft 122) can be increased by lowering the coefficient of friction f, increasing the pitch p 152, or decreasing the mean thread diameter dm.

Some embodiments of rotation powered vehicle drive mechanisms may be configured with helical drive shafts 166 which are configured with helical slots 168 having a variable pitch (see FIG. 25) can act as "drive gears" for the rotation powered vehicle. Motion of the drive pin 144 along helical slots 168 configured with a variable pitch will result in corresponding variable rotation of the respective helical drive shaft 166 with respect to the chassis assembly 18. Thus different gears may be considered "low" or "high" ratios of the linear motion of the drive pin 144 to the rotational motion of the helical drive shaft 166, the ratios corresponding to the variable pitch (longer pitch or shorter pitch respectively) of the helical slots 168.

Figure 25:
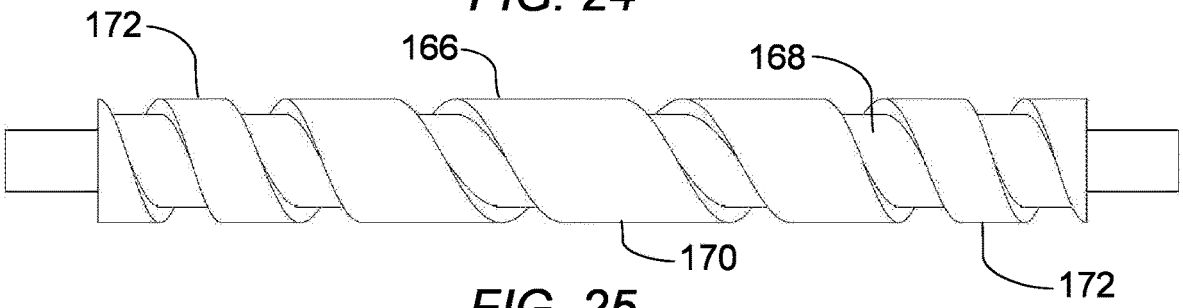
FIG. 25 is an elevation view of a helical drive shaft embodiment having a helical slot with a variable pitch.

Consider the helical drive shaft 166 having the helical slot 168 configured with a variable pitch which is depicted in FIG. 25. The pitch is longer in a central portion 170 of the helical drive shaft 166 than it is in two outer portions 172 of the helical drive shaft 166. Thus a rider of a rotation powered vehicle configured with the helical drive shaft 166 of FIG. 25 could (starting from a platform assembly 16 neutral position see FIG. 4) rotate the platform assembly 16 such that only the central portion 170 of the helical drive shaft 166 was engaged. This would correspond to a "low gear" of the vehicle: a low ratio of the linear motion of the drive pin 144 to the rotational motion of the helical drive shaft 166. Once the desired speed was obtained the rider could rotate the platform assembly 16 such that the outer portions 172 of the helical drive shaft 166 were engaged. This would correspond to a "high gear" of the vehicle: a high ratio of the linear motion of the drive pin 144 to the rotational motion of the helical drive shaft 166.

For the rotation powered vehicles discussed herein, the helical drive shafts may be configured with any suitable constant pitch or variable pitched helical slots. Consider a helical drive shaft having a variable pitch helical slot, the helical drive shaft having a first outer portion, a central portion, and a second outer portion (any suitable number of portions is allowable). Now consider three helical slot pitch options: long pitch, medium pitch, and short pitch (any suitable number of pitch options is allowable). Each portion of the helical drive shaft could configured with any of the three pitch options (including repeated pitch options). Each variable pitch helical slot could be configured with continuous transitions between the different pitch options to allow for smooth interaction between the drive pin and the helical shaft. For example the first outer portion could be configured with the long pitch option, the central portion could be configured with the medium pitch option, and the second outer portion could be configured with the short pitch option and so on. Any suitable of portions/pitches may be allowable for the helical shaft configurations discussed herein.

Figure 27:
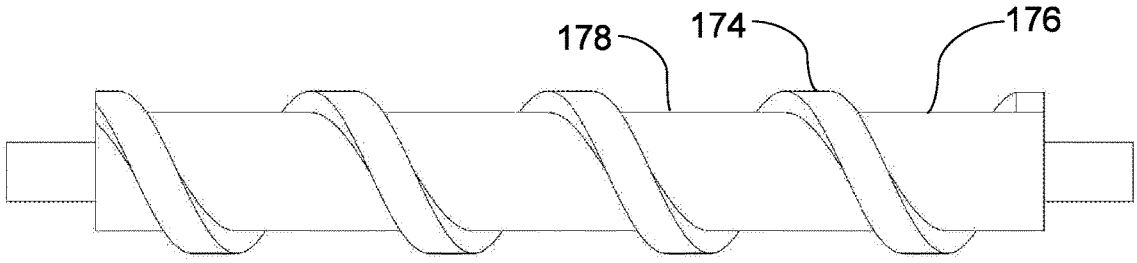
FIG. 27 is an elevation view of a rail drive shaft having a helical rail.

For some embodiments, the helical slot 146 of the helical drive shaft 122 may be configured as a helical rail 174 (see FIGS. 27 and 28). The helical rail 174 may extend from an outer surface 176 of a helical drive shaft 178. For embodiments of a helical drive shaft 178 having a helical rail 174, the corresponding cart assembly 180 may be configured with two drive pins 182 (as shown in FIG. 28) thereby allowing for the engagement of the cart assembly 180 with the helical drive shaft 178 when the cart assembly 180 is driven in the allowable directions along the helical drive shaft 178.

As discussed above, the rotation powered vehicle drive mechanism may also include a truck assembly 20 which is pivotally secured to the chassis assembly 18. The truck assembly 20 may include the axle 60 which is rotationally secured to the truck assembly 20 and which is operatively coupled to a plurality of wheels 62. The axle 60 may be operatively coupled to the helical drive shaft 122 such that rotation of the platform assembly 16 with respect to the chassis assembly 18 in a first angular direction 184 results in rotation of the axle 60 and respective wheels 62 in the first angular direction 184.

For some embodiments, a universal joint 186 may be operatively coupled between the helical drive shaft 122 and the axle 60 (see FIGS. 14 and 15). In some cases the universal joint 186 may be configured as a flexible coupler tube. The flexible coupler tube may be configured to transmit torque between the helical drive shaft 122 and axle 60. In some cases, the flexible coupler tube may have an outer sheath and an interior cable which is disposed within the outer sheath. The interior cable may be configured to spin freely within the outer sheath, thereby allowing the flexible coupler tube to bend while still transmitting torque. Thus both the universal joint 186 and the flexible coupler tube allow for the continued operative coupling between the helical drive shaft 122 and the axle 60 during rotation of each truck assembly 20 during steering of the rotation powered vehicle 10.

Figure 17:
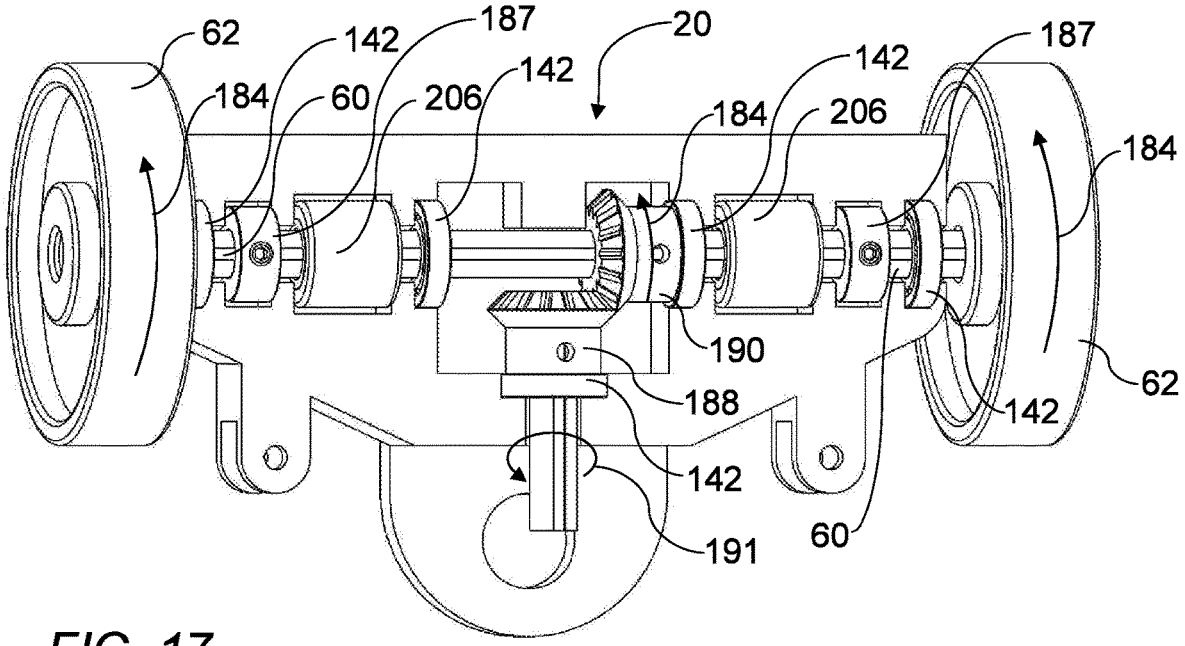
FIG. 17 is a perspective view of the truck assembly of FIG. 16 depicting the internal components of the truck assembly including miter gears, ratchet mechanisms, bearings, and shaft collars.

For some embodiments, the axle 60 may be operatively coupled to the helical drive shaft 122 by at least one miter gear. The truck assembly embodiment 20 which is depicted in FIG. 17 has a first miter gear 188 which is coupled to the helical drive shaft 122 via the universal joint 186, and a second miter gear 190 which is coupled to the axle 60. As shown in FIG. 17, first and second miter gears 188 and 190 are configured such that right hand rotation 191 (as the cart assembly 16 moves toward the truck assembly 20) of the helical drive shaft 122 (configured with right hand orientation helical slot) results in rotation of the wheels 62 in the first angular direction 184 (see FIG. 5). In some cases the axle 60 may be rotationally secured to the truck assembly 20 by roller bearings 142. The truck assembly 20 may also include multiple shaft collars 187 which may act to confine the axle 60 within the truck assembly 20.

Figure 18:
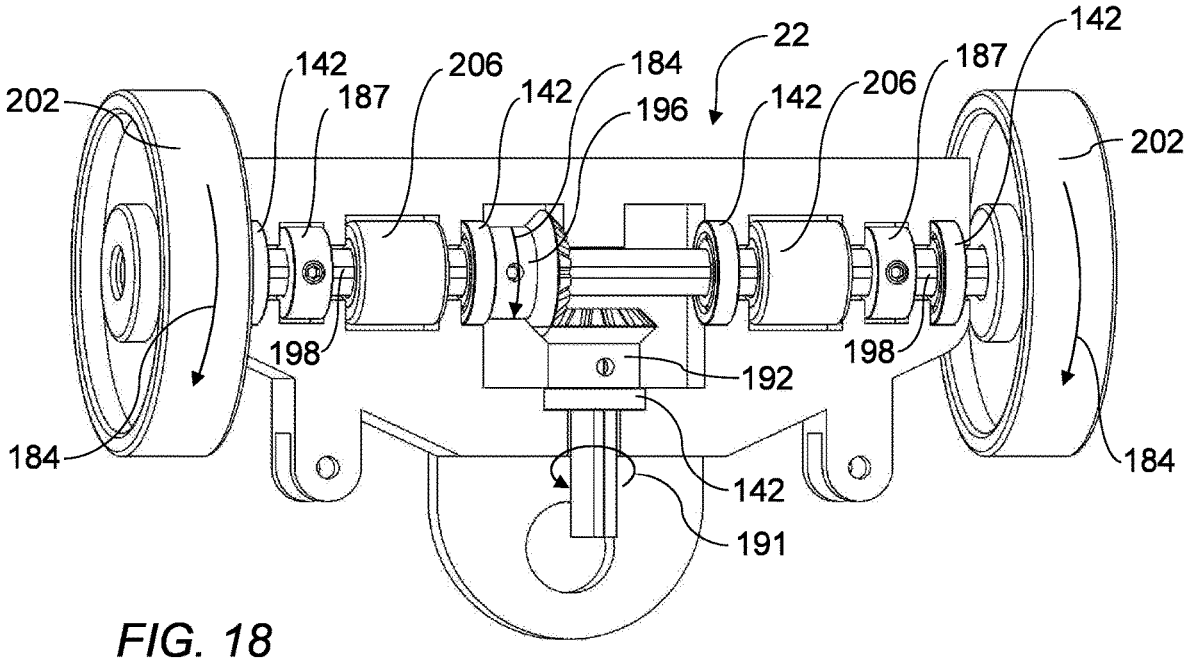
FIG. 18 is a perspective view of a second truck assembly depicting the internal components of the second truck assembly including miter gears, ratchet mechanisms, bearings, and shaft collars.
Figure 19:
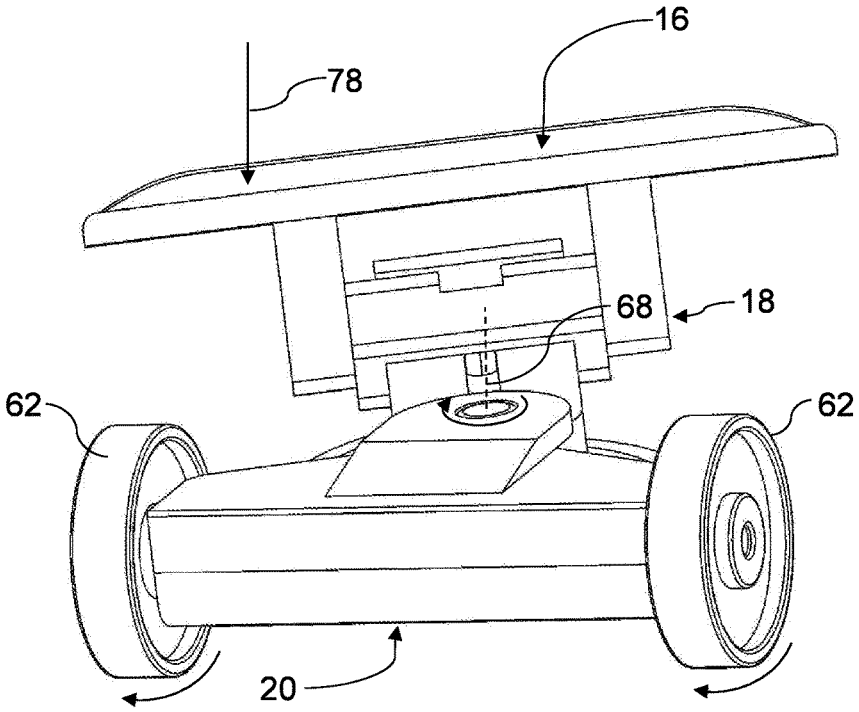
FIG. 19 is an elevation view of the rotation powered vehicle of FIG. 1 depicting a steering force applied to the platform assembly, with resulting rotation of the truck assembly with respect to the chassis.

Similarly, the second truck assembly embodiment 22 which is depicted in FIG. 18 has a first miter gear 192 which is coupled to a second helical drive shaft 194, and a second miter gear 196 which is coupled to a second axle 198. As shown in FIG. 18, first and second miter gears 192 and 196 are configured such that right hand rotation 191 (as the second cart assembly 117 moves toward the second truck assembly 22) of the second helical drive shaft 194 (configured with a right hand orientation second helical slot 200) results in rotation of a plurality of second wheels 202 in the first angular direction 184 (see FIG. 6). In this manner, the configuration of the first and second miter gears 188, 190, 192 and 196 can determine direction of the rotation of the wheels 62 and 202 with right handed rotation of the helical drive shafts 122 and 194. In some cases the second axle 198 may be rotationally secured to the second truck assembly 22 by roller bearings 142. The second truck assembly 22 may also include multiple shaft collars 187 which may act to confine the second axle 198 within the second truck assembly 22.

Right or left hand orientation of the helical slots 146 and 200 may also determine direction of the rotation of the wheels 62 and 202 with rotation of the respective helical drive shafts 122 and 194. For example if in the above example helical slot 122 and second helical slot 194 were configured with left hand orientations, rotation of the wheels 62 and second wheels 202 (of the respective truck assembly 20 and second truck assembly 22) would be in a second angular direction 204 for the respective board assembly rotations depicted in FIGS. 5 and 6.

Figure 5:
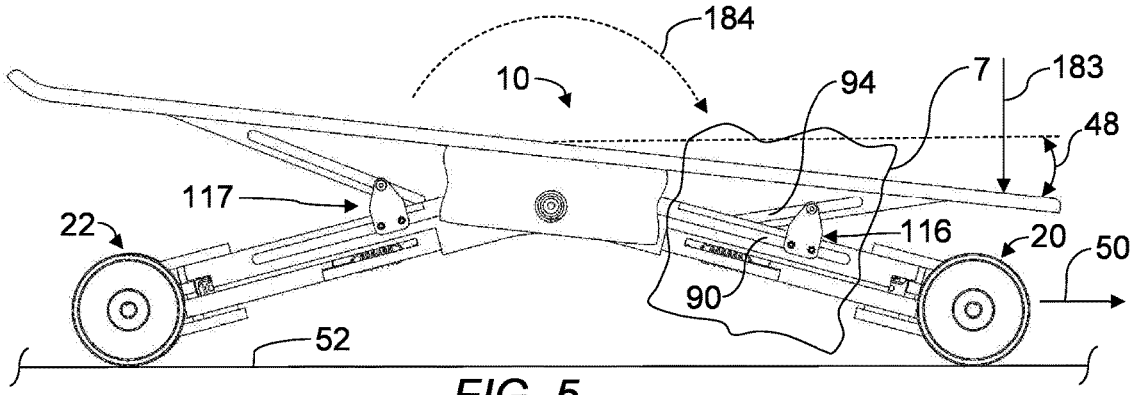
FIG. 5 is an elevation view in partial section of the rotation powered vehicle of FIG. 1 undergoing a first half power cycle.
Figure 6:
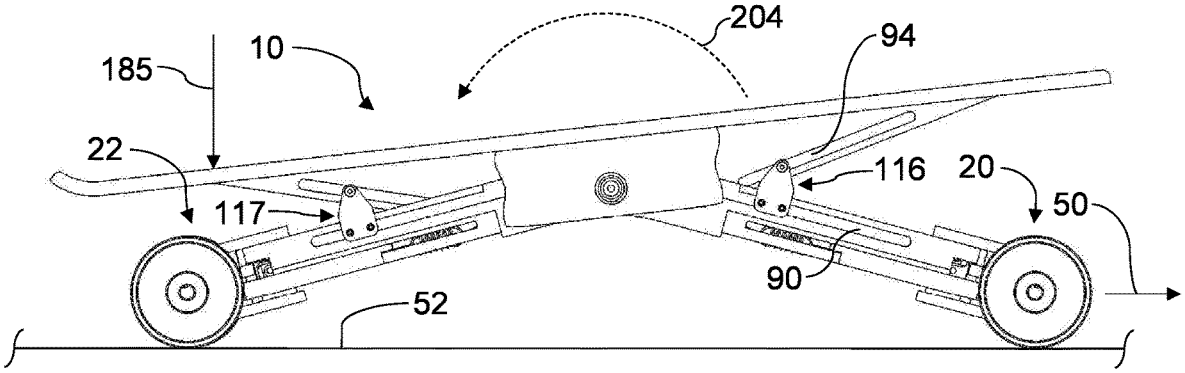
FIG. 6 is an elevation view in partial section of the rotation powered vehicle of FIG. 1 undergoing a second half power cycle.
Figure 7:
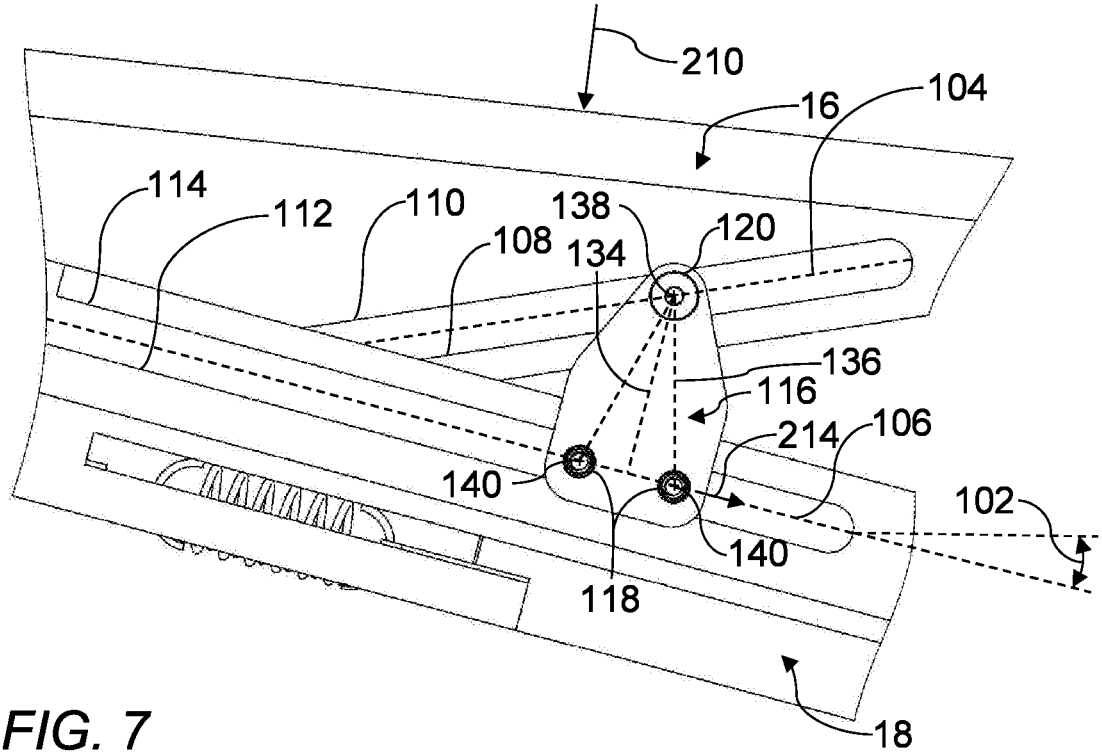
FIG. 7 is an enlarged detail view of FIG. 5 depicting the cart assembly, the platform assembly, and the chassis assembly.

It is important to note that for the rotation powered vehicle embodiment 10 depicted in FIGS. 5 and 6, the first and second half power cycles occur as the platform assembly 16 is rotated toward the wheels 62 and 202 that are being powered. In FIG. 5 the platform assembly 16 is rotated in the first angular direction 184 towards the wheels 62 which are being driven by the helical drive shaft 122. In FIG. 6 the platform assembly 16 is rotated in the second angular direction 204 towards the second wheels 202 which are being driven by the second helical drive shaft 194. For some rotation powered vehicles, this configuration could be reversed. That is to say that the miter gears 188, 190, 192 and 196 and the right/left hand orientation of the helical slots 168 and 200 could be configured such that each half power cycle was applied to wheels 62 and 202 that the platform assembly 16 is being rotated away from. As an example, in FIG. 5 the power would be applied to the second wheels 202 as the platform assembly 16 is rotated in the first angular direction 184 and so on.

For the rotation powered vehicles discussed herein, any possible combination of the half power cycles represented in FIGS. 4-6 are allowable. For example a rider could operate the rotation powered vehicle 10 by repeatedly rotating the platform assembly 16 from the platform rotation angle 48 depicted in FIG. 5 (wherein the drive mechanism 12 has been activated) to the platform rotation angle 48 depicted in FIG. 6 (wherein the second drive mechanism 14 has been activated) and back again. In this manner the rider engages the first and second drive mechanisms 12 and 14. Or a rider could operate the rotation powered vehicle 10 by repeatedly rotating the platform assembly 16 from the platform rotation angle 48 depicted in FIG. 4 to the platform rotation angle 48 depicted in FIG. 5 and back again, thereby only engaging the drive mechanism 12. Or a rider could operate the rotation powered vehicle 10 by repeatedly rotating the platform assembly 16 from the platform rotation angle 48 depicted in FIG. 4 to the platform rotation angle 48 depicted in FIG. 6 and back again, thereby only engaging the second drive mechanism 14. Thus a rider can selectively activated the first or second drive mechanisms 12 and 14.

Each rotation powered vehicle drive mechanism 12 and 14 may be configured such that the axles 60 and 198 and wheels 62 and 202 selectively engage with the respective helical drive shafts 122 and 194. This may be accomplished with the use of at least one ratchet mechanism 206 which may operatively couple an axle 60 and 198 to its respective wheels 62 and 202. For example FIG. 17 depicts the truck assembly 20 which is configured such that when right hand rotation is applied to the helical drive shaft 122 the first and second miter gears 188 and 190 rotate the axle 60 in the first angular direction 184 and each ratchet mechanism 206 engages the axle 60 with the wheels 62 which are also driven in the first angular direction 184. When a left hand rotation is applied to the helical drive shaft 122 (not shown) the first and second miter gears 188 and 190 rotate the axle 60 in the second angular direction 204 and each ratchet mechanism 206 is configured not to engage the axle 60 with the wheels 62, and the wheels 62 are free to spin in the first angular direction 184. In some cases the ratchet mechanism 206 may be fabricated using multiple clutch bearings (such as McMaster-Carr Catalog #2489K24 one-way locking bearing clutch) which may be configured to selectively engage with the axle 60 and which are disposed within a suitable housing.

FIG. 18 depicts the second truck assembly 22 which is configured such that when right hand rotation is applied to the second helical drive shaft 194 the first and second miter gears 192 and 196 rotate the second axle 198 in the first angular direction 184 and each ratchet mechanism 206 engages the second axle 198 with the second wheels 202 which are also driven in the first angular direction 184. When a left hand rotation is applied to the second helical drive shaft 194 (not shown) the first and second miter gears 192 and 196 rotate the second axle 198 in the second angular direction 204 and each ratchet mechanism 206 is configured not to engage the second axle 198 with the second wheels 202, and the second wheels 202 are free to spin in the first angular direction 186.

Figure 38:
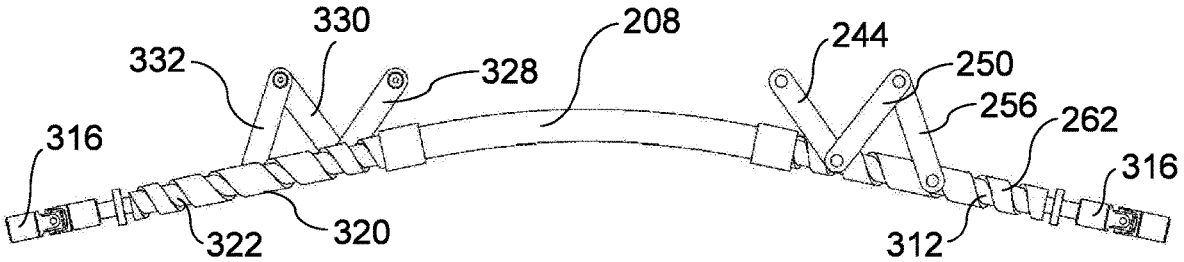
FIG. 38 is an elevation view of components multiple drive mechanisms including a plurality of linkages, multiple universal joints, multiple helical drive shafts, and a helical shaft connector.
Figure 39:
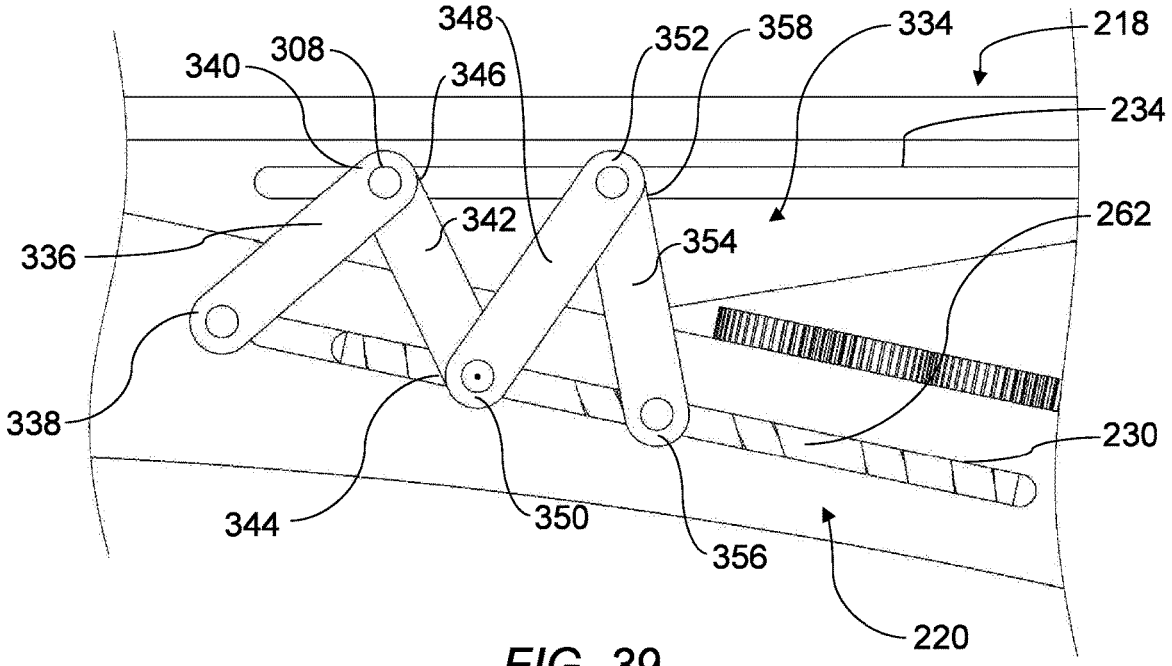
FIG. 39 is a detail view of a rotation powered vehicle drive mechanism having multiple linkages and a helical drive shaft.
Figure 40:
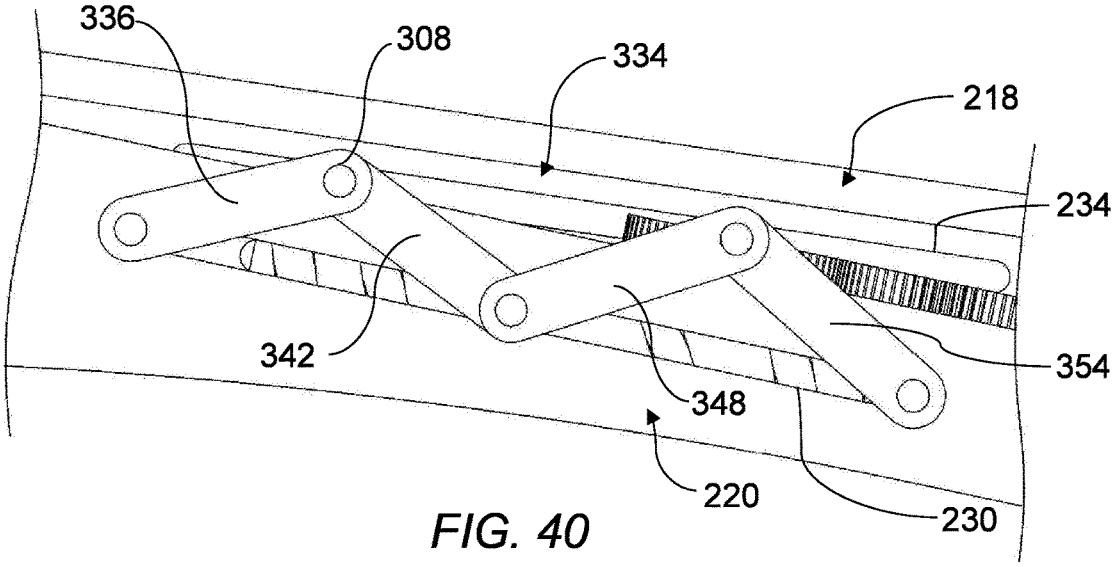
FIG. 40 is a detail view of the rotation powered vehicle drive mechanism of FIG. 39. Undergoing a first half power cycle.
Figure 41:
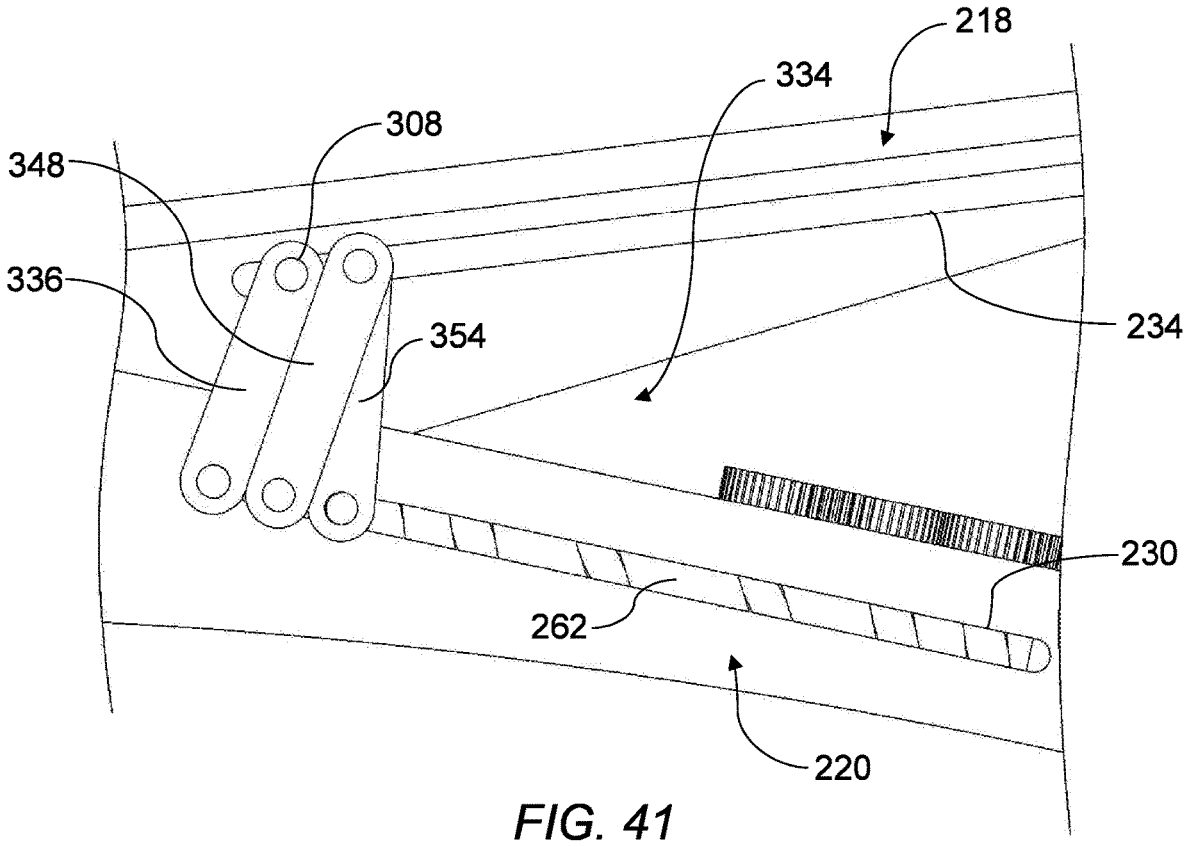
FIG. 41 is a detail view of the rotation powered vehicle drive mechanism of FIG. 39. Undergoing a second half power cycle.
Figure 42:
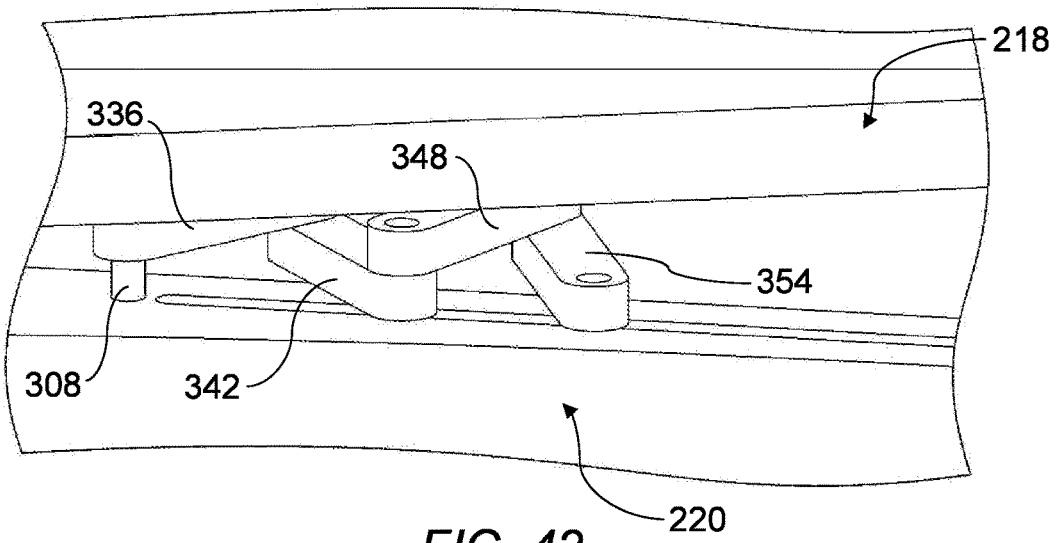
FIG. 42 is a perspective view of the rotation powered vehicle drive mechanism of FIG. 38.

The first half power cycle which engages the second drive mechanism 14 is depicted in FIG. 5. The rotation powered vehicle 10 second drive mechanism 14 may include the second cart assembly 117 and the second drive pin 145. For the second drive mechanism 14, the second axle 198 is operatively coupled to the second helical drive shaft 194 such that rotation of the platform assembly 16 with respect to the chassis assembly 18 in the second angular direction 204 results in rotation of the second axle 198 and second wheels 202 in the first angular direction 184. For some embodiments discussed herein, the helical shaft 122 of the drive mechanism 12 may be operatively coupled to the second helical shaft 194 of the second drive mechanism 14 by a helical shaft connector 208 (as an example see FIG. 38 which depicts two helical drive shafts with variable pitches connected by a helical shaft connector). The helical shaft connector 208 may be configured as a universal joint, or as a flexible coupling shaft. The coupling of the first and second helical shafts 122 and 194 by the helical shaft connector 208 allows for the transmission of power between the first and second helical shafts 122 and 194.

As discussed above the rotation powered vehicle 10 may include the chassis assembly 18 and the platform assembly 16 which may be pivotally secured to the chassis assembly 18 such that the platform assembly 16 may rotate with respect to the chassis assembly 18 about the platform rotation axis 46. The rotation powered vehicle 18 may also include the drive mechanism 12, the drive mechanism 12 having a cart assembly 116 which may be operatively coupled between the chassis assembly 18 and the platform assembly 16 such that rotation of the platform assembly 16 with respect to the chassis assembly 18 results in translation of the cart assembly 116 along the chassis assembly 18. The drive mechanism 12 may also include the helical drive shaft 122 which may be rotationally secured within the chassis assembly 18. The helical drive shaft 122 may be operatively coupled to the cart assembly 116 such that translation of the cart assembly 116 along the chassis assembly 18 results in rotational motion of the helical drive shaft 122.

The rotation powered vehicle 10 may also include the truck assembly 20 which is pivotally secured to the chassis assembly 18. The truck assembly 20 may include the axle 60 which may be rotationally secured to the truck assembly 20, with the axle 60 being operatively coupled to the plurality of wheels 62. In some cases, the axle 60 may be operatively coupled to the helical drive shaft 122 whereby rotation of the platform assembly 16 with respect to the chassis assembly 18 in the first angular direction 184 results in translation of the cart assembly 116 along the chassis assembly 18 and rotation of the axle 60 and wheels 62 in the first angular direction 184.

The rotation powered vehicle 10 may also include the second drive mechanism 14. The second drive mechanism 14 may include the second cart assembly 117 which may be operatively coupled between the chassis assembly 18 and the platform assembly 16 such that rotation of the platform assembly 16 with respect to the chassis assembly 18 results in translation of the second cart assembly 117 along the chassis assembly 18. The second drive mechanism 14 may also include the second helical drive shaft 194 which may be rotationally secured to the chassis assembly 18. The second helical drive shaft 194 may be operatively coupled to the second cart assembly 117 such that translation of the second cart assembly 117 along the chassis assembly 18 induces rotational motion of the second helical drive shaft 194.

The rotation powered vehicle 10 may also include the second truck assembly 22 which may be pivotally secured to the chassis assembly 18. The second truck assembly 22 may include the second axle 198 which may be rotationally secured to the second truck assembly 22 and operatively coupled to a plurality of second wheels 202. The second axle 198 may be operatively coupled to the second helical drive shaft 194 whereby rotation of the platform assembly 16 with respect to the chassis assembly 18 in the second angular direction 204 results in translation of the second cart assembly 117 along the chassis assembly 18 and rotation of the second axle 198 and second wheels 202 in the first angular direction 184.

In use the rotation powered vehicle drive mechanism 12 would function as described by the following: a rider rotates the platform assembly 16 with respect to the chassis assembly 18 thereby decreasing the variable slot height 98 which is measured between the chassis slot 90 and the platform slot 94. The cart assembly 116 may be constrained by the chassis slot 90 and the platform slot 94 to a position on the chassis assembly 18 wherein the cart height 134 is substantially equivalent to the variable slot height 98. Rotation of the platform assembly 16 thereby results in the translation of the cart assembly 116 along the chassis assembly 18, rotation of the helical drive shaft 122, and rotation of the axle 60 and wheels 62 in the first angular direction 184.

The platform assembly 16 may be rotated with respect to the chassis assembly 18 in the first angular direction 184 via the application of a first half power cycle force 183 (see FIG. 5) or in the second angular direction 204 via the application of a second half power cycle force 185 (see FIG. 6), with the first and second drive mechanisms 12 and 14 converting the rotational motion into motion of the rotation powered vehicle 10 in the first linear direction 50. Additionally the platform assembly 16 may be rotated with respect to the chassis assembly 18 in the first angular direction 184 or in the second angular direction 204, with the rotation resulting in an increase of the variable slot height 98 which is measured between the chassis slot 90 and the platform slot 94.

Motion of the cart assembly 116 may be due to the physical constraints applied to the cart assembly 116, and the force applied to the cart assembly 116 by a rider will be applied to the chassis cart rollers 118 and the platform cart rollers 120 by the respective slot surfaces 108, 110, 112, 114 of the chassis slot 90 and the platform slot 94. In each case, the force which is applied to a given cart roller by a respective slot surface will be oriented such that it is perpendicular (normal) to that slot surface.

Figure 29:
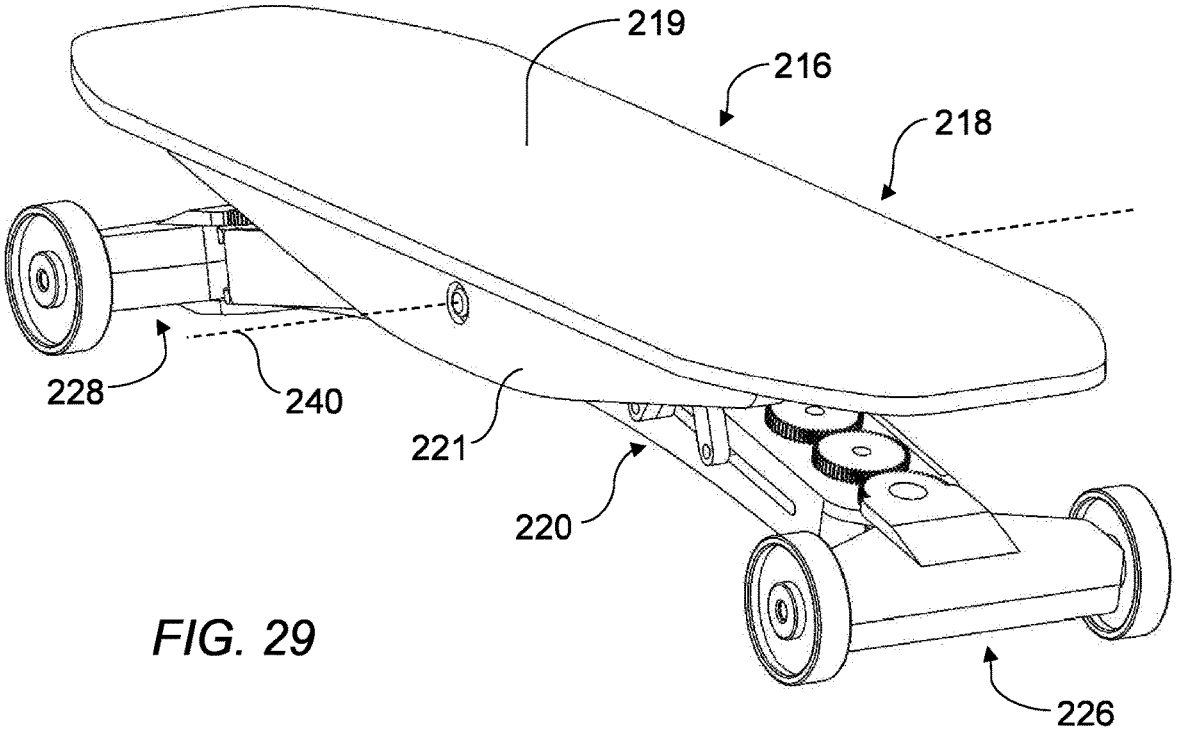
FIG. 29 is a perspective view of a rotation powered vehicle embodiment having a platform assembly which is operatively coupled to a chassis assembly and multiple drive mechanisms with each drive mechanism utilizing a plurality of linkages and a respective helical drive shaft to power the vehicle.
Figure 30:
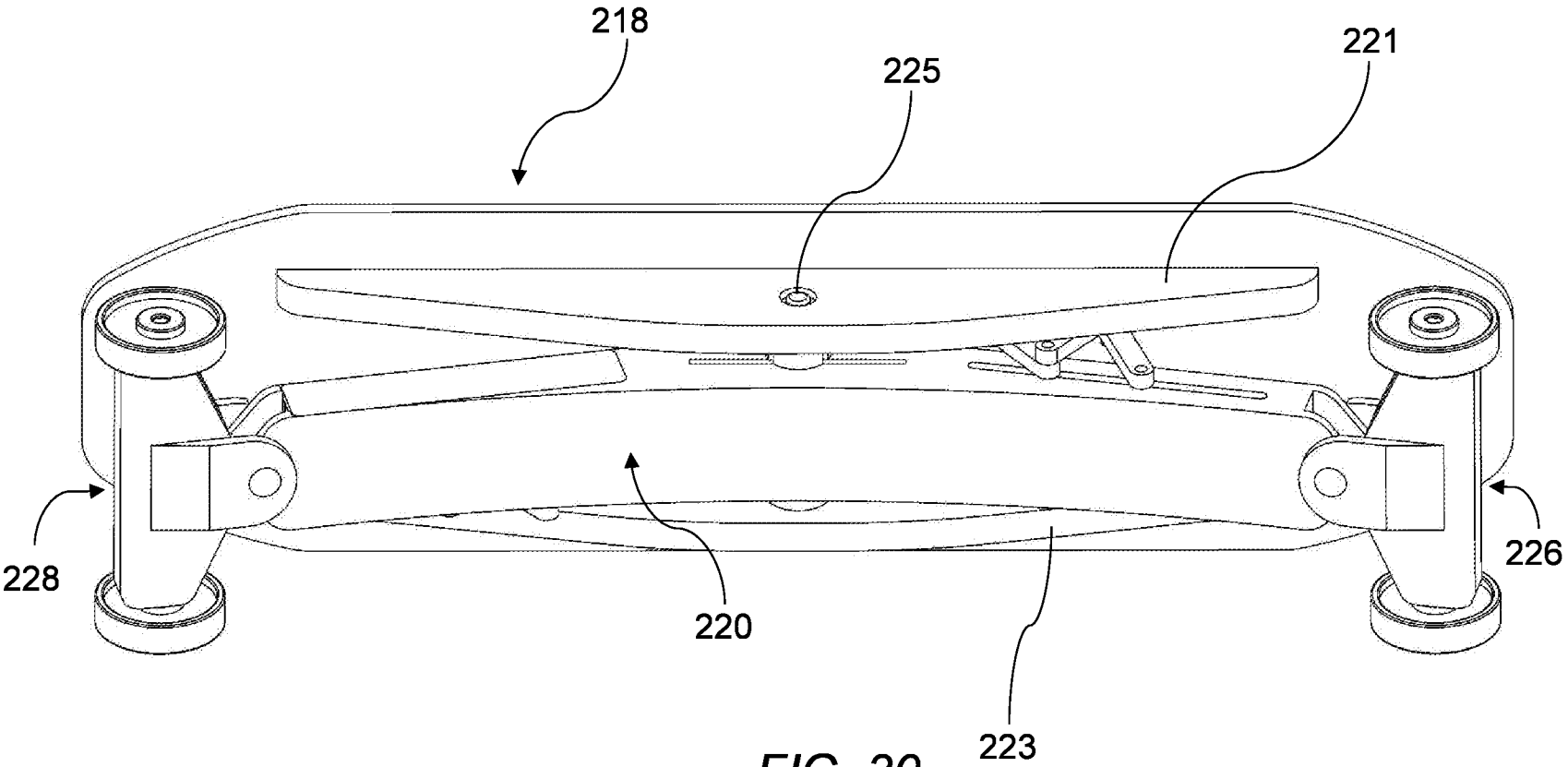
FIG. 30 is a perspective view of the rotation powered vehicle of FIG. 29.
Figure 31:
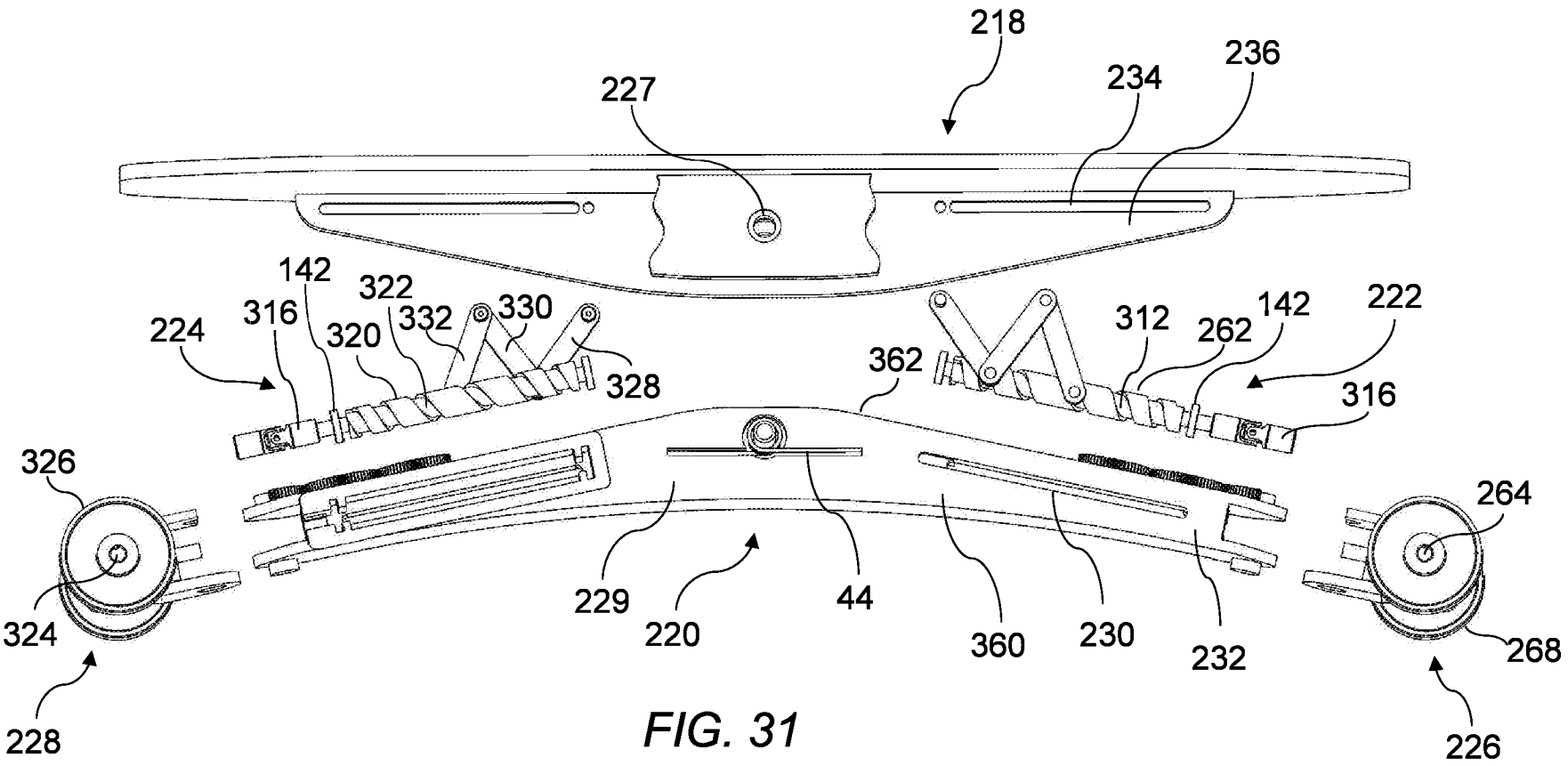
FIG. 31 is an exploded view of the rotation powered vehicle of FIG. 29.

An embodiment of a rotation powered vehicle 216 having multiple drive mechanisms which utilize helical drive shafts is depicted in FIGS. 29-31. The rotation powered vehicle 216 may include a platform assembly 218, a chassis assembly 220 including a chassis body 229, a drive mechanism 222, a second drive mechanism 224, a truck assembly 226, and a second truck assembly 228. The platform assembly 218 may be configured to support a rider, to pivotally secure to the chassis assembly 220, and to operatively couple the platform assembly 218 to the chassis assembly 220 via the drive mechanisms 222 and 224. The platform assembly 218 may include a board 219, a first side panel 221, second side panel 223, and a pivot rod 225.

Each rotation powered vehicle drive mechanism 222 and 224 again utilizes a helical drive shaft, however in this case multiple operatively coupled linkages are used to convert rotational motion of the platform assembly 218 into rotational motion of each helical drive shaft and translational motion of the rotation powered vehicle 216. Each linkage may vary in length, and may be operatively coupled to the platform assembly 218, the chassis assembly 220, or to adjacent linkages. There may be any suitable number of linkages, in this case each drive mechanism 222 and 224 includes 3 linkages (an odd number of linkages).

As discussed above the rotation powered vehicle 216 may include the drive mechanism 222 and the second drive mechanism 224 which may be configured similarly to the drive mechanism 222. The drive mechanism 12 may include an elongated chassis slot 230 which may be disposed within a respective lateral exterior portion 232 of the chassis assembly 220. The drive mechanism 12 may also include an elongated platform slot 234 which may be disposed within a respective lateral interior portion 236 of the platform assembly 218 and which may be configured such that it is substantially opposed to the chassis slot 230. The platform assembly 218 may be pivotally secured to the chassis assembly 220 thereby allowing for rotation through a platform rotation angle 238 of the platform assembly 218 with respect to the chassis assembly 220 about a platform rotation axis 240. The rotation of the platform assembly 218 resulting in an increase or decrease of a variable slot height 242 which is measured between the chassis slot 230 and the platform slot 234. In some cases the pivot rod 225 may rotationally secure the platform assembly 218 to the chassis assembly 220 such that the platform assembly 218 may rotate with respect to the chassis assembly 220 about the platform rotation axis 440. The pivot rod 225 may be rotationally secured to the first side panel 221 and the second side panel 223 via pivot channels 227 which may be disposed within the first side panel 221 and the second side panel 223. In some cases the pivot rod 225 and respective pivot channel 227 may each have a substantially cylindrical shape. For some embodiments, the pivot rod 225 may be rigidly secured to the chassis assembly 220 by any suitable means such as an adhesive or pins.

Figure 32:
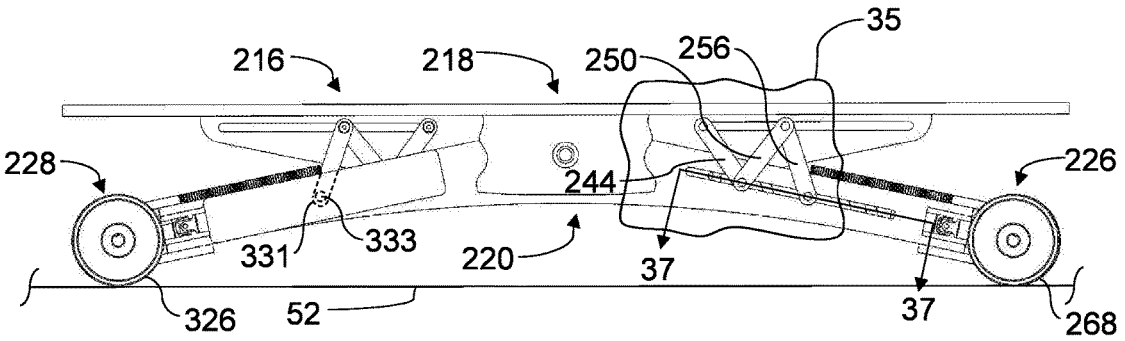
FIG. 32 is an elevation view in partial section of the rotation powered vehicle embodiment of FIG. 29.

The rotation powered vehicle embodiment 216 may also include at least one power cycle dampener 44 which may be configured to provide a restorative force to the platform assembly 218 when the platform assembly 218 is rotated about the platform rotation axis 240 and through a platform rotation angle 238 from a neutral platform position (in FIG. 32 the platform assembly 218 is disposed in the neutral platform position). In this manner the at least one power cycle dampener 44 acts (via the restorative force) to maintain the platform assembly 218 in the neutral position.

The drive mechanism 222 may further include an anchor linkage 244 which may have an anchor chassis section 246 and an anchor platform section 248 and which may be disposed between the chassis assembly 220 and the platform assembly 218. The anchor platform section 248 may be pivotally coupled to the platform assembly 218, and the anchor chassis section 246 may be slidably and pivotally coupled to the chassis slot 230. The anchor linkage 244 may be thus constrained by the platform assembly 218 and the chassis slot 230 such that an increase or decrease in the variable slot height 242 results in translation of the anchor chassis section 246 along the chassis slot 230, and rotation of the anchor linkage 244 about the platform assembly 218.

The drive mechanism 222 may further include a second linkage 250 having a second chassis section 252 and a second platform section 254, the second linkage 250 being disposed between the chassis assembly 220 and the platform assembly 218. The second chassis section 252 may be pivotally coupled to the anchor chassis section 246 and the second platform section 254 may be pivotally and slidably coupled to the platform slot 234. The second linkage 250 may thus be constrained by the anchor linkage 244 and the platform slot 234 such that increase or decrease in the variable slot height 242 results in translation of the second platform section 254 along the platform slot 234.

The drive mechanism 222 may further include a drive linkage 256 having a drive chassis section 258 and a drive platform section 260, the drive linkage 256 being disposed between the chassis assembly 220 and the platform assembly 218. The drive platform section 260 may be pivotally coupled to the second platform section 254, and the drive chassis section 258 may be pivotally and slidably coupled to the chassis slot 230. The drive linkage 256 may thus be constrained by the second linkage 250 and the chassis slot 230 such that increase or decrease in the variable slot height 242 results in translation of the drive chassis section 258 along the chassis slot 230.

The drive mechanism 222 may also include a helical drive shaft 262 which is rotationally secured within the chassis assembly 220 and which is operatively coupled to the drive linkage 256 such that translation of the drive chassis section 258 along the chassis slot 230 results in rotational motion of the helical drive shaft 262. The drive mechanism 222 may include the truck assembly 226 which is pivotally secured to the chassis assembly 220. The truck assembly 226 may include an axle 264 which is rotationally secured to the truck assembly 226 and which is operatively coupled to a plurality of wheels 268. The axle 264 may be operatively coupled to the helical drive shaft 262 such that rotation of the platform assembly 218 with respect to the chassis assembly 220 in the first angular direction 184 results in rotation of the axle 264 and wheels 268 in the first angular direction 184.

The length of each of the linkages (for all of the linkage embodiments discussed herein) may be configured to optimize the conversion of rotational motion of the platform assembly 218 into rotational motion of respective helical drive shafts. In some cases, the linkages may have equal lengths and in some other cases the lengths of the linkages may vary. The anchor linkage 244 may have an anchor linkage length 270, the second linkage 250 may have a second linkage length 272, and the drive linkage 256 may have a drive linkage length 274. In some cases any of the following may be substantially equal: the anchor linkage length 270, the second linkage length 272, and the drive linkage length 274.

In some other cases the anchor linkage length 270, the second linkage length 272, and the drive linkage length 274 may each vary. For example the drive linkage length 274 may be greater than the second linkage length 272 which may in turn be greater than the anchor linkage length 270. In general, for the linkage embodiments discussed herein, any suitable combination of linkage length is allowable.

For some embodiments of the rotation powered vehicle 216, the platform assembly 218, chassis assembly 220, platform slot 234, chassis slot 230, helical drive shaft 262, and truck assembly 226 may be configured with features, dimensions, and functionalities which are substantially similar to the corresponding elements which have been discussed previously for the rotation powered vehicle 10 of FIG. 1. The corresponding elements for the rotation powered vehicle 10 of FIG. 1 which have been discussed previously being the platform assembly 16, chassis assembly 18, platform slot 94, chassis slot 90, helical drive shaft 122, and truck assembly 20.

For some embodiments, the platform slot 234 may be disposed within the platform assembly 218 at a platform slot angle 276 of about zero degrees to about 25 degrees (see FIG. 32). Additionally, the chassis slot 230 may be disposed within the chassis assembly 220 at a chassis slot angle 278 of about zero degrees to about 25 degrees. In some cases the platform slot 234 may incorporate a platform slot plane 280 and the chassis slot 230 may incorporate a chassis slot plane 282. For some embodiments the platform slot plane 280 may be disposed such that it is substantially equidistant from a lower platform slot surface 284 and an upper platform slot surface 286, and may be substantially parallel to the upper and lower platform slot surfaces 284 and 286.

In some cases, the platform slot 234 may be disposed on the platform assembly 218 such that it is offset from the platform rotation axis 240. The platform slot 234 may be disposed such that the platform slot plane 280 is either above or below the platform rotation axis 240. For some embodiments, the platform slot plane 280 may be disposed from about 0.25 inches to about 2 inches above or below the platform rotation axis 240. As has been previously discussed, for some embodiments the platform slot 234 may be configured as a platform rail.

The chassis slot plane 282 may be disposed such that it is substantially equidistant from a lower chassis slot surface 288 and an upper chassis slot surface 290, and may be substantially parallel to the upper and lower chassis slot surfaces 288 and 290. In some cases, the chassis slot 230 may be disposed on the chassis assembly 220 such that it is offset from the platform rotation axis 240. The chassis slot 230 may be disposed such that the chassis slot plane 282 is either above or below the platform rotation axis 240. For some embodiments, the chassis slot plane 282 may be disposed from about 0.25 inches to about 2 inches above or below the platform rotation axis 240. As has been previously discussed, for some embodiments the chassis slot 230 may be configured as a chassis rail.

Figure 35:
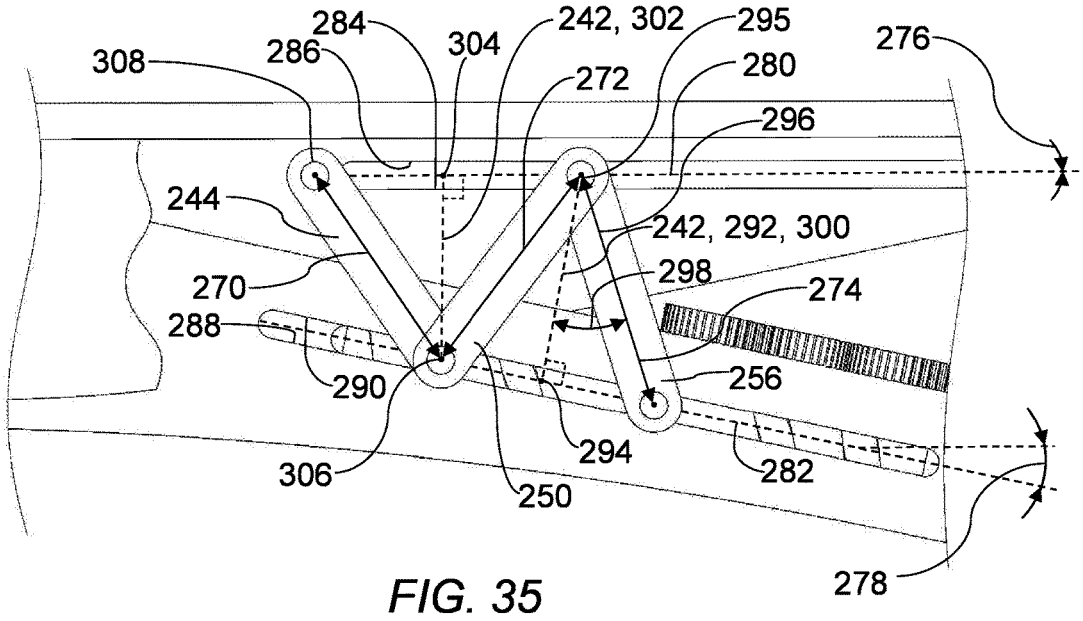
FIG. 35 is an enlarged detail view of FIG. 32.
Figure 36:
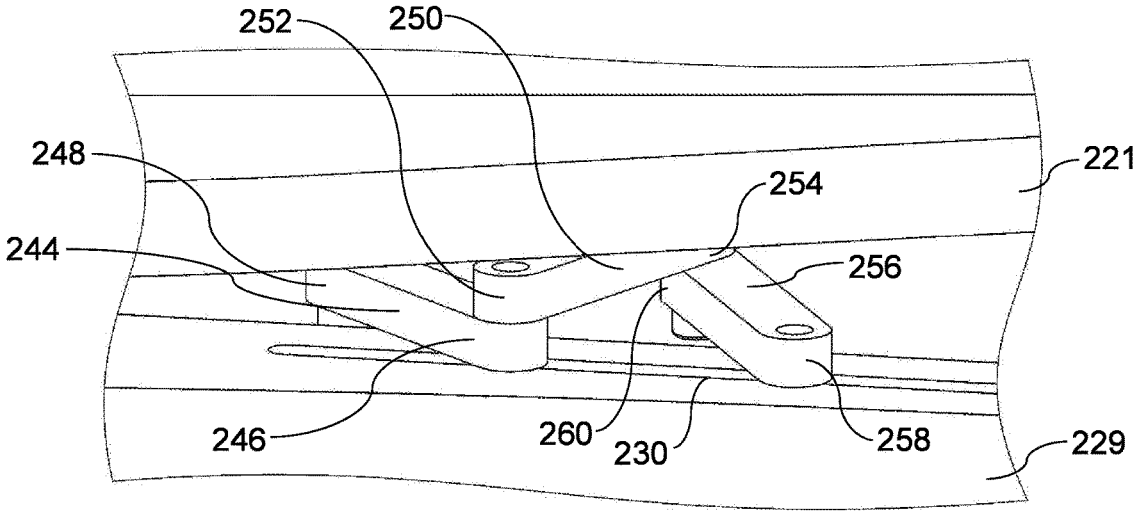
FIG. 36 is a perspective view of a drive mechanism of the rotation powered vehicle of FIG. 32.

For some rotation powered vehicle embodiments 216, for a fixed platform rotation angle 238 the variable slot height 242 may be measured as the length of a line 292 which originates from a point 294 which is disposed within the chassis slot 230 and disposed on the chassis slot plane 282, the line 292 being substantially perpendicular to the chassis slot plane 282 and the line terminating at a point 295 which is disposed on the platform slot plane 280 (see FIG. 35). For some other rotation powered vehicle embodiments 216, for a fixed platform rotation angle 238 the variable slot height 242 may be measured as the length of a line 302 which originates from a point 304 which is disposed within the platform slot 234 and disposed on the platform slot plane 280, the line being substantially perpendicular to the platform slot plane 280 and the line terminating at a point 306 which is disposed on the chassis slot plane 282.

For some embodiments discussed herein the total angle between the platform slot 234 and the chassis slot 230 may be calculated as the sum of the platform rotation angle 238, the platform slot angle 276 and the chassis slot angle 278. For a fixed length linkage, the distance a linkage moves along a given slot may be calculated from the following:

$$\Delta s = L^* \sin(\Delta\sigma) \quad (2)$$

Where Δs is the distance the linkage slides along the given slot, L is the length of the linkage, and Δσ is the change in the linkage angle σ between the linkage the variable slot height 242 which measured from a corresponding section of the linkage. As an example, see FIG. 35. The drive linkage 256 has a length L 274 and forms a linkage angle σ 298 with the variable slot height h 242 which originates from the drive platform section 260 of the drive linkage 256. The drive chassis section 258 of the drive linkage 256 will slide a distance Δs along the chassis slot 230 when rotation of the platform assembly 218 with respect to the chassis assembly 220 results in a change Δσ in the linkage angle 298 between the drive linkage 256 and the variable slot height 242 which originates from the drive platform section 260 of the drive linkage 256. In general the motion of multiple operatively coupled linkages is linearly cumulative, that is to say that motion of the drive platform section 260 (due to rotation of the second linkage 250) further translates the drive chassis section 258 along the chassis slot 230 and so on.

Each rotation powered vehicle drive mechanism 222 and 224 may further include a plurality of linkage pins 308 which operatively couple the anchor linkage 244, the second linkage 250, and the drive linkage 256 to each other, to the chassis slot 230, and to the platform slot 234. For some embodiments at least one linkage pin 308 may be configured as a bearing. Each drive mechanism 222 and 224 may further include a drive pin 310 which may operatively couple the drive chassis section 258 to the chassis slot 230 and to a helical slot 312 of the helical drive shaft 262. For some embodiments the drive pin 310 may be rotationally secured to the drive chassis section 258 of the drive linkage 256. In some cases the drive pin 310 may be configured as a track roller. For some embodiments the drive pin 310 may have a diameter which is from about 75 percent to about 98 percent of the width of the helical slot 312. As has been discussed above the helical drive shaft 262 may include a helical slot 312. The helical slot 312 may be configured with a constant helical pitch or with a variable helical pitch. For some embodiments the helical slot may be configured as a helical rail as has been previously discussed.

In some cases the force that a rider applies to the plurality of linkages may be distributed between each linkage. That is a portion of the total force a rider apples to the platform assembly 218 may be applied to each of the linkages. Motion of each linkage is due to the physical constraints on the linkage, and the force applied on each linkage by a rider may be applied by the platform assembly 218 (and chassis assembly 220) to the linkage pins 308 which are operatively coupled to the respective slot surfaces of the chassis slot 230 and the platform slot 234. In each case, the force which is applied to a given linkage pin 308 by a respective slot surface will be oriented such that it is perpendicular (normal) to that slot surface.

For some of the linkage embodiments discussed herein, linkages which are adjacent to a given linkage may also apply forces to that linkage. For example, consider the second linkage 250 which is depicted in FIG. 35. The second chassis section 252 is operatively coupled to the anchor chassis section 246 of the anchor linkage 244. Upon rotation of the platform assembly 218 with respect to the chassis assembly 220 (and subsequent decrease of the variable slot height 242) the second chassis section 252 applies a linkage force to the anchor chassis section 246, with a component of that linkage force being directed along the chassis slot plane 282. Similarly, consider the drive linkage 256. The second platform section 254 is operatively coupled to the drive platform section 260. Upon rotation of the platform assembly 218 with respect to the chassis assembly 220 (and subsequent decrease of the variable slot height 242) the drive platform section 260 applies a linkage force to the second platform section 254, with a component of that linkage force being directed along the platform slot plane 280.

The truck assembly 226 and the second truck assembly 228 may be configured with features, dimensions, elements, and functionalities which are substantially similar to the truck assembly embodiments 20 and 22 which have been discussed previously. The truck assemblies 226 and 228 may be rotationally secured to the chassis assembly 220 by multiple chassis steering bosses 89 which are coupled to respective truck steering channels 91 which have both been discussed previously. As discussed above, the axle 264 may be operatively coupled to the helical drive shaft 262 by at least one miter gear which is disposed within the truck assembly 226. Additionally a universal joint 316 may operatively coupled between the helical drive shaft 262 and the axle 264. In some cases, the universal joint 316 may be configured as a flexible coupler. For some embodiments, the axle 264 may be operatively coupled to the wheels 268 with at least one ratchet mechanism. For some other embodiments a ratchet mechanism may be operatively coupled between the helical drive shaft 262 and the axle 264.

The second drive mechanism 224 may be configured in a similar manner to the drive mechanism 222 and may include a second helical drive shaft 320 having a second helical slot 322, a second axle 324 disposed within the second truck assembly 228 and operatively coupled to a plurality of second wheels 326, a second anchor linkage 328, a second second linkage 330, and a second drive linkage 332. The second drive linkage 332 may be operatively coupled to a respective second drive pin 333 as has been discussed above for the drive linkage 256 and drive pin 310. The second drive linkage may include a second drive chassis section 331. As discussed above the second axle 324 may be operatively coupled to the second helical drive shaft 320 such that rotation of the platform assembly 218 with respect to the chassis assembly 220 in the second angular direction 204 results in rotation of the second axle 324 and second wheels 326 in the first angular direction 184. For some embodiments the drive mechanism 222 may be operatively coupled to the second drive mechanism 224 by the helical shaft connector 208 (see FIG. 38). In some cases the helical shaft connector 208 may be configured as a universal joint, in some other cases the helical shaft connector may be configured as a flexible coupling shaft.

In some cases (not shown), the rotation powered vehicle 216 drive mechanism 222 may include additional linkages. For example the drive mechanism 222 may include a third linkage and a fourth linkage which are operatively coupled between the second linkage 250 and the drive linkage 256, with a third platform section being pivotally coupled to the second platform section 254 and a third chassis section being slidably and pivotally coupled to the chassis slot 230, a fourth chassis section being pivotally coupled to the third chassis section and a fourth platform section being slidably and pivotally coupled to the platform slot 234, and the drive platform section 260 being pivotally coupled to the fourth platform section.

FIGS. 39-42 depict an embodiment of a rotation powered vehicle drive mechanism 334 which includes four linkages (even number of linkages), in this case an anchor linkage 334 is pivotally secured to the chassis assembly 220 (as opposed to the platform assembly 218 as has been discussed above). In general, when the anchor linkage is pivotally secured to the platform assembly 218 there will be an odd number of linkages and when the anchor linkage is secured to the chassis assembly 220 there will be an even number of linkages. This is because in each case the respective drive chassis section must be operatively coupled to the helical drive shaft which is disposed within the chassis assembly 220.

The drive mechanism 334 may include the anchor linkage 336 which includes an anchor chassis section 338 and an anchor platform section 340, and which is disposed between the chassis assembly 220 and the platform assembly 218. The anchor chassis section 338 may be pivotally coupled to the chassis assembly 220 and the anchor platform section 340 may be slidably and pivotally coupled to the platform slot 234. The anchor linkage 336 may thus be constrained by the chassis assembly 220 and the platform slot 234 such that an increase or decrease in the variable slot height 242 results in translation of the anchor platform section along 340 the platform slot 234.

The drive mechanism 334 may also include a second linkage 342 which includes a second chassis section 344 and a second platform section 346, and which is disposed between the chassis assembly 220 and the platform assembly 218. The second platform section 346 may be pivotally coupled to the anchor platform section 340, and the second chassis section 344 may be pivotally and slidably coupled to the chassis slot 230. The second linkage 342 may thus be constrained by the anchor linkage 336 and the chassis slot 230 such that an increase or decrease in the variable slot height 242 results in translation of the second chassis section 344 along the chassis slot 230.

The drive mechanism 344 may also include a third linkage 348 which includes a third chassis section 350 and a third platform section 352, and which is disposed between the chassis assembly 220 and the platform assembly 218. The third chassis section may be pivotally coupled to the second chassis section 344, and the third platform section 350 may be pivotally and slidably coupled to the platform slot 234. The third linkage 348 may thus be constrained by the second linkage 342 and the platform slot 234 such that increase or decrease in the variable slot height 242 results in translation of the third platform section 352 along the platform slot 234.

Figure 37:
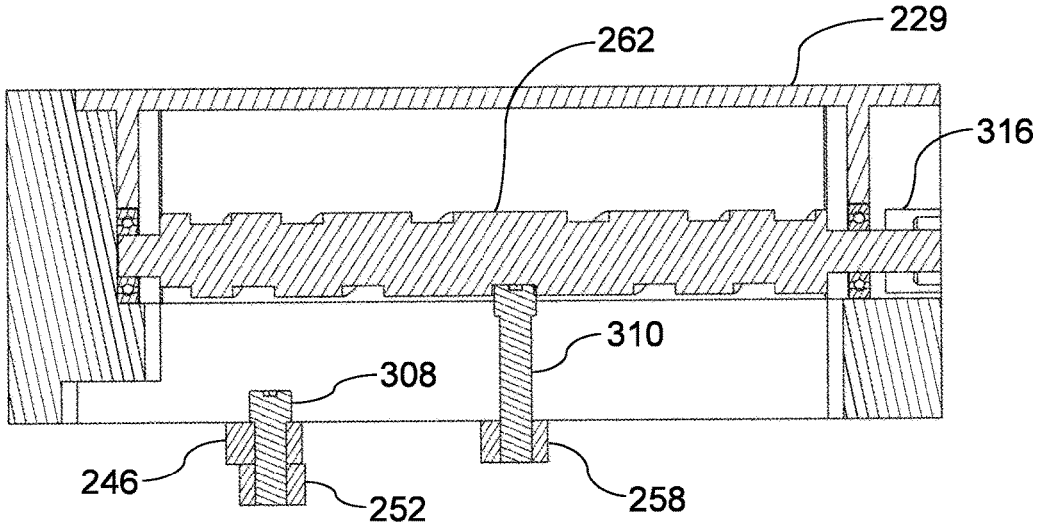
FIG. 37 is a sectional view of the rotation powered vehicle embodiment of FIG. 32.

The drive mechanism 334 may also include a drive linkage 354 which includes a drive chassis section 356 and a drive platform section 358, and which is disposed between the chassis assembly 220 and the platform assembly 218. The drive platform section 358 may be pivotally coupled to the third platform section 352, and the drive chassis section 356 may be pivotally and slidably coupled to the chassis slot 230. The drive linkage 354 may thus be constrained by the third linkage 348 and the chassis slot 230 such that increase or decrease in the variable slot height 242 results in translation of the drive chassis section 356 along the chassis slot 230. The drive chassis section 356 may be operatively coupled to the helical drive shaft 262 by a drive pin 310 (see FIG. 37).

As discussed above, the rotation powered vehicle embodiment 216 may include the chassis assembly 220 and the platform assembly 218 which may be pivotally secured to the chassis assembly 220 such that the platform assembly 218 may rotate with respect to the chassis assembly 220 about a platform rotation axis 240. The rotation powered vehicle 216 may also include the drive mechanism 222 which may have a plurality of drive linkages which may be operatively coupled to the chassis assembly 220, the platform assembly 218, and/or to adjacent linkages such that rotation of the platform assembly 218 with respect to the chassis assembly 220 results in rotation and/or translation of the linkages. The drive mechanism 222 may also include the helical drive shaft 262 which may be rotationally secured within the chassis assembly 220. The helical drive shaft 262 may be operatively coupled to the drive linkage 256 such that translation of a drive chassis section 258 of the drive linkage 256 along the chassis assembly 220 results in rotational motion of the helical drive shaft 262.

The rotation powered vehicle 216 may also include the truck assembly 226 which may be pivotally secured to the chassis assembly 220. The Truck assembly 226 may include an axle 264 which may be rotationally secured to the truck assembly 226 and operatively coupled to the plurality of wheels 268. The axle 264 may be operatively coupled to the helical drive shaft 262 whereby rotation of the platform assembly 218 with respect to the chassis assembly 220 in the first angular direction 184 results in translation of the drive chassis section 258 along the chassis assembly 220 and rotation of the axle 264 and wheels 268 in the first angular direction 184.

The rotation powered vehicle 216 may also include the second drive mechanism 224, which may have a plurality of linkages which may be operatively coupled to the chassis assembly 220, the platform assembly 218, and/or to adjacent linkages whereby rotation of the platform assembly 218 with respect to the chassis assembly 220 induces rotation and/or translation of the linkages. The second drive mechanism 224 may also include the second helical drive shaft 322 which may be rotationally secured within the chassis assembly 220. The second helical drive shaft 322 may be operatively coupled to the second drive linkage 332 such that translation of the second drive chassis section 331 of the second drive linkage 332 along the chassis assembly results in rotational motion of the second helical drive shaft 322.

The rotation powered vehicle 216 may also include the second truck assembly 228 which may be pivotally secured to the chassis assembly 220. The second truck assembly 228 may include the second axle 324 which may be rotationally secured to the second truck assembly 228 and which may be operatively coupled to the plurality of second wheels 326. The second axle 324 may be operatively coupled to the second helical drive shaft 322 such that rotation of the platform assembly 218 with respect to the chassis assembly 220 in the second angular direction 204 results in translation of the second drive chassis section 331 along the chassis assembly 220 and rotation of the second axle 324 and second wheels 326 in the first angular direction 184.

Figure 33:
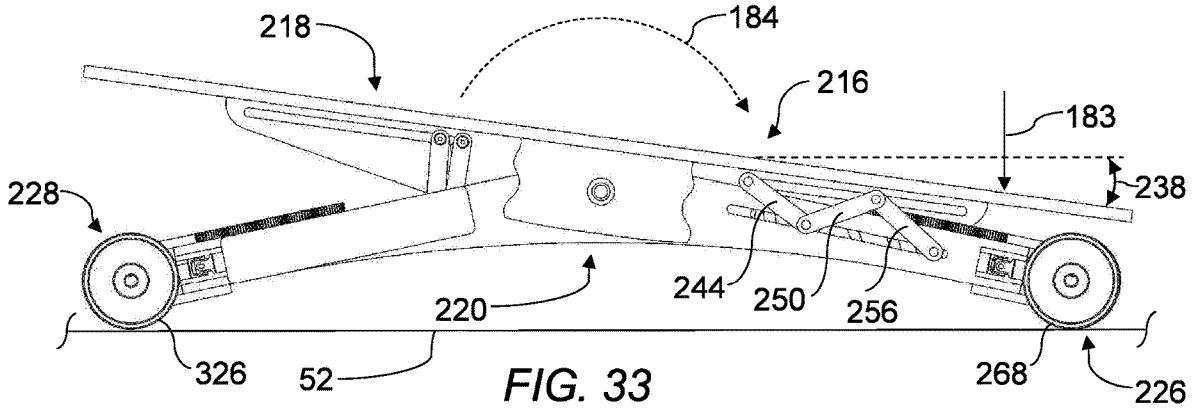
FIG. 33 is an elevation view in partial section of the rotation powered vehicle of FIG. 29 undergoing a first half power cycle.
Figure 34:
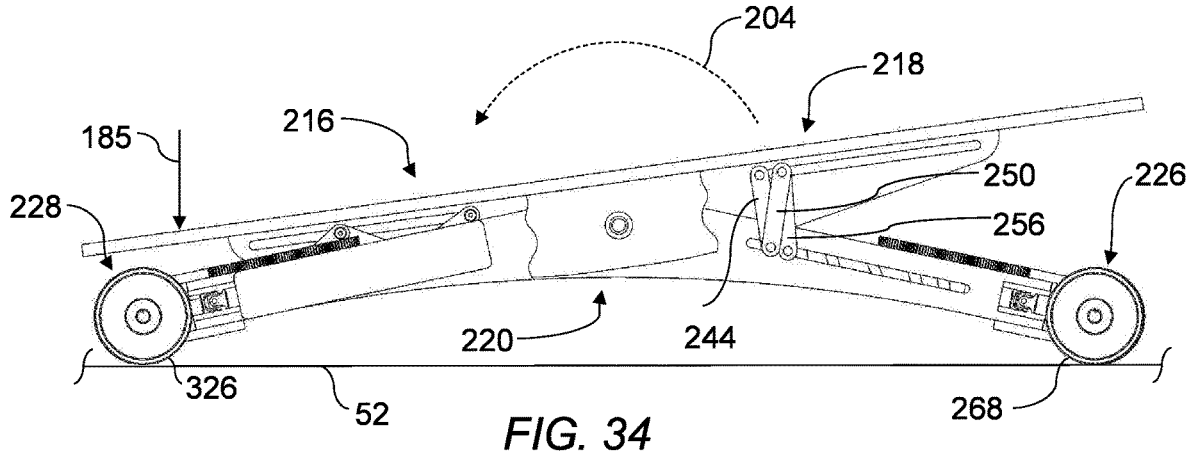
FIG. 34 is an elevation view in partial section of the rotation powered vehicle of FIG. 29 undergoing a second half power cycle.

In use the rotation powered vehicle 216 drive mechanisms 222 and 224 would operate as described by the following (see FIGS. 32-34): rotation of the platform assembly 218 with respect to the chassis assembly 220 decreases the variable slot height 242 which are measured between the chassis slot 230 and the platform slot 234. The plurality of linkages being constrained by the chassis assembly 220, the platform assembly 218, the chassis slot 230, the platform slot 234, and/or by adjacent linkages such that the rotation of the platform assembly 218 results in rotation and/or translation of the plurality of linkages, rotation of the helical drive shafts 262 and 320, and rotation of the axles 264 and 324 and respective wheels 268 and 326.

The drive mechanism 222 may be configured (see FIG. 33) such that rotation of the platform assembly 218 with respect to the chassis assembly 220 in the first angular direction 184 via an application of a first half power cycle force 183 results in rotation of the axle 60 and respective wheels 62 in the first angular direction 184. The second drive mechanism 224 may be configured (see FIG. 34) such that rotation of the platform assembly 218 with respect to the chassis assembly 220 in the second angular direction 204 via an application of a second half power cycle force 185 results in rotation of the second axle 198 and second wheels 202 in the first angular direction 184.

Additionally, in some cases rotating the platform assembly 218 with respect to the chassis assembly 220 may increase the variable slot height 242 each of which is measured between the chassis slot 230 and the platform slot 234. The plurality of linkages may include an odd number of linkages (three or five), or an even number of linkages (two, four, or six). For the rotation powered vehicle 216 of FIG. 29, the drive linkage 256 may be operatively coupled to the helical drive shaft 262 through a lateral surface 360 of the chassis assembly 220. For some embodiments (not shown), the drive linkage 256 may be operatively coupled to the helical drive shaft 262 through a top surface 362 of the chassis assembly 220. For some embodiments (not shown) the linkages may be disposed within the chassis body 229 as opposed to between the chassis assembly 220 and the platform assembly 218.

Figure 47:
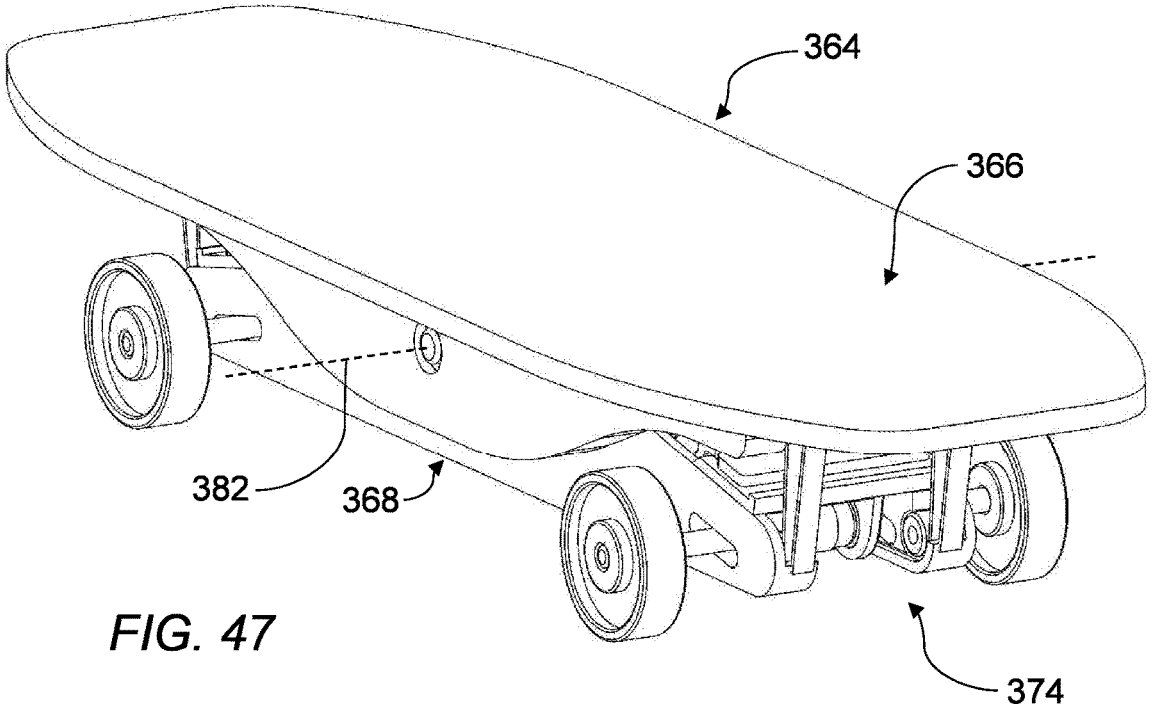
FIG. 47 is a perspective view of a rotation powered vehicle embodiment having a platform assembly which is rotationally secured to a chassis assembly and multiple drive mechanism, each drive mechanism utilizing a sprocket assembly and a chassis platform belt.
Figure 48:
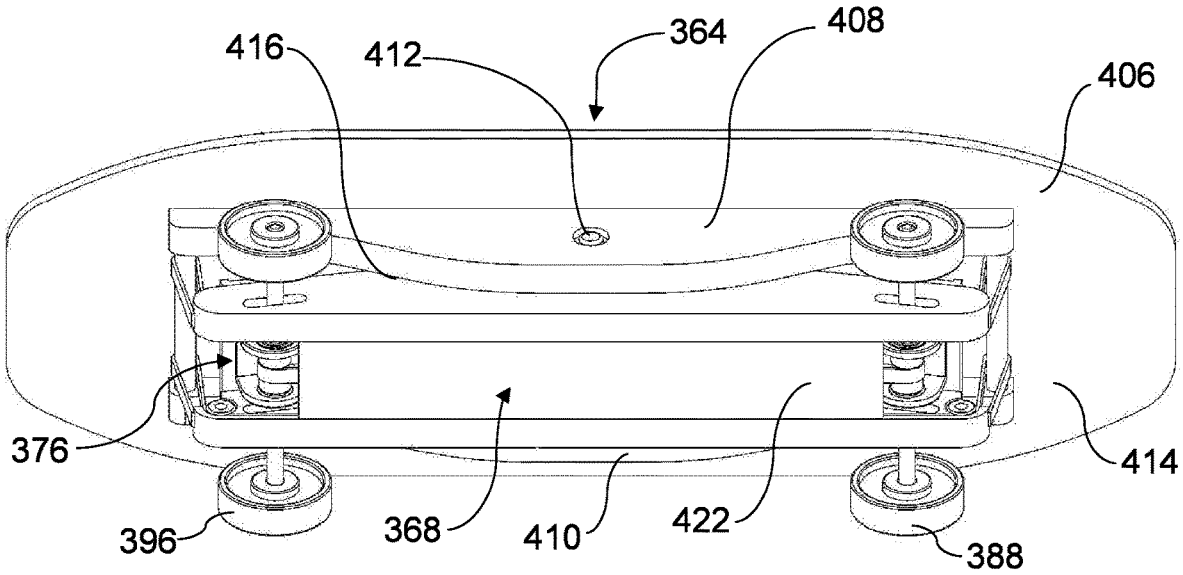
FIG. 48 is a perspective view of the rotation powered vehicle of FIG. 47.
Figure 49:
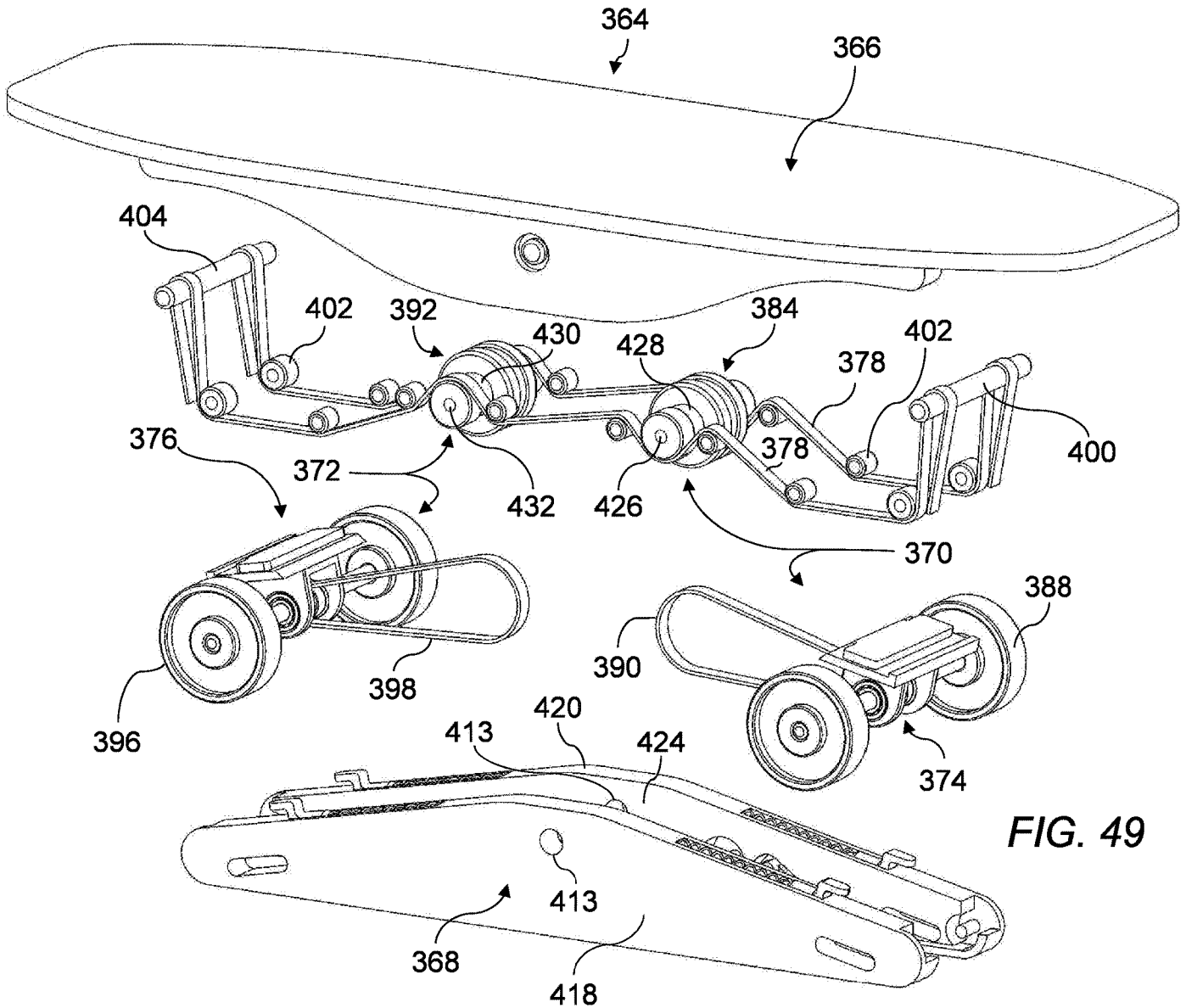
FIG. 49 is an exploded view of the rotation powered vehicle embodiment of FIG. 47.
Figure 50:
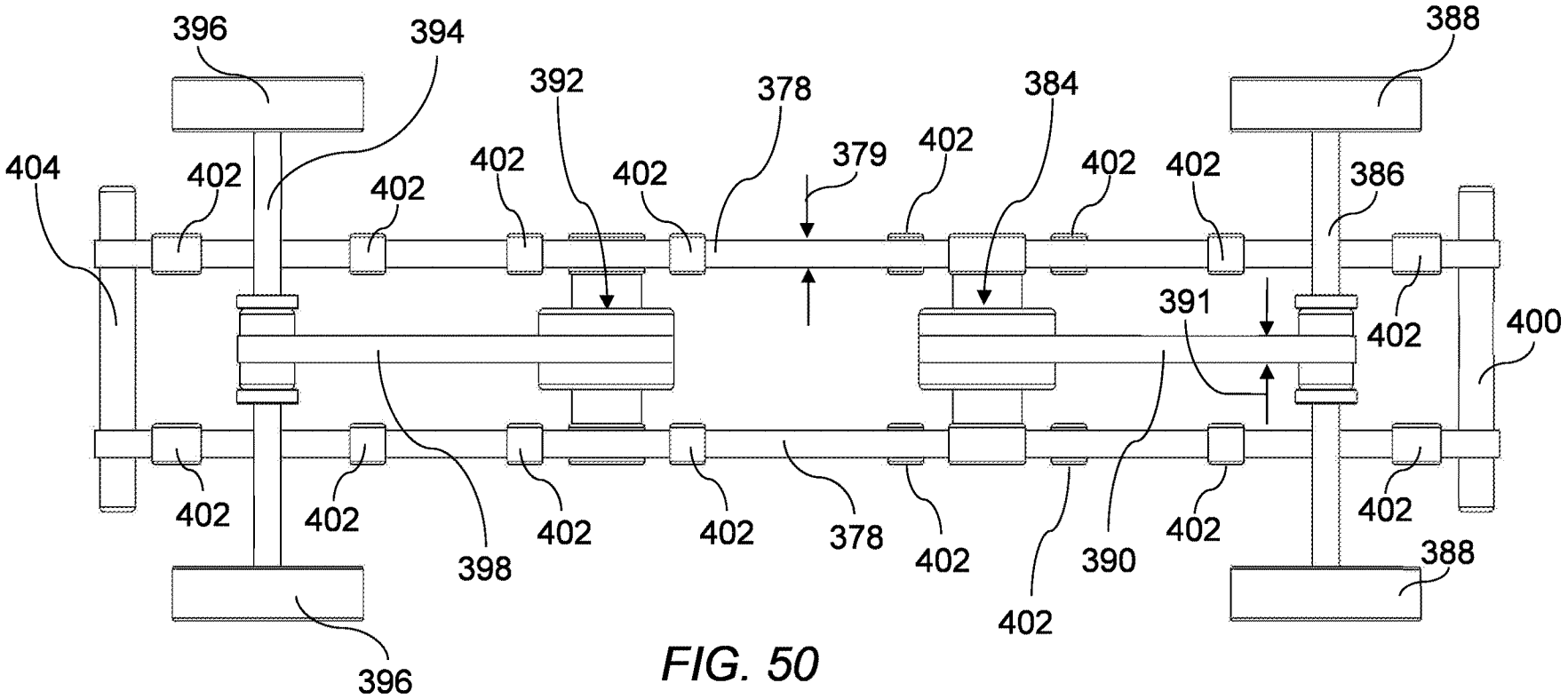
FIG. 50 is an elevation view of the drive mechanisms of the rotation powered vehicle embodiment of FIG. 47.

An embodiment of a rotation powered vehicle 364 which incorporates drive mechanisms which utilize belts which are operatively coupled between a platform assembly 366 and a chassis assembly 368 is shown in FIGS. 47-49. The rotation powered vehicle 364 may include a drive mechanism 370, a second drive mechanism 372, a truck assembly 374, and a second truck assembly 376. The drive mechanisms 370 and 372 may be configured to convert rotational motion of the platform assembly 366 with respect to the chassis assembly 368 into motion of the rotation powered vehicle 364 in the first linear direction 50.

The drive mechanism 370 may include a chassis platform belt 378 which is operatively coupled between the platform assembly 366 and the chassis assembly 368. The platform assembly 366 mat be pivotally secured to the chassis assembly 368 by a pivot rod 412 in some cases thereby allowing for rotation through a platform rotation angle 380 of the platform assembly 366 with respect to the chassis assembly 368 about a platform rotation axis 382. The drive mechanism 370 may also include a sprocket assembly 384 which may be disposed within the chassis assembly 368 and which may be operatively coupled to the chassis platform belt 378.

Figure 51:
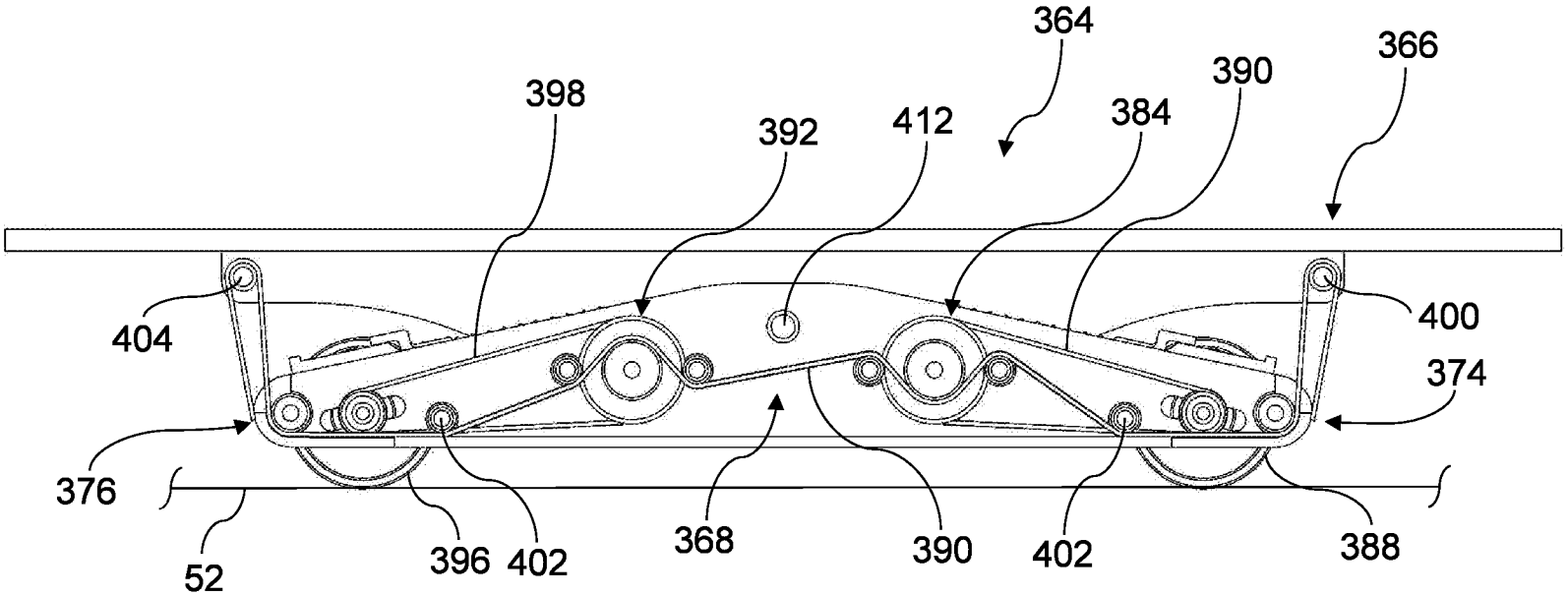
FIG. 51 is an elevation view in partial section of the rotation powered vehicle of FIG. 47.

The rotation powered vehicle embodiment 364 may also include at least one power cycle dampener 44 (not shown) which may be configured to provide a restorative force to the platform assembly 366 when the platform assembly 366 is rotated about the platform rotation axis 382 and through a platform rotation angle 380 from a neutral platform position (in FIG. 51 the platform assembly 366 is disposed in the neutral platform position). In this manner the at least one power cycle dampener 44 acts (via the restorative force) to maintain the platform assembly 366 in the neutral position.

The drive mechanism 370 may also include the truck assembly 374 which may be pivotally secured to the chassis assembly 368 such that the truck assembly 374 can rotate with respect to the chassis about a truck pivot axis 385. In some cases, the truck assembly 374 may be pivotally secured to a truck chassis plate 377 of the chassis assembly 368 which may be rigidly secured between a first chassis panel 418 and a second chassis panel 420. A truck dampener plate 450 may be connected to a lower truck body 375 portion of the truck assembly 374 by a truck steering pin 381 which may be rotationally disposed within a steering pin channel 383 of the truck dampener plate 450. The second truck assembly 376 may be rotationally secured to the chassis assembly 368 in a manner which is substantially similar to that which has been discussed for the truck assembly 374. The truck assembly 374 may also include an axle 386 which is operatively coupled to a plurality of wheels 388 in some cases by at least one bearing 142. The truck assembly 374 may also be operatively coupled to the sprocket assembly 384 by a sprocket axle belt 390.

The sprocket assembly 384 may be configured to rotate via the sprocket axle belt 390 the axle 386 and wheels 388 in the first angular direction 184 when rotation of the platform assembly 366 with respect to the chassis assembly 368 in the first angular direction 184 translates the chassis platform belt 378 about the sprocket assembly 384. For some embodiments the chassis platform belt 378 may have a width 379 from about 0.25 inches to about 2 inches, and the sprocket axle belt 390 may have a width 391 from about 0.25 inches to about 1 inch.

The rotation powered vehicle 364 may also include a second drive mechanism 372 which may be pivotally secured to the platform assembly 366. The second drive mechanism 372 may include a second sprocket assembly 392. The second truck assembly may include a second axle 394 which is operatively coupled to a plurality of wheels 396, and a second sprocket axle belt 398 which operatively couples the second sprocket assembly 392 to the second axle 394. The second sprocket assembly 392 may be configured to rotate via the second sprocket axle belt 398 the second axle 394 and second wheels 396 in the first angular direction 184 when rotation of the platform assembly 366 with respect to the chassis assembly 368 in the second angular direction 204 translates the chassis platform belt 378 about the second sprocket assembly 392. For some rotation powered vehicle embodiments 364 the chassis platform belt 378 may be operatively coupled to the sprocket assembly 384 and the second sprocket assembly 392. For some other embodiments (not shown), the sprocket assembly 384 and the second sprocket assembly 392 may be operatively coupled to independent chassis platform belts.

The chassis platform belt 378 may be configured as any suitable flexible resilient member such as a chain, a cable, a rope or the like. A variety of elements may be used to guide and or constrain the chassis platform belt 378. The chassis platform belt 378 may be operatively coupled to the platform assembly 366 by at least one belt pulley 400. Some embodiments may include a plurality of belt rollers 402 which may be disposed on the chassis assembly 368 and which may be operatively coupled to the chassis platform belt 378. Each belt roller 402 may be configured to tension the chassis platform belt 378 onto the sprocket assembly 384.

As discussed above for some embodiments of the rotation powered vehicle 364 the chassis platform belt 378 may be operatively coupled to the platform assembly 366 by at least one belt pulley 400. The at least one belt pulley 400 may act to increase the length of the section of chassis platform belt 378 which is translated about the sprocket assembly 384 as the platform assembly 366 is rotated with respect to the chassis assembly 368. The rotation powered vehicle embodiment 364 of FIG. 47 incorporates the belt pulley 400 and a second belt pulley 404. Both the belt pulley 400 and the second belt pulley 404 act to increase the length of the section of chassis platform belt 378 which is translated about the sprocket assembly 384 as the platform assembly 366 is rotated with respect to the chassis assembly 368.

To further elaborate, each belt pulley 400 and 402 provides a 2:1 increase in the length of the section of chassis platform belt 378 which is translated about the sprocket assembly 384 during a given half power cycle. For the rotation powered vehicle embodiment 364 of FIG. 47 each end of the chassis platform belt 378 is secured to a respective single belt pulley 400 and 404. For some other embodiments (not shown), each end of the chassis platform belt 378 may be secured to multiple belt pulleys which are secured to the platform assembly 366.

The platform assembly 366 may include a board 406, a first side panel 408, a second side panel 410, and a pivot rod 412. For some embodiments of the platform assembly 366 the first and second side panels 408 and 410 may be secured to a lower board surface 414, and the first and second side panels 408 and 410 may be separated by a chassis gap 416. The pivot rod may 412 be rotationally secured to the first side panel 408 and the second side panel 410, and may span the chassis gap 416 disposed between the first side panel 408 and the second side panel 410. The pivot rod 412 may be rotationally secured to the first side panel 408 and the second side panel 410 by pivot channels 413 which are disposed within the first side panel 408 and the second side panel 410. In some cases, the pivot rod 412 and the respective pivot channel 413 may each have a substantially cylindrical shape. For some embodiments, the pivot rod 412 may be rigidly secured to the chassis assembly 368 by any suitable means such as adhesive or pins.

The chassis assembly 368 may include the first chassis panel 418 and the second chassis panel 420 which may be connected by a lower chassis plate 422. The first chassis panel 418 and the second chassis panel 420 may be separated by a drive mechanism gap 424, which may be disposed between the first chassis panel 418, the second chassis panel 420, and the lower chassis plate 422. The drive mechanism gap 424 may be configured to suitably contain and protect some elements of the drive mechanism 370 and the second drive mechanism 372. Some other elements of the drive mechanism 370 and the second drive mechanism 372 may be disposed within the first chassis panel 418 or the second chassis panel 420.

The sprocket assembly 384 may be secured to the chassis assembly 368 via a sprocket rod 426. The sprocket rod 426 may be secured to the first chassis panel 418 and the second chassis panel 420 such that the sprocket rod spans 426 the drive mechanism gap 424. The sprocket rod 426 may be rigidly secured to the chassis assembly 366, or the sprocket rod 426 may be rotationally secured to the chassis assembly 366. For some drive mechanism embodiments 370, the sprocket assembly 384 may include a ratchet mechanism 428. The ratchet mechanism 428 may be configured to engage with and rotate via the sprocket axle belt 390 the axle 386 when the sprocket assembly 384 is rotated in the first angular direction 184. The ratchet mechanism 428 may also be configured to not engage the axle 386 via the sprocket axle belt 390 when the sprocket assembly 384 is rotated in the second angular direction 204.

The second sprocket assembly 392 may include a second ratchet mechanism 430, and may be secured to the chassis assembly 368 by a second sprocket rod 432. The second ratchet mechanism 392 may be configured to engage with and rotate via the second sprocket axle belt 398 the second axle 394 when the second sprocket assembly 392 is rotated in the first angular direction 184. The second ratchet mechanism 430 may also be configured to not engage the second axle 394 via the second sprocket axle belt 398 when the second sprocket assembly 392 is rotated in the second angular direction 204.

For some embodiments, the sprocket assembly 384 and second sprocket assembly 392 may spin freely on the sprocket rod 426 and the second sprocket rod 432 respectively. In this case the sprocket axle belt 390 may be operatively coupled to a clutch bearing (such as McMaster-Carr Catalog #2489K24 one-way locking bearing clutch) which is disposed on the axle 386. The clutch bearing may be configured such that it engages/disengages the sprocket axle belt 390 in a manner which is similar to the sprocket assembly 384/ratchet mechanism 428 which has been discussed above. Similarly, the second sprocket axle belt 398 may be operatively coupled to a second clutch bearing which is disposed on the second axle 394. The second clutch bearing may be configured such that it engages/disengages the second sprocket axle belt 398 in a manner which is similar to the second sprocket assembly 392/second ratchet mechanism 430 which has been discussed above.

For some embodiments (not shown) the sprocket assembly 384 may include multiple diameters which are configured to engage the sprocket axle belt 390. The sprocket assembly 384 may also include a belt tensioner and shifter which would allow a rider of the rotation powered vehicle to shift between gears (the different diameters which are engaged with the sprocket axle belt 390) while the tensioner maintains tension on the sprocket axle belt 390. For some embodiments the shifter could be user controlled, for some other embodiments the shifter could be automatic.

For the rotation powered vehicle embodiment 364 discussed above the outer surfaces of the sprocket assemblies 384 and 392, belt pulleys 400 and 404, belt rollers 402, axles 386 and 394, and roller bearings may be configured to sufficiently grip the inner surface of the respective chassis platform belt 378 and or sprocket axle belt 390 and 398. For example, an outer surface of the sprocket assembly 384 may be configured with teeth, and the respective sprocket axle belt 390 may be configured as a chain. As another example, the belt rollers 402 may be configured as gears (with teeth on the outer surfaces) and the chassis platform belt 378 may be configured as a drive belt with mating teeth on the inner surface of the drive belt.

As discussed above, the rotation powered vehicle embodiment 364 may include the chassis assembly 368 and the platform assembly 366 which may be pivotally secured to the chassis assembly 368 such that the platform assembly 366 may rotate with respect to the chassis assembly 368 about a platform rotation axis 382. The rotation powered vehicle 364 may also include the drive mechanism 370 which may have a chassis platform belt 378 which may be operatively coupled between the platform assembly 366 and the chassis assembly 368. The drive mechanism 370 may also include the sprocket assembly 384 which may be disposed within the chassis assembly 368 and which may be operatively coupled to the chassis platform belt 378.

The rotation powered vehicle 364 may also include the truck assembly 374 which may be pivotally secured to the chassis assembly 368. The truck assembly 374 may include the axle 386 which may be rotationally secured to the truck assembly 374 and operatively coupled to the plurality of wheels 388. The axle 386 may be operatively coupled to the sprocket assembly 384 by a sprocket axle belt 390, with the sprocket assembly 384 being configured to rotate via the sprocket axle belt 390 the axle 386 and respective wheels 388 in a first angular direction 184 when rotation of the platform assembly 366 with respect to the chassis assembly 368 in the first angular direction 184 translates the chassis platform belt 378 about the sprocket assembly 384.

The rotation powered vehicle 364 may also include the second drive mechanism 372 including the second sprocket assembly 392 which may be disposed within the chassis assembly 368 and which may be operatively coupled to the chassis platform belt 378. The rotation powered vehicle 364 may also include the second truck assembly 376 which is pivotally secured to the chassis assembly 368. The second truck assembly 376 may include the second axle 394 which may be rotationally secured to the second truck assembly 376 and which may be operatively coupled to the plurality of second wheels 396. The second axle 394 may be operatively coupled to the second sprocket assembly 392 by a second sprocket axle belt 398. The second sprocket assembly 392 may be configured to rotate via the sprocket axle belt 390 the second axle 394 and respective second wheels 396 in the first angular direction 184 when rotation of the platform assembly 366 with respect to the chassis assembly 368 in the second angular direction 204 translates the chassis platform belt 378 about the second sprocket assembly 392.

Figure 52:
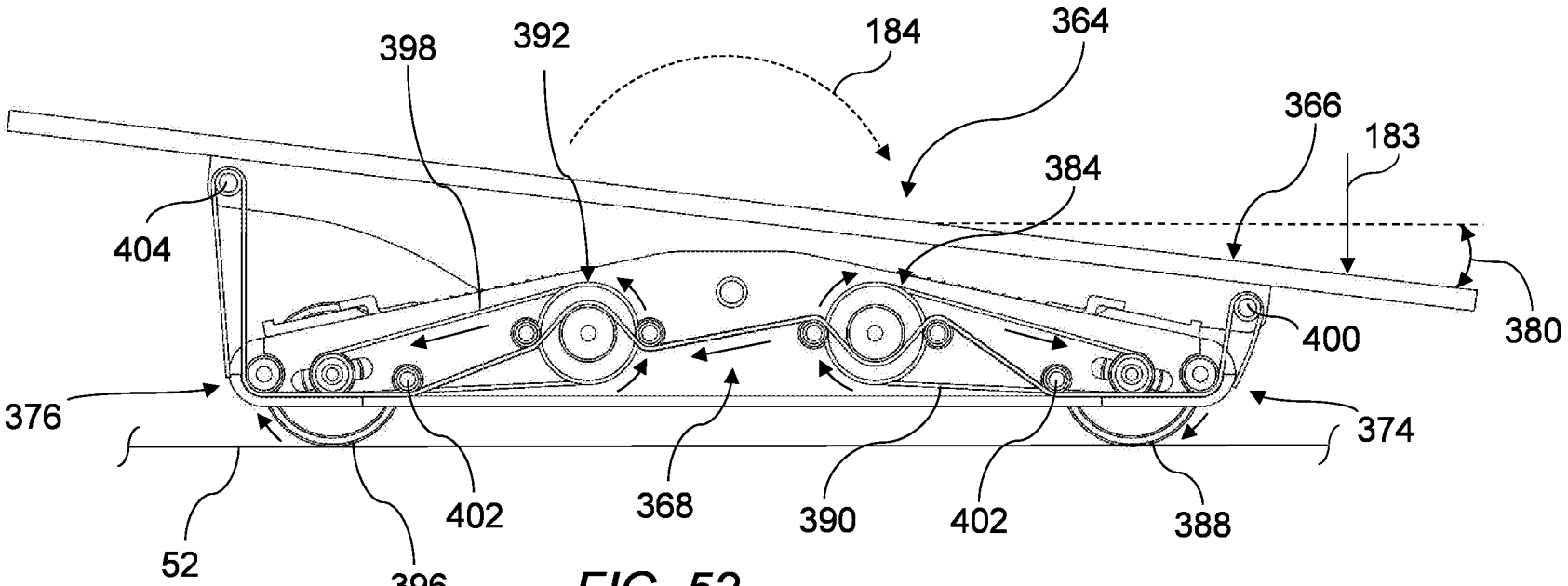
FIG. 52 is an elevation view in partial section of the rotation powered vehicle of FIG. 47 undergoing a first half power cycle.

In use, the rotation powered vehicle 364 of FIG. 47 would operate as described by the following. The platform assembly 366 may be rotated with respect to the chassis assembly 368 in the first angular direction 184 via the application of a first half power cycle force 183 thereby translating the chassis platform belt 378 about the sprocket assembly 384 thereby resulting in rotation of the sprocket assembly 384, the sprocket axle belt 390, the axle 386, and the wheels 388 in the first angular direction 184 (see FIG. 52). During the rotation of the platform assembly 366 in the first angular direction 184, the ratchet mechanism 428 of the sprocket assembly 384 may be engaged with and rotate via the sprocket axle belt 390 the axle 386. Additionally during the rotation of the platform assembly 366 in the first angular direction 184, the second ratchet mechanism 430 of the second sprocket assembly 392 may not engage the second axle 394 via the second sprocket axle belt 398.

Figure 53:
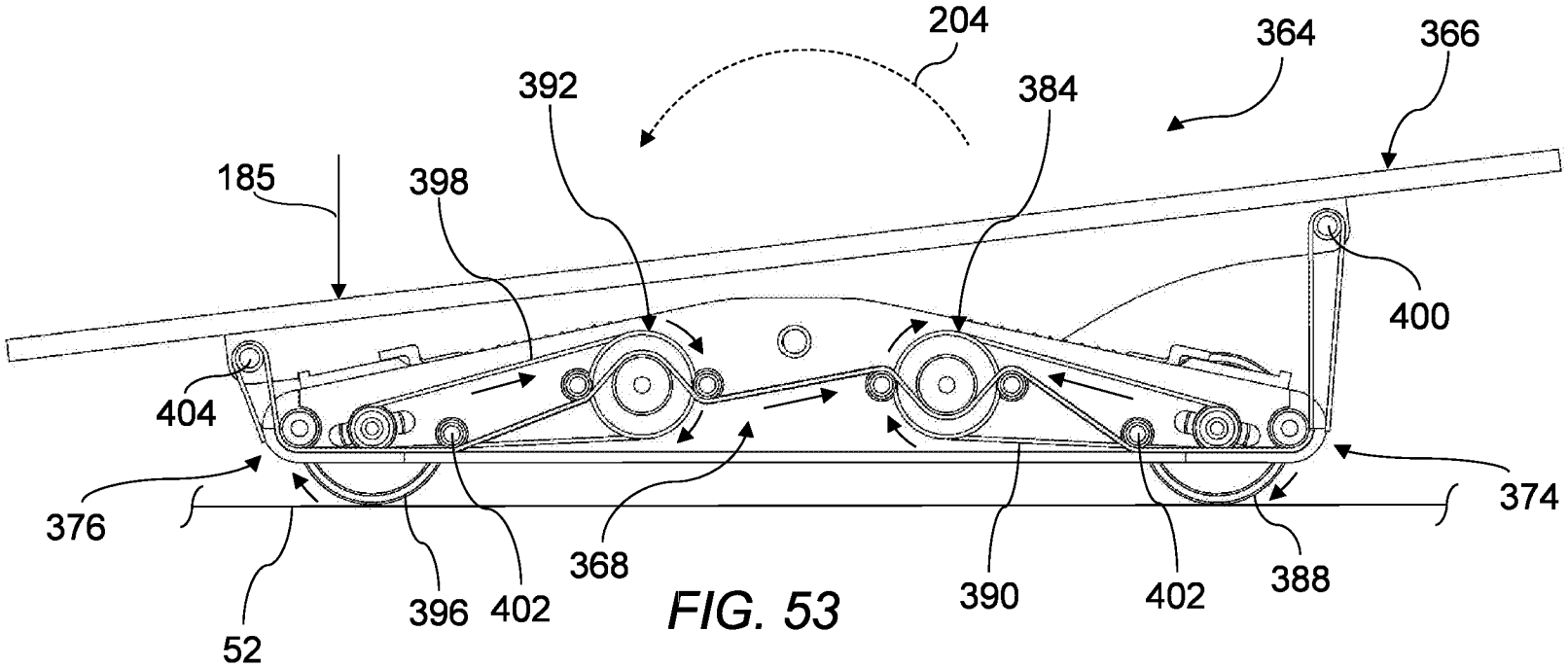
FIG. 53 is an elevation view in partial section of the rotation powered vehicle embodiment of FIG. 47 undergoing a second half power cycle.

The platform assembly 366 may be rotated with respect to the chassis assembly 368 in the second angular direction 204 via the application of a second half power cycle force 185 thereby translating the chassis platform belt 378 about the second sprocket assembly 392 and resulting in rotation of the second sprocket assembly 392, the second sprocket axle belt 398, the second axle 394 and second wheels 396 in the first angular direction 184 (see FIG. 53). During the rotation of the platform assembly 366 in the second angular direction 204, the second ratchet mechanism 430 of the second sprocket assembly 392 may be engaged with and rotate via the second sprocket axle belt 398 the second axle 394. During the rotation of the platform assembly 366 in the second angular direction 204, the ratchet mechanism 428 of the sprocket assembly 384 may not engage the axle 386 via the sprocket axle belt 390.

Rotation powered vehicle embodiments which have been discussed herein may include a variety of steering dampener mechanisms. Each steering dampener mechanisms may be configured to apply a restorative force to the respective rotation powered vehicle when the platform assembly of the rotation powered vehicle is rotated from a "neutral" steering position in the third or fourth angular directions for the purposes of steering. In some cases, the neutral steering position may be a position wherein the rotation powered vehicle is powered such that it travels in a substantially straight line. In this manner, a rider has to apply a steering force to the platform assembly (with the respective steering dampener mechanism applying a restorative force in response) in order to turn the rotation powered vehicle from the neutral steering position.

As discussed previously rotation powered vehicle embodiments which are discussed herein may include a chassis assembly, and a platform assembly which is pivotally secured to the chassis assembly. The rotation powered vehicles may also include a power cycle dampener which is operatively coupled between the chassis assembly and the platform assembly. The rotation powered vehicle embodiments may also include at least one drive mechanism which is operatively coupled between the chassis assembly and the platform assembly; and at least one truck assembly which is pivotally secured to the chassis assembly. The rotation powered vehicle embodiments may also include at least one steering dampener mechanism which is operatively coupled between the at least one truck assembly and the chassis assembly.

For rotation powered vehicle embodiments which are discussed herein, the power cycle dampener and steering dampener mechanism embodiments may be adjusted/optimized for the weight and/or riding ability of a rider of the rotation powered vehicle. For example, a power cycle dampener 44 for a heavier rider may be configured as a torsion spring with a higher spring constant than the spring constant of a power cycle dampener 44 configured as a torsion spring for a lighter rider. Heavier riders may require stiffer (greater restorative forces) steering dampener mechanisms than steering dampeners which are configured for lighter riders. Similarly, less experienced riders may prefer stiffer steering dampener mechanisms as they learn to ride the rotation powered vehicle with the stiffer steering dampener mechanisms providing greater stability for the rotation powered vehicle.

Figure 21:
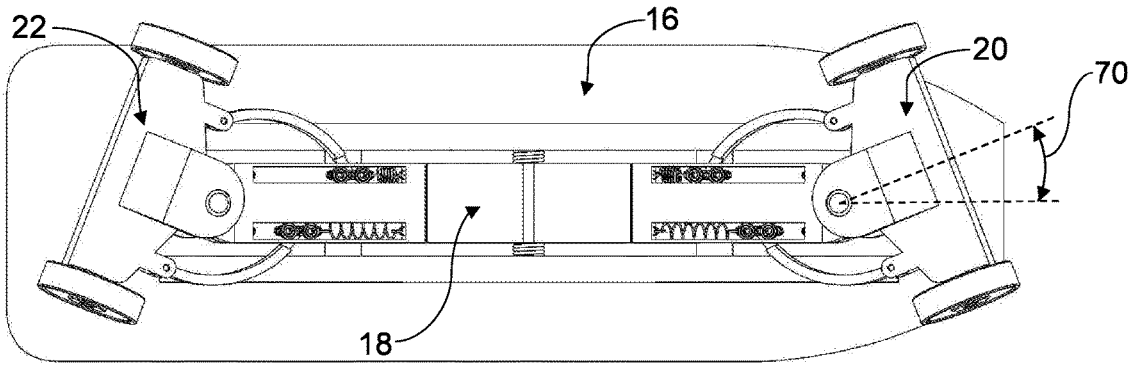
FIG. 21 is an elevation view of the rotation powered vehicle of FIG. 20.
Figure 22:
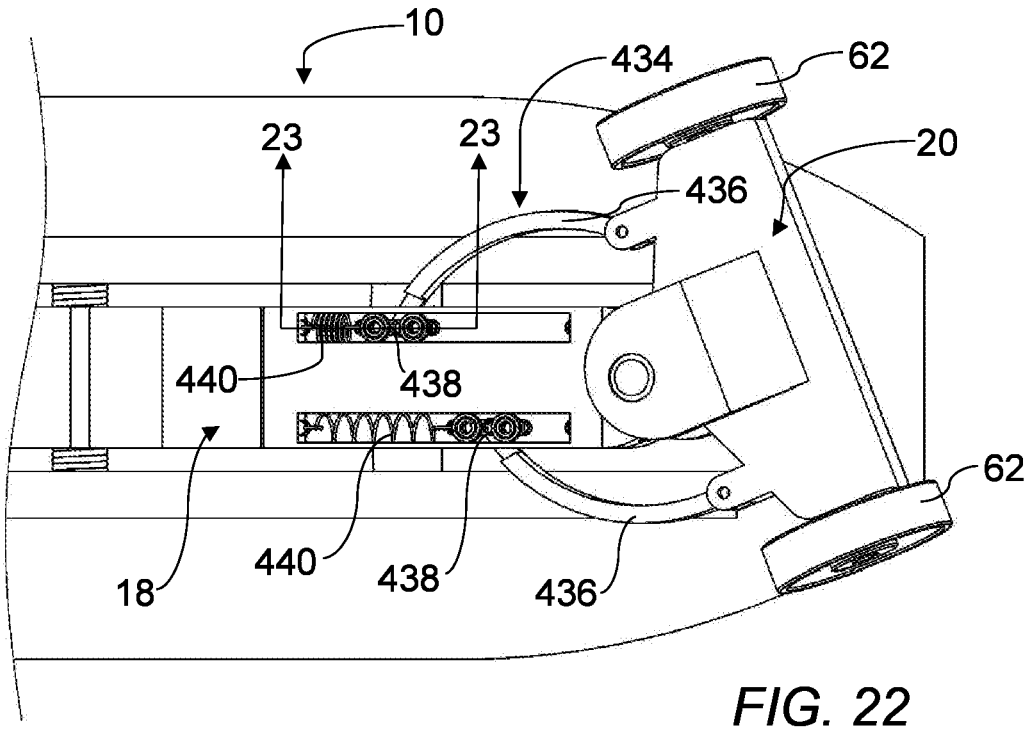
FIG. 22 is an enlarged detail view of FIG. 21.
Figure 23:
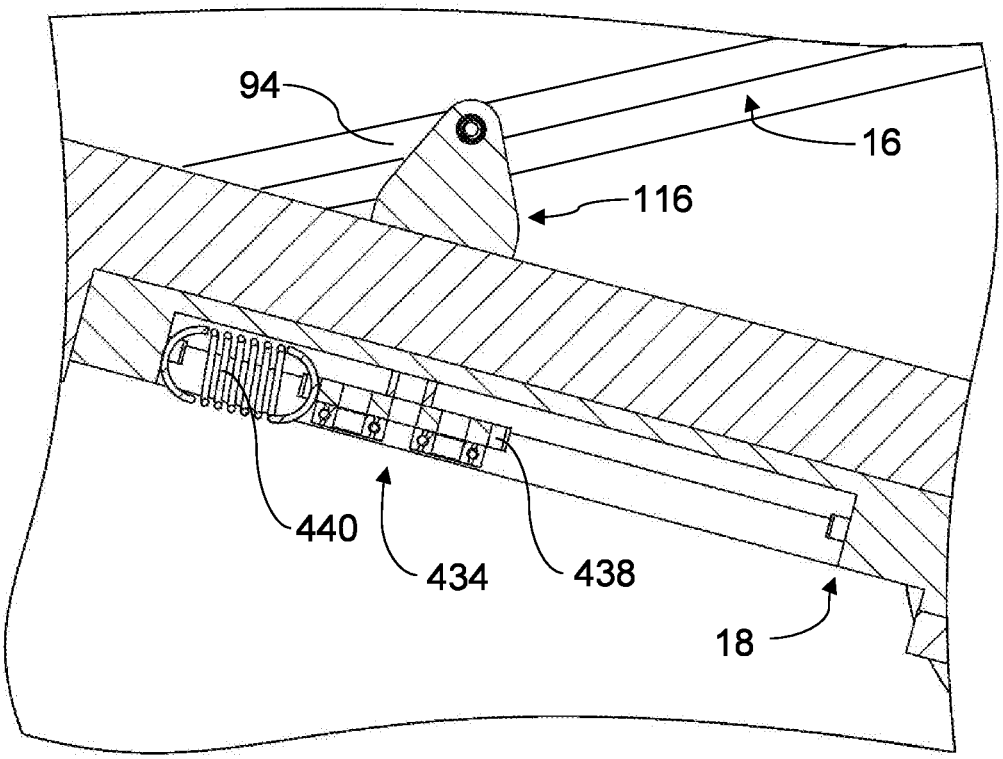
FIG. 23 is a sectional view of the rotation powered vehicle embodiment of FIG. 21 depicting a steering dampener mechanism embodiment.

An embodiment of a steering dampener mechanism 434 is depicted in FIGS. 21-23. In this case the rotation powered vehicle 10 includes a total of four steering dampener mechanisms 434, with two steering dampener mechanisms 434 coupled between each truck assembly 20 and 22 and the chassis assembly 18. The steering dampener mechanism embodiment 434 may include a dampener arm 436 which is rotationally secured to the truck assembly 20 of the rotation powered vehicle 10. The steering dampener mechanism 434 may also include a dampener cart 438 which is slidably disposed within the chassis assembly 18 of the rotation powered vehicle 10 and which is operatively coupled to the dampener arm 438.

The steering dampener mechanism 434 may also include a cart spring 440 which may be operatively coupled between the dampener cart 438 and the chassis assembly 18. The cart spring 440 may be configured to provide a restorative force to the dampener cart 438, dampener arm 436, and truck assembly 20 when rotation of the chassis assembly 18 in the third angular direction 64 or fourth angular direction 66 results in rotation from a neutral truck position (see FIG. 1) of the truck assembly 20 about the truck pivot axis 68. For some embodiments, the dampener cart 438 may be slidably disposed within the chassis assembly 18 via bearings which are disposed between the dampener cart 438 and chassis assembly 18. The cart spring 440 may be configured as a compression spring or a tension spring. Some steering dampener mechanism embodiments 343 may include a second cart spring (not shown) which is operatively coupled between the dampener cart 438 and the chassis assembly 18.

Figure 43:
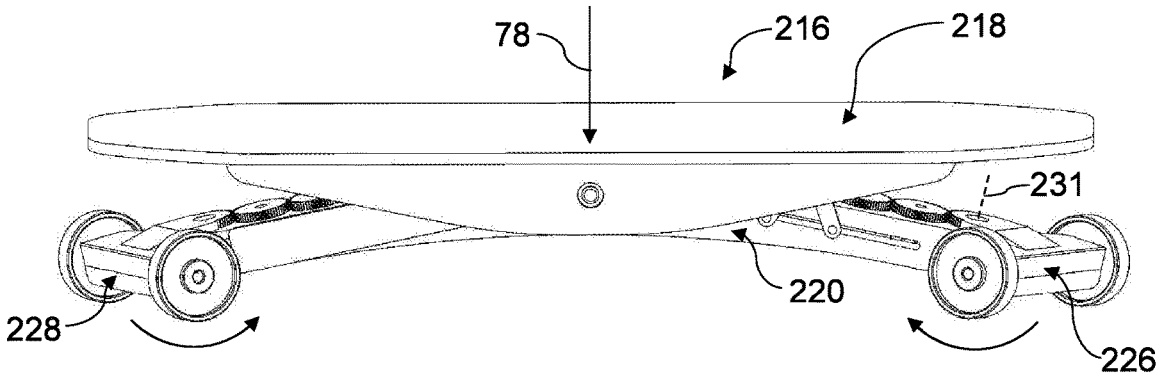
FIG. 43 is a perspective view of the rotation powered vehicle of FIG. 29 under the application of an eccentric steering force and the resultant motion of truck assemblies with respect to the chassis assembly.
Figure 44:
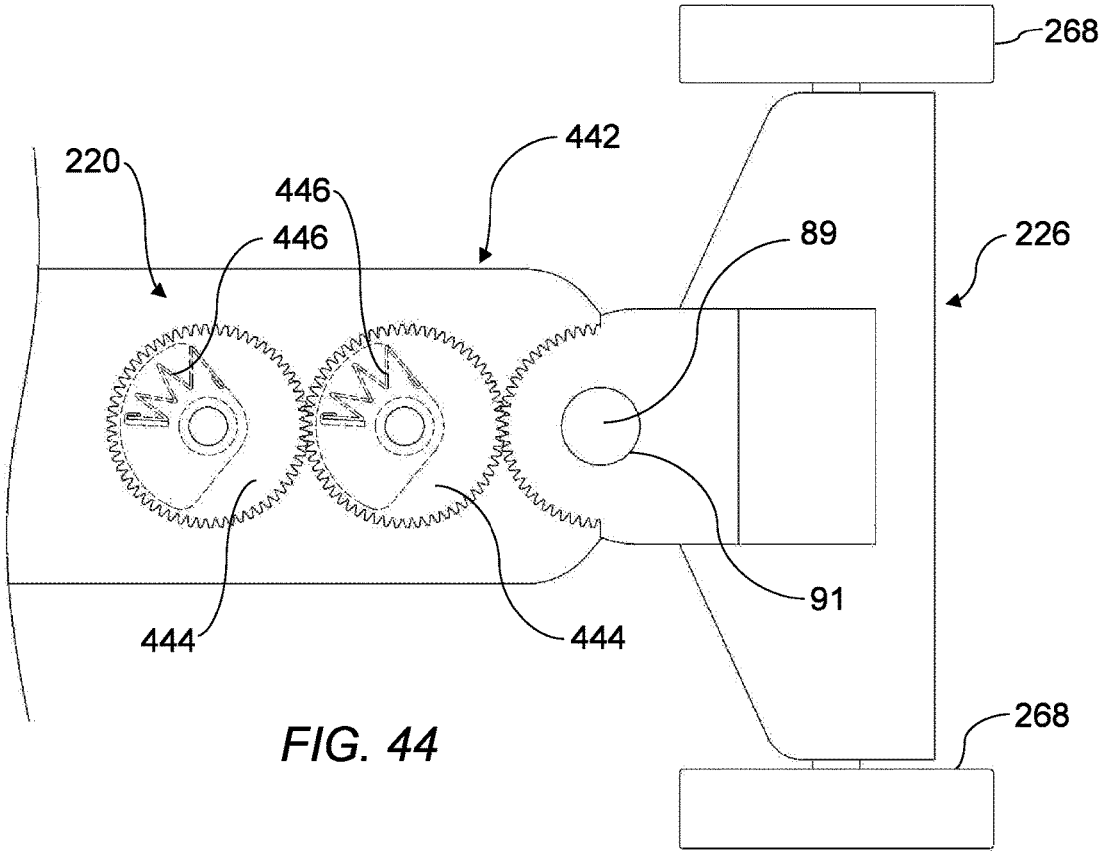
FIG. 44 is an elevation view of a steering dampener embodiment in a neutral position.
Figure 45:
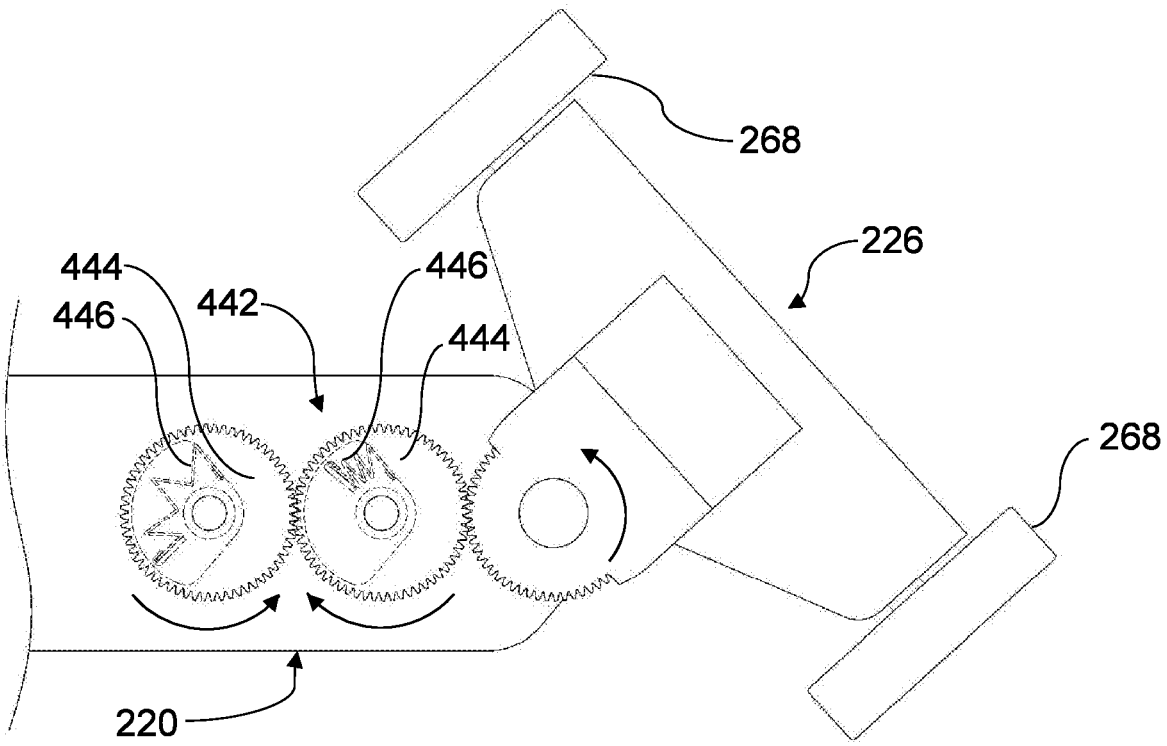
FIG. 45 is an elevation view of the steering dampener embodiment of FIG. 44 with rotation of the chassis assembly in a third angular direction, and resulting rotation of the truck assembly with respect to the chassis assembly.
Figure 46:
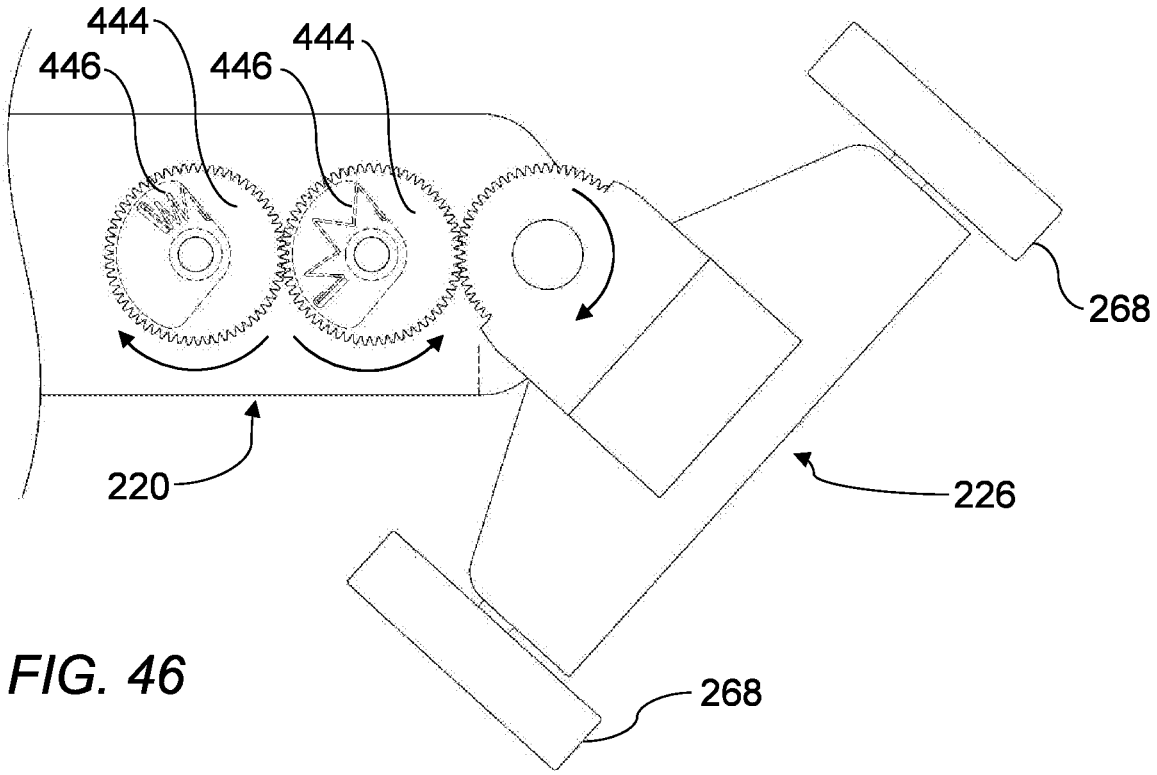
FIG. 46 is an elevation view of the steering dampener embodiment of FIG. 44 with rotation of the chassis assembly in a fourth angular direction, and resulting rotation of the truck assembly with respect to the chassis assembly.

Another embodiment of a steering dampener mechanism 442 is depicted in FIGS. 44-46. In this case the rotation powered vehicle 216 includes a total of two steering dampener mechanisms 442, with one steering dampener mechanism 442 coupled between each truck assembly 226 and 228 and the chassis assembly 220. The steering dampener mechanism embodiment 442 may include a dampener gear 444 which is rotationally secured to a chassis assembly 220 of the rotation powered vehicle 216. The dampener gear 444 may be operatively coupled to the truck assembly 226 (which may also be configured with a geared surface) which in turn may be pivotally secured to the chassis assembly 220. The steering dampener mechanism 442 may also include a dampener gear spring 446 which is operatively coupled between the dampener gear 444 and the chassis assembly 220. The dampener gear spring 446 may be configured to provide a restorative force to the dampener gear 444 and truck assembly 226 when rotation of the chassis assembly 220 in the third angular direction 64 or fourth angular direction 66 results in rotation from a neutral steering position (see FIG. 43) of the truck assembly 226 about a tuck pivot axis 231.

For some embodiments the steering dampener mechanism 442 may further include at least one additional dampener gear 444 which is operatively coupled to the dampener gear 444 which is operatively coupled to the truck assembly 226. The at least one additional dampener gear 444 being operatively coupled to a respective dampener gear spring 446 which may be configured to provide a restorative force to the at least one additional dampener gear 444 with rotation of the chassis assembly 220 in the third angular direction 64 or fourth angular direction 66 results in rotation from a neutral steering position (see FIG. 43) of the truck assembly 226 about the chassis assembly 220. For some embodiments, the dampener gear spring 446 may be configured as a torsion spring. For some other embodiments, the dampener gear spring 446 may be configured as a leaf spring.

Figure 55:
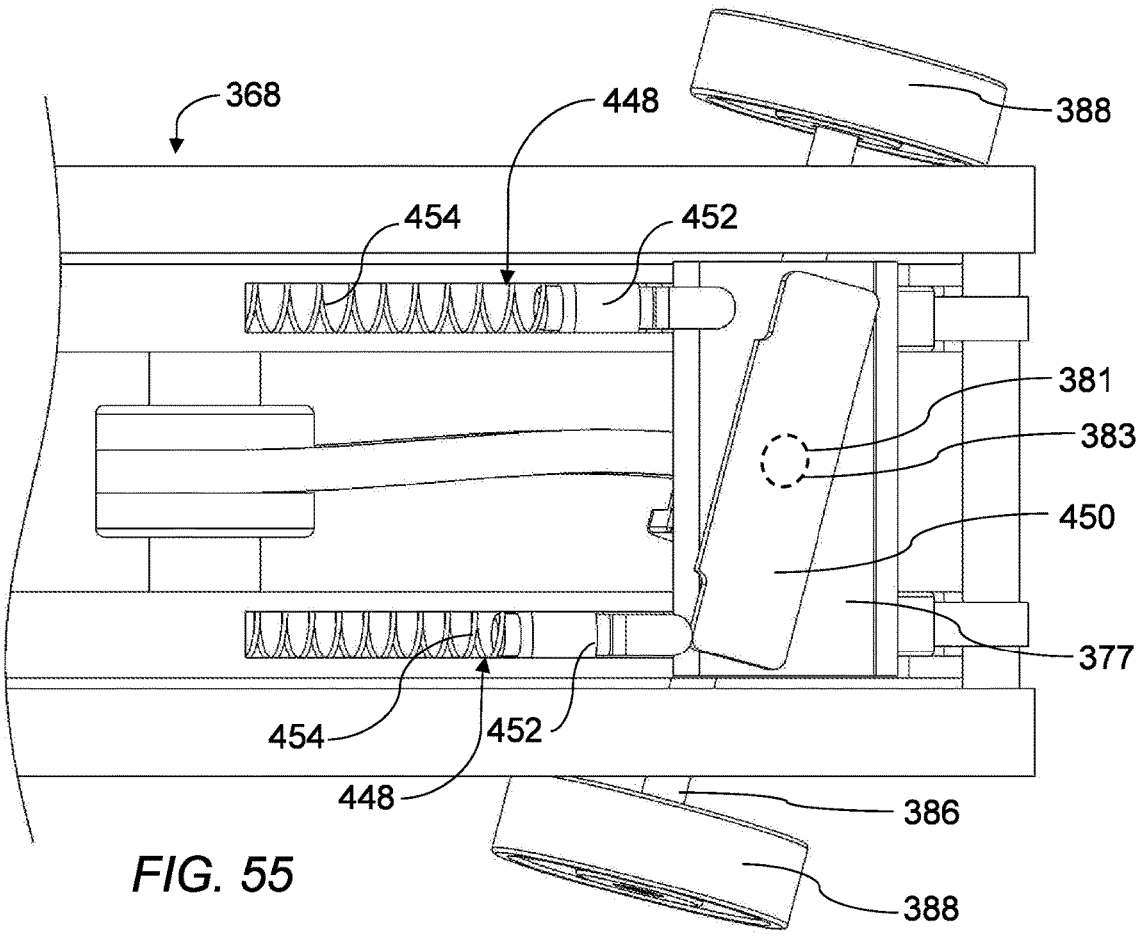
FIG. 55 is an elevation view of a steering dampener mechanism embodiment including a truck dampener plate, multiple dampener carts, and multiple dampener cart springs.
Figure 56:
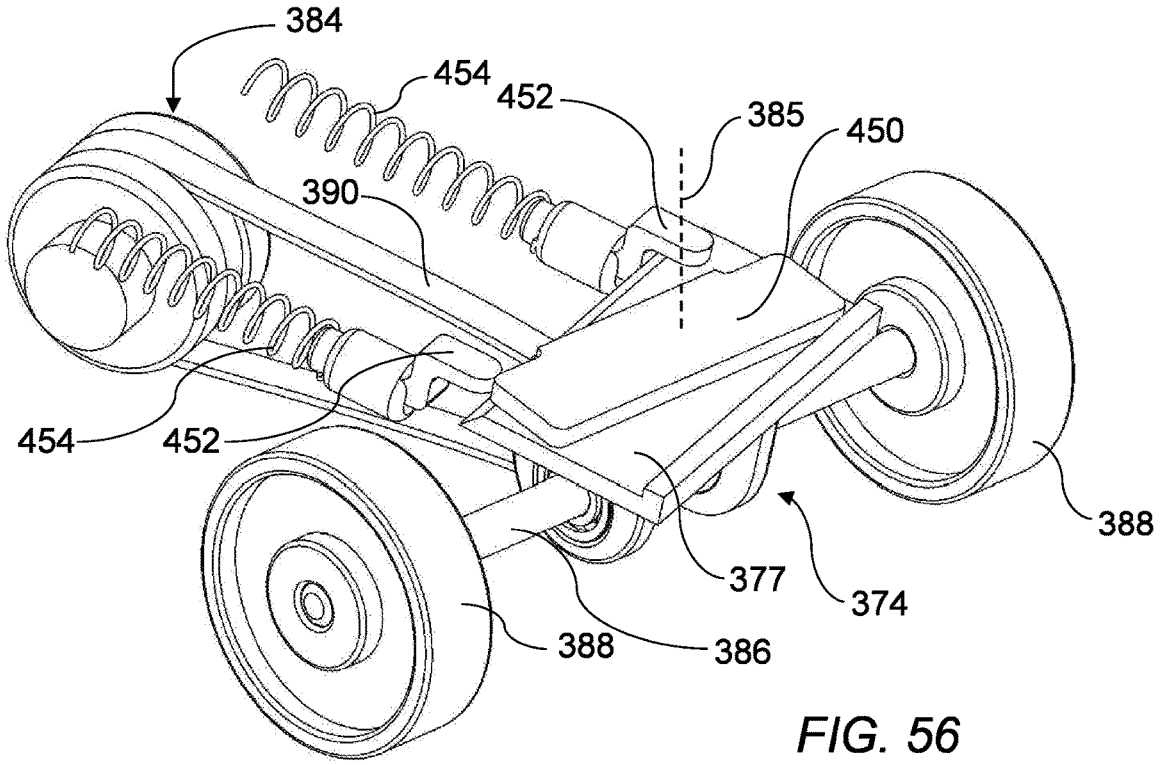
FIG. 56 is a perspective view of the steering dampener mechanism embodiment of FIG. 55.
Figure 57:
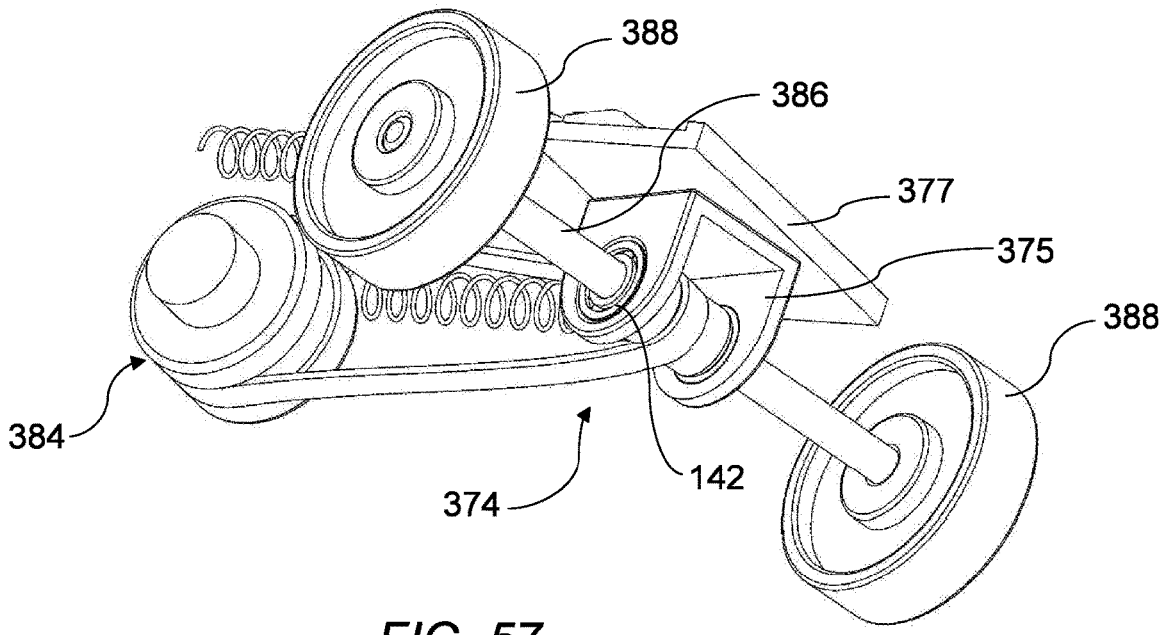
FIG. 57 is a perspective view of the steering dampener mechanism embodiment of FIG. 55.

Another embodiment of a steering dampener mechanism 448 is depicted in FIGS. 55-57. In this case the rotation powered vehicle 364 includes a total of two steering dampener mechanisms 448, with one steering dampener mechanism coupled between each truck assembly 374 and 376 and the chassis assembly 368. The steering dampener mechanism embodiment 448 may include a truck dampener plate 450 which may be rigidly secured to the truck assembly 374 of the rotation powered vehicle 364. The steering dampener mechanism embodiment 448 may further include a dampener cart 452 which is slidably disposed within the chassis assembly 368, with the dampener cart 452 being operatively coupled to the truck dampener plate 450.

Figure 54:
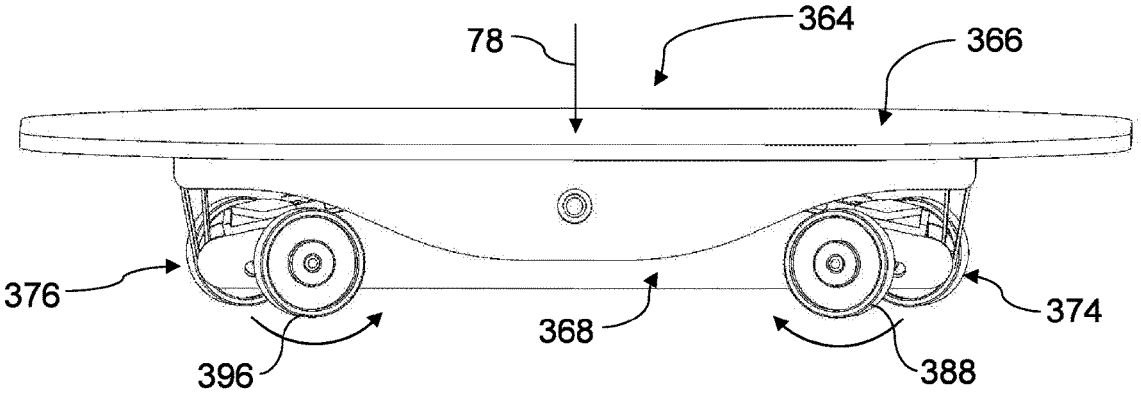
FIG. 54 is a perspective view of the rotation powered vehicle of FIG. 47 under the application of an eccentric steering force and the resultant motion of truck assemblies with respect to the chassis assembly.

The steering dampener mechanism 448 may further include a dampener cart spring 454 which is operatively coupled to the dampener cart 452. The dampener cart spring 454 may be configured to provide a restorative force to the dampener cart 452, truck dampener plate 450, and truck assembly 374 when rotation of the platform assembly 366 in the third angular direction 64 or fourth angular direction 66 results in rotation from a neutral steering position (see FIG. 54) of the truck assembly 374 about the truck pivot axis 385. For some embodiments, the dampener cart spring 454 may be configured as a tension spring. For some other embodiments, the dampener cart spring 454 may be configured as a compression spring.

Certain embodiments of the technology are set forth in the claim(s) that follow(s).

What is claimed is:

1. A rotation powered vehicle comprising:

A. a chassis assembly;

B. a platform assembly pivotally secured to the chassis assembly such that the platform assembly may rotate with respect to the chassis assembly about a platform rotation axis;

C. a drive mechanism comprising:

(i) a cart assembly operatively coupled between the chassis assembly and the platform assembly such that rotation of the platform assembly with respect to the chassis assembly results in translation of the cart assembly along the chassis assembly;

(ii) a helical drive shaft rotationally secured within the chassis assembly and operatively coupled to the cart assembly such that translation of the cart assembly along the chassis assembly results in rotational motion of the helical drive shaft;

D. a second drive mechanism including:

(i) a second cart assembly operatively coupled between the chassis assembly and the platform assembly such that rotation of the platform assembly with respect to the chassis assembly results in translation of the second cart assembly along the chassis assembly;

(ii) a second helical drive shaft rotationally secured within the chassis assembly and operatively coupled to the second cart assembly whereby translation of the second cart assembly along the chassis assembly induces rotational motion of the second helical drive shaft;

E. a truck assembly pivotally secured to the chassis assembly, the truck assembly including an axle rotationally secured to the truck assembly and operatively coupled to a plurality of wheels, the axle being operatively coupled to the helical drive shaft whereby rotation of the platform assembly with respect to the chassis assembly in a first angular direction results in translation of the cart assembly along the chassis assembly and rotation of the axle and wheels in the first angular direction; and, F. a second truck assembly pivotally secured to the chassis assembly, the second truck assembly including a second axle rotationally secured to the second truck assembly and operatively coupled to a plurality of second wheels, the second axle being operatively coupled to the second helical shaft whereby rotation of the platform assembly with respect to the chassis assembly in a second angular direction results in translation of the second cart assembly along the chassis assembly and rotation of the second axle and second wheels in the first angular direction.

2. A rotation powered vehicle drive mechanism comprising:

an elongated chassis slot disposed within a respective lateral exterior portion of a chassis assembly;

an elongated platform slot disposed within a respective lateral portion of a platform assembly, said elongated platform slot substantially opposed to the chassis slot, the platform assembly being pivotally secured to the chassis assembly thereby allowing for rotation through a platform rotation angle of the platform assembly with respect to the chassis assembly about a platform rotation axis, the rotation resulting in an increase or decrease of a variable slot height, said variable slot height measured between the chassis slot and the platform slot;

a cart assembly disposed between the chassis assembly and the platform assembly and operatively coupled to the chassis slot and to the platform slot, the cart assembly having a cart height and being constrained by chassis slot and the platform slot to a position on the chassis assembly wherein the cart height is substantially equivalent to the variable slot height, the cart assembly thereby configured to translate along the chassis assembly upon rotation of the platform assembly with respect to the chassis assembly;

a helical drive shaft rotationally secured within the chassis assembly and operatively coupled to the cart assembly such that translation of the cart assembly results in rotational motion of the helical drive shaft;

a truck assembly pivotally secured to the chassis assembly, the truck assembly including an axle rotationally secured to the truck assembly and, operatively coupled to a plurality of wheels, and the axle being operatively coupled to the helical drive shaft whereby rotation of the platform assembly with respect to the chassis assembly in a first angular direction results in translation of the cart assembly along the chassis assembly and rotation of the axle and wheels in the first angular direction.

3. The rotation powered vehicle drive mechanism of claim 2 wherein the axle is operatively coupled to the helical drive shaft such that rotation of the platform assembly with respect to the chassis assembly in a second angular direction results in rotation of the axle and respective wheels in the first angular direction.

4. The rotation powered vehicle drive mechanism of claim 2 wherein the cart assembly is operatively coupled to the chassis slot by a chassis cart roller operatively coupled to the cart, and is operatively coupled to the platform slot by a platform cart roller operatively coupled to the cart.

5. The rotation powered vehicle drive mechanism of claim 4 wherein the chassis cart roller and the platform cart roller are configured as bearings.

6. The rotation powered vehicle drive mechanism of claim 4 wherein the cart assembly is slidably and pivotally coupled to the platform slot by a platform cart roller, and is slidably coupled to the chassis slot by a plurality of chassis cart rollers.

7. The rotation powered vehicle drive mechanism of claim 4 wherein the cart assembly is slidably and pivotally coupled to the chassis slot by a chassis cart roller, and is slidably coupled to the platform slot by a plurality of platform cart rollers.

8. The rotation powered vehicle drive mechanism of claim 2 wherein the axle is operatively coupled to the helical drive shaft by at least one miter gear disposed within the truck assembly.

9. The rotation powered vehicle drive mechanism of claim 2 wherein a universal joint is operatively coupled between the helical drive shaft and the axle.

10. The rotation powered vehicle drive mechanism of claim 9 wherein the universal joint is configured as a flexible coupler tube.

11. The rotation powered vehicle drive mechanism of claim 2 wherein the axle is operatively coupled to the wheels by at least one ratchet mechanism.

12. The rotation powered vehicle drive mechanism of claim 11 wherein a ratchet mechanism is operatively coupled between the helical drive shaft and the axle.

13. The rotation powered vehicle drive mechanism of claim 2 further comprising a helical shaft connector which operatively couples the drive mechanism to a second drive mechanism comprising:

a second elongated chassis slot disposed within a respective lateral exterior portion of the chassis assembly;

a second elongated platform slot disposed within a respective lateral portion of a second platform assembly, said second elongated platform slot substantially opposed to the second elongated chassis slot, the second platform assembly being pivotally secured to the chassis assembly thereby allowing for rotation through a platform rotation angle of the second platform assembly with respect to the chassis assembly about a second platform rotation axis, the rotation resulting in an increase or decrease of a second variable slot height, said second variable slot height measured between the second elongated chassis slot and the second platform slot;

a second cart assembly disposed between the chassis assembly and the platform assembly and operatively coupled to the second elongated chassis slot and to the second platform, slot, the second cart assembly having a second cart height and being constrained by second chassis slot and the second platform slot to a position on the chassis assembly wherein the second cart height is substantially equivalent to the second variable slot height, the second cart assembly thereby configured to translate along the chassis assembly upon rotation of the platform assembly with respect to the chassis assembly;

a second helical drive shaft rotationally secured within the chassis assembly and operatively coupled to the second cart assembly such that translation of the second cart assembly results in rotational motion of the second helical drive shaft;

a second truck assembly pivotally secured to the chassis assembly, the second truck assembly including a second axle rotationally secured to the second truck assembly and operatively coupled to a second plurality of wheels, and the second axle being operatively coupled to the second helical drive shaft whereby rotation of the platform assembly with respect to the chassis assembly in a first angular direction results in translation of the second cart assembly along the chassis assembly and rotation of the second axle and second plurality of wheels in the first angular direction and wherein the second axle is operatively coupled to the second helical drive shaft such that rotation of the platform assembly with respect to the chassis assembly in a second angular direction results in rotation of the axle and respective wheels in the first angular direction.

14. The rotation powered drive mechanism of claim 13 wherein the helical shaft connector is configured as a universal joint.

15. The rotation powered drive mechanism of claim 13 wherein the helical shaft connector is configured as a flexible coupling shaft.

16. A method for activating a rotation powered vehicle drive mechanism comprising:

providing a rotation powered vehicle comprising:

a chassis assembly which includes an elongated chassis slot disposed within a respective lateral exterior portion of the chassis assembly;

a platform assembly pivotally secured to the chassis assembly and which includes an elongated platform slot disposed within a respective lateral portion of the platform assembly and configured such that it is substantially opposed to the chassis slot;

a cart assembly operatively coupled to the chassis slot and to the platform slot and disposed between the chassis assembly and the platform assembly, the cart assembly having a cart height;

a helical drive shaft rotationally secured within the chassis assembly and operatively coupled to the cart assembly;

a truck assembly pivotally secured to the chassis assembly, the truck assembly including an axle rotationally secured to the truck assembly and operatively coupled to a plurality of wheels and operatively coupled to the helical drive shaft;

rotating the platform assembly with respect to the chassis assembly thereby decreasing a variable slot height measured between the chassis slot and the platform slot with the cart assembly being constrained by the chassis slot and the platform slot to a position on the chassis assembly wherein the cart height is substantially equivalent to the variable slot height, the rotation resulting in translation of the cart assembly along the chassis assembly, rotation of the helical drive shaft, and rotation of the axle and respective wheels in a first angular direction.

17. The method of claim 16 wherein rotating the platform assembly with respect to the chassis assembly comprises rotation in a first angular direction.

18. The method of claim 16 wherein rotating the platform assembly with respect to the chassis assembly comprises rotation in a second angular direction.

19. The method of claim 16 wherein rotating the platform assembly with respect to the chassis assembly increases a variable slot height measured between the chassis slot and the platform slot.

* * * * *